US012527996B2

(12) United States Patent
Greaney et al.

(10) Patent No.: US 12,527,996 B2
(45) Date of Patent: Jan. 20, 2026

(54) MULTI-PIECE GOLF CLUB HEAD

(71) Applicant: Taylor Made Golf Company, Inc, Carlsbad, CA (US)

(72) Inventors: Mark Greaney, Vista, CA (US); Stephen Kraus, Kaohsiung (TW); Bryan Cheng, Kaohsiung (TW); Kevin Cheng, Kaohsiung (TW); Matthew Greensmith, Carlsbad, CA (US); Christopher Harbert, Carlsbad, CA (US); Todd Beach, San Diego, CA (US); Jake Feuerstein, Beverly, MA (US); Matthew D. Johnson, Carlsbad, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 973 days.

(21) Appl. No.: 17/560,054

(22) Filed: Dec. 22, 2021

(65) Prior Publication Data

US 2022/0184468 A1 Jun. 16, 2022

Related U.S. Application Data

(63) Continuation-in-part of application No. 17/505,511, filed on Oct. 19, 2021, which is a continuation-in-part
(Continued)

(51) Int. Cl.
*A63B 53/04* (2015.01)
*A63B 53/02* (2015.01)

(52) U.S. Cl.
CPC ..... *A63B 53/0433* (2020.08); *A63B 53/02* (2013.01); *A63B 53/0408* (2020.08);
(Continued)

(58) Field of Classification Search
CPC ..... A63B 53/0433; A63B 53/0416; A63B 53/0408; A63B 53/02; A63B 53/0437;
(Continued)

(56) References Cited

U.S. PATENT DOCUMENTS 4,872,685 A 10/1989 Sun
5,273,819 A 12/1993 Jex
(Continued)

FOREIGN PATENT DOCUMENTS

CA 2384522 1/2003
CN 1816374 8/2006
(Continued)

OTHER PUBLICATIONS

Translated Abstract and original publication for Document ID: JP-2016086905-A, titled "Golf Club Head", with an inventor name: Tsujiura Kazuteru, pp. 1-13; published May 23, 2016. (Year: 2016).*

(Continued)

*Primary Examiner* — Sebastiano Passaniti
(74) *Attorney, Agent, or Firm* — Kunzler Bean & Adamson

(57) ABSTRACT

A golf club head that includes a plate opening, a plate-opening recessed ledge defining the plate opening, and a strike plate attached to the plate-opening recessed ledge. The golf club head also comprises a hollow interior cavity. At least a portion of a top half of the plate-opening recessed ledge is made of a first material having a first density and at least a portion of a bottom half of the plate-opening recessed ledge is made of a second material having a second density that is greater than the first density. The top half of the plate-opening recessed ledge is closer to a crown portion of the golf club head than the bottom half of the plate-opening recessed ledge and the bottom half of the plate-opening
(Continued)

recessed ledge is closer to a sole portion of the golf club head than the top half of the plate-opening recessed ledge.

29 Claims, 31 Drawing Sheets

Related U.S. Application Data of application No. 17/389,167, filed on Jul. 29, 2021, now abandoned, which is a continuation-in-part of application No. 17/124,134, filed on Dec. 16, 2020, now Pat. No. 12,121,780.

(52) U.S. Cl.
CPC ..... *A63B 53/0416* (2020.08); *A63B 53/0437* (2020.08); *A63B 53/045* (2020.08); *A63B 53/0466* (2013.01); *A63B 53/047* (2013.01); *A63B 2209/02* (2013.01)

(58) Field of Classification Search
CPC ..... A63B 53/045; A63B 53/0466; A63B 53/2209; A63B 53/047; A63B 2209/02
USPC ..... 473/324–350, 287–292
See application file for complete search history.

(56) References Cited

U.S. PATENT DOCUMENTS 5,377,986 A 1/1995 Viollaz et al.
5,624,331 A 4/1997 Lo et al.
5,665,014 A 9/1997 Sanford et al.
5,997,415 A 12/1999 Wood
6,017,280 A 1/2000 Hubert
6,149,534 A 11/2000 Peters et al.
6,525,157 B2 2/2003 Cozewith
6,773,360 B2 8/2004 Willet et al.
6,800,038 B2 10/2004 Willet et al.
6,824,475 B2 11/2004 Burnett et al.
6,997,820 B2 2/2006 Willet et al.
7,082,665 B2 8/2006 Deshmukh et al.
7,140,974 B2 11/2006 Chao et al.
7,166,040 B2 1/2007 Chao et al.
7,186,190 B1 3/2007 Beach et al.
7,223,180 B2 5/2007 Willet et al.
7,267,620 B2 9/2007 Chao et al.
7,407,447 B2 8/2008 Beach et al.
7,410,425 B2 8/2008 Willet et al.
7,410,426 B2 8/2008 Willet et al.
7,410,428 B1 8/2008 Dawson et al.
7,419,441 B2 9/2008 Hoffman et al.
7,448,963 B2 11/2008 Beach et al.
7,452,285 B2 11/2008 Chao et al.
7,530,904 B2 5/2009 Beach et al.
7,540,811 B2 6/2009 Beach et al.
7,568,985 B2 8/2009 Beach et al.
7,578,753 B2 8/2009 Beach et al.
7,591,738 B2 9/2009 Beach et al.
7,621,823 B2 11/2009 Beach et al.
7,628,707 B2 12/2009 Beach et al.
7,628,712 B2 12/2009 Chao et al.
7,632,194 B2 12/2009 Beach et al.
7,713,142 B2 5/2010 Hoffman et al.
7,717,804 B2 5/2010 Beach et al.
7,717,805 B2 5/2010 Beach et al.
7,731,603 B2 6/2010 Beach et al.
7,744,484 B1 6/2010 Chao et al.
RE41,577 E 8/2010 McLean et al.
7,775,905 B2 8/2010 Beach et al.
7,798,919 B2 9/2010 Kubota et al.
7,846,041 B2 12/2010 Beach et al.
7,871,340 B2 1/2011 Chao et al.
7,874,936 B2 1/2011 Chao
7,874,937 B2 1/2011 Chao
7,874,938 B2 1/2011 Chao
7,887,431 B2 2/2011 Beach et al.
7,963,861 B2 6/2011 Beach et al.
RE42,544 E 7/2011 Chao et al.
7,985,146 B2 7/2011 Lin et al.
8,012,039 B2 9/2011 Greaney et al.
8,025,587 B2 9/2011 Beach et al.
8,096,897 B2 1/2012 Beach et al.
8,163,119 B2 4/2012 Chao
8,235,831 B2 8/2012 Beach et al.
8,235,844 B2 8/2012 Albertson et al.
8,241,143 B2 8/2012 Albertson et al.
8,241,144 B2 8/2012 Albertson et al.
8,303,431 B2 11/2012 Beach et al.
8,337,319 B2 12/2012 Sargent et al.
8,353,786 B2 1/2013 Beach et al.
8,444,505 B2 5/2013 Beach et al.
8,608,591 B2 12/2013 Chao et al.
8,628,434 B2 1/2014 Chao
8,734,271 B2 5/2014 Beach et al.
8,801,541 B2 8/2014 Beach et al.
8,870,678 B2 10/2014 Beach et al.
8,888,607 B2 11/2014 Harbert et al.
8,900,069 B2 12/2014 Beach et al.
8,926,450 B2 1/2015 Takahashi et al.
8,979,669 B2 3/2015 Greaney et al.
9,033,821 B2 5/2015 Beach et al.
9,044,653 B2 6/2015 Wahl et al.
9,174,096 B2 11/2015 Sargent et al.
9,220,953 B2 12/2015 Beach et al.
9,259,625 B2 2/2016 Beach et al.
9,278,267 B2 3/2016 Chao et al.
9,468,816 B2 10/2016 Barelmann et al.
9,662,545 B2 5/2017 Beach et al.
9,925,432 B2 3/2018 Morales et al.
9,943,733 B2 4/2018 Franklin et al.
10,035,049 B1 7/2018 Nielson et al.
10,046,212 B2 8/2018 Sargeant et al.
10,780,327 B2 9/2020 Chao et al.
10,828,540 B2 11/2020 Beach et al.
10,874,915 B2 12/2020 Greensmith et al.
10,874,918 B2 12/2020 Beach et al.
10,881,917 B2 1/2021 Greensmith et al.
10,953,292 B2 3/2021 Beach et al.
11,110,325 B2 9/2021 Spackman et al.
11,130,027 B2 * 9/2021 Chao ..... A63B 60/02
11,219,803 B2 1/2022 Greaney et al.
12,053,677 B2 * 8/2024 Greensmith ..... A63B 53/0458
12,121,780 B2 * 10/2024 Greensmith ..... A63B 53/0437
12,268,940 B2 * 4/2025 Greensmith ..... A63B 53/0437
2001/0055995 A1 12/2001 Cackett et al.
2002/0142861 A1 10/2002 Helmstetter et al.
2002/0193175 A1 12/2002 Soracco et al.
2004/0116208 A1 6/2004 De Shiell et al.
2005/0261082 A1 11/2005 Yamamoto
2007/0004531 A1 1/2007 Galloway et al.
2007/0287554 A1 12/2007 Gilbert et al.
2007/0293344 A1 12/2007 Davis
2008/0015051 A1 1/2008 Roach et al.
2008/0149267 A1 6/2008 Chao
2009/0143167 A1 6/2009 Evans
2009/0163289 A1 6/2009 Chao
2010/0048323 A1 2/2010 Chao et al.
2010/0125000 A1 5/2010 Lee et al.
2010/0160091 A1 6/2010 Boyd et al.
2010/0178996 A1 * 7/2010 Chao ..... A63B 53/0466 473/349
2010/0203983 A1 8/2010 Stites
2010/0279793 A1 11/2010 Burnett et al.
2011/0152000 A1 6/2011 Sargent et al.
2011/0275446 A1 11/2011 Rahrig et al.
2011/0275451 A1 11/2011 Chao
2011/0312437 A1 12/2011 Sargent et al.
2012/0071264 A1 3/2012 Beach et al.
2012/0083361 A1 4/2012 Beach et al.
2012/0122601 A1 5/2012 Beach et al.
2012/0199282 A1 8/2012 Chao et al.
2012/0258818 A1 10/2012 Beach et al.
2013/0123040 A1 5/2013 Willet et al.

(56) References Cited

U.S. PATENT DOCUMENTS

| | | | |
|---|---|---|---|
| 2013/0324300 | A1 | 12/2013 | Beach et al. |
| 2014/0011605 | A1 | 1/2014 | Lee |
| 2014/0080632 | A1 | 3/2014 | Deshmukh et al. |
| 2014/0302946 | A1 | 10/2014 | Rae et al. |
| 2015/0196972 | A1 | 7/2015 | Wohl et al. |
| 2015/0335963 | A1 | 11/2015 | Sugimae et al. |
| 2017/0072275 | A1 | 3/2017 | Mitzel et al. |
| 2018/0071589 | A1 | 3/2018 | Beach et al. |
| 2018/0154224 | A1 | 6/2018 | Bovee et al. |
| 2018/0178087 | A1 | 6/2018 | Beach et al. |
| 2018/0185719 | A1 | 7/2018 | Johnson et al. |
| 2019/0046845 | A1 | 2/2019 | Greensmith et al. |
| 2019/0201759 | A1 | 7/2019 | Hoffman et al. |
| 2020/0023247 | A1 | 1/2020 | Larsen et al. |
| 2020/0121994 | A1 | 4/2020 | Greensmith et al. |
| 2020/0139208 | A1 | 5/2020 | Johnson et al. |
| 2020/0215399 | A1 | 7/2020 | Stokke |
| 2021/0060392 | A1 | 3/2021 | Greaney et al. |
| 2021/0101056 | A1 | 4/2021 | Chao et al. |
| 2021/0121749 | A1 | 4/2021 | Willett et al. |
| 2022/0184466 | A1 | 6/2022 | Greensmith et al. |
| 2022/0184471 | A1 | 6/2022 | Greaney |
| 2022/0184746 | A1 | 6/2022 | Greaney |
| 2022/0193505 | A1 | 6/2022 | Greensmith et al. |
| 2023/0381605 | A1 | 11/2023 | Chou et al. |
| 2024/0308004 | A1 | 9/2024 | Greaney et al. |

FOREIGN PATENT DOCUMENTS

| | | |
|---|---|---|
| CN | 1925892 | 3/2007 |
| CN | 107115643 | 9/2017 |
| CN | 206979990 | 2/2018 |
| CN | 109999445 | 7/2019 |
| CN | 111054038 | 4/2020 |
| CN | 113543857 | 10/2021 |
| JP | H06238019 | 8/1994 |
| JP | 2007229002 | 9/2007 |
| JP | 2017189700 | 10/2017 |
| JP | 2019013376 | 1/2019 |
| JP | 2019130294 | 8/2019 |
| JP | 2020075102 | 5/2020 |
| JP | 2020103942 | 7/2020 |
| JP | 2020108814 | 7/2020 |
| JP | 2020202984 | 12/2020 |
| TW | M283662 | 12/2005 |
| TW | 201936238 | 9/2019 |
| TW | 201940210 | 10/2019 |
| TW | 202041258 | 11/2020 |

OTHER PUBLICATIONS

Machine language translation of Document ID: JP-2016086905-A, pp. 1-11, retrieved from Espacenet Patent search at https://worldwide.espacenet.com/singleLineSearch?locale=en_EP; retrieved May 16, 2025. (Year: 2025).*

Office Action for Taiwan Patent Application No. 112103965 dated Nov. 3, 2023.

Office Action for Taiwan Patent Application No. 112119448 dated Dec. 7, 2023.

United States Golf Associate and R&A Rules Limited, Procedure for Measuring the Club Head Size of Wood Clubs; Revision 1.0.0, Nov. 21, 2003.

Hopley, M., TaylorMade M6 Driver Review, GOLFALOT, https://www.golfalot.com/equipment-reviews/taylormade-m6-driver-review-4143.aspx, accessed Dec. 28, 2020.

U.S. Appl. No. 16/752,397, filed Jan. 24, 2020.

U.S. Appl. No. 16/660,561, filed Oct. 22, 2019.

U.S. Appl. No. 17/006,561, filed Aug. 28, 2020.

GLOIRE Reserve Driver Limitless Technology, YouTube video, https://www.youtube.com/watch?v=dNqGaGIn57M, accessed Dec. 29, 2020.

Achenbach, J., 2002: Business—Callaway's C4 looking to break sound barrier, Golfweek, https://golfweek.usatoday.com/2002/11/02/2002-business-callaways-c4-looking-break-sound-bar/, accessed Dec. 29, 2020.

Callaway Big Bertha C4 Carbon Fiber Driver & Cover NM, https://www.worthpoint.com/worthopedia/callaway-big-bertha-c4-carbon-fiber-169221581, accessed Dec. 29, 2020.

Palmiere, et al., Laser Ablation Surface Preparation Of Ti-6AI-4V For Adhesive Bonding, National Institute of Aerospace, Hampton, VA, pp. 1-13.

U.S. Appl. No. 17/124,134, filed Dec. 16, 2020.

Belcher, M.A., Laser Surface Preparation and Bonding of Aerospace Structural Composites, National Institute of Aerospace, Hampton, VA, pp. 1-7.

Office Action for Taiwan Patent Application No. 110142729 dated Jul. 14, 2022.

Office Action for Chinese Patent Application No. 202111541194.2 dated Dec. 28, 2022.

Office Action for Chinese Patent Application No. 202111541194.2 dated May 19, 2023.

Hopley, M., Nike Vapor Flex 440 Driver Review, GOLFALOT, https://www.golfalot.com/equipment-reviews/nike-vapor-flex-440-driver-review-3384.aspx, accessed Sep. 16, 2021.

Nike News, Vapor Fly Clubs, pp. 9-23, https://news.nike.com/news/vapor-fly-clubs, accessed Sep. 16, 2021.

Vapor Fly Clubs, https://news.nike.com/news/vapor-fly-clubs, accessed Mar. 8, 2022.

Office Action for Japanese Patent Application No. 2021-196622 dated Oct. 26, 2022.

* cited by examiner

MULTI-PIECE GOLF CLUB HEAD

FIELD

This disclosure relates generally to golf clubs, and more particularly to a golf club head constructed of multiple parts adhesively bonded together.

BACKGROUND

In the early history of golf, golf club heads were made primarily of a single material, such as wood. Subsequently, golf club heads progressed away from a construction made primarily from wood to one made primarily of metal. Initial golf club heads made of metal were made of steel alloys. Over time, golf club heads started to be made of titanium alloys. Some, but not all, golf club head manufacturers have transitioned away from use of a single material to a multi-material and multi-piece construction. The use of multiple pieces and the use of multiple materials can provide various manufacturing and performance advantages. The multiple pieces of a multi-piece golf club head can be bonded together in a variety of ways, such as adhesive bonding and welding.

Often, the strength of the bond between bonded pieces of a multi-piece golf club head affects the durability of the golf club head and thus the performance of the golf club head over time. A weak bond tends to accelerate degradation of the bond as the golf club head is used to impact golf balls. Degradation in a bond between bonded pieces can lead to a diminution of the performance of the golf club head, such as via a reduction in stiffness and lack of proper load transfer, at best, and complete failure of the golf club head, at worst. Typically, the strike face of a driver-type golf club head undergoes several thousand collisions with a golf ball through its life-cycle. Each collision imparts a force onto the strike face in the range of 10,000 to 20,000 g, where g is equal to the force per unit mass due to gravity. Repeated impacts, at such high forces, tends to cause degradation of the bonds forming the golf club head. Accordingly, a strong initial and durable bond between bonded pieces of a golf club head is desired.

Because welding generally provides a stronger initial bond and can exhibit a higher durability compared to other bonding techniques, the pieces of many conventional multi-piece golf club heads utilize materials, such as compatible metals, that are conducive to welding. However, many metals used to construct multi-piece golf club heads have a higher mass than non-metallic materials. Therefore, the mass available to for distribution around such golf club heads (otherwise known as discretionary mass), which can be utilized for promote the performance of golf club heads, can be limited. difficult. For this reason, providing a multi-piece golf club head that has strong and durable bonds between the pieces of the golf club head and that promotes an increase in discretionary mass can be difficult.

SUMMARY

The subject matter of the present application has been developed in response to the present state of the art, and in particular, in response to the shortcomings of golf club heads with a multi-piece construction, that have not yet been fully solved. Accordingly, the subject matter of the present application has been developed to provide a golf club head that overcomes at least some of the above-discussed shortcomings of conventional golf club heads.

The following portion of this paragraph delineates example 1 of the subject matter, disclosed herein. According to example 1, a golf club head comprises a crown portion, defining a crown of the golf club head, a sole portion, opposite the crown portion and defining a sole of the golf club head, a heel portion, defining a heel of the golf club head and located between the crown portion and the sole portion, a toe portion, defining a toe of the golf club head, located between the crown portion and the sole portion, and opposite the heel portion, a rearward portion, located between the crown portion and the sole portion, a forward portion, opposite the rearward portion and located between the crown portion and the sole portion. The heel portion and the sole portion are located between the forward portion and the rearward portion. The forward portion comprises a plate opening, a plate-opening recessed ledge defining the plate opening, and a strike plate attached to the plate-opening recessed ledge and covering the plate opening. The golf club head also comprises a hollow interior cavity, defined and enclosed by the crown portion, the sole portion, the heel portion, the toe portion, the rearward portion, and the forward portion. At least a portion of a top half of the plate-opening recessed ledge is made of a first material having a first density and at least a portion of a bottom half of the plate-opening recessed ledge is made of a second material having a second density that is greater than the first density. The top half of the plate-opening recessed ledge is closer to the crown portion than the bottom half of the plate-opening recessed ledge and the bottom half of the plate-opening recessed ledge is closer to the sole portion than the top half of the plate-opening recessed ledge.

The following portion of this paragraph delineates example 2 of the subject matter, disclosed herein. According to example 2, which encompasses example 1, above, the strike plate is adhesively bonded to the plate-opening recessed ledge.

The following portion of this paragraph delineates example 3 of the subject matter, disclosed herein. According to example 3, which encompasses example 1 or 2, above, the forward portion comprises a continuous collar and a forward insert attached to the continuous collar. Additionally, the continuous collar is made of the first material and defines the at least the portion of the top half of the plate-opening recessed ledge. Also, the forward insert is made of the second material and defines the at least the portion of the bottom half of the plate-opening recessed ledge.

The following portion of this paragraph delineates example 4 of the subject matter, disclosed herein. According to example 4, which encompasses example 3, above, the forward insert is closer to the heel of the golf club head than the toe of the golf club head.

The following portion of this paragraph delineates example 5 of the subject matter, disclosed herein. According to example 5, which encompasses any one of examples 3 or 4, above, the forward insert defines a forwardmost point of the golf club head and a bottommost point of the golf club head.

The following portion of this paragraph delineates example 6 of the subject matter, disclosed herein. According to example 6, which encompasses any one of examples 3-5, above, the forward insert forms part of the forward portion and the sole portion, and defines a portion of the sole of the golf club head.

The following portion of this paragraph delineates example 7 of the subject matter, disclosed herein. According to example 7, which encompasses any one of examples 3-6, above, the forward insert is adhesively bonded to the continuous collar.

The following portion of this paragraph delineates example 8 of the subject matter, disclosed herein. According to example 8, which encompasses any one of the examples 1-7, above, the continuous collar comprises a forward notch at a forward edge of the continuous collar and extending rearwardly from the forwardmost portion of the continuous collar. The forward insert is nestably received within the forward notch of the continuous collar.

The following portion of this paragraph delineates example 9 of the subject matter, disclosed herein. According to example 9, which encompasses example 8, above, the continuous collar comprises an insert-retention receptacle that is circumferentially closed. The forward insert comprises an insert-retention projection. The insert-retention projection of the forward insert is nestably received within the insert-retention receptacle of the continuous collar.

The following portion of this paragraph delineates example 10 of the subject matter, disclosed herein. According to example 10, which encompasses example 9, above, the insert-retention receptacle of the continuous collar and the insert-retention projection of the forward insert are closer to the toe of the golf club head than the heel of the golf club head.

The following portion of this paragraph delineates example 11 of the subject matter, disclosed herein. According to example 11, which encompasses any one of examples 8-10, the continuous collar comprises an insert-retention ridge, protruding in a crown-to-sole direction and having a forward-facing surface and a rearward-facing surface. The forward insert comprises an insert-retention channel having a forward-facing surface and a rearward-facing surface. The insert-retention ridge of the continuous collar is nestably received within the insert-retention channel of the forward insert such that the forward-facing surface of the insert-retention ridge is directly engaged with the rearward-facing surface of the insert-retention channel and the rearward-facing surface of the insert-retention ridge is directly engaged with the forward-facing surface of the insert-retention channel.

The following portion of this paragraph delineates example 12 of the subject matter, disclosed herein. According to example 12, which encompasses example 11, above, the insert-retention ridge of the continuous collar and the insert-retention channel of the forward insert is closer to the heel of the golf club head than the toe of the golf club head.

The following portion of this paragraph delineates example 13 of the subject matter, disclosed herein. According to example 13, which encompasses any one of examples 11 or 12, above, the continuous collar comprises an internal valley that defines the insert-retention ridge. The internal valley extends parallel to the strike face. The continuous collar further comprises a rib that extends across the internal valley in a direction perpendicular to the strike face.

The following portion of this paragraph delineates example 14 of the subject matter, disclosed herein. According to example 14, which encompasses any one of examples 3-13, above, a thickness of a heelward portion of the forward insert gradually increases in a toe-to-heel direction.

The following portion of this paragraph delineates example 15 of the subject matter, disclosed herein. According to example 15, which encompasses any one of examples 3-14, above, an outer surface of the continuous collar is flush with an outer surface of the forward insert.

The following portion of this paragraph delineates example 16 of the subject matter, disclosed herein. According to example 16, which encompasses any one of examples 3-15, above, the forward insert defines a portion of the sole of the golf club head. The forward insert comprises a slot formed in the portion of the sole defined by the forward insert. The slot is open to the hollow interior cavity. An entirety of the slot is confined within the forward insert.

The following portion of this paragraph delineates example 17 of the subject matter, disclosed herein. According to example 17, which encompasses any one of examples 3-16, above, the golf club head further comprises a hosel, located at the heel portion of the golf club head and defining a bore, a shaft, extending at least partially through the bore, and a fastener, fastened to the shaft such that the shaft is selectively attached to the hosel. The forward insert comprises a fastener port that is open to the bore of the hosel and through which the fastener is passable for fastening to the shaft.

The following portion of this paragraph delineates example 18 of the subject matter, disclosed herein. According to example 18, which encompasses any one of examples 3-17, above, the continuous collar comprises an internal rib, parallel to the strike plate and rearwardly offset from the at least the portion of the bottom half of the plate-opening recessed ledge defined by the forward insert.

The following portion of this paragraph delineates example 19 of the subject matter, disclosed herein. According to example 19, which encompasses any one of examples 3-18, above, the continuous collar defines at least a portion of the bottom half of the plate-opening recessed ledge.

The following portion of this paragraph delineates example 20 of the subject matter, disclosed herein. According to example 20, which encompasses any one of examples 1-19, above, the strike plate is made of a third material having a third density that is less than the first density.

The following portion of this paragraph delineates example 21 of the subject matter, disclosed herein. According to example 21, which encompasses example 20, above, the first material is a titanium alloy, the second material is one of a steel alloy or a tungsten alloy, and the third material is a fiber-reinforced polymer.

The following portion of this paragraph delineates example 22 of the subject matter, disclosed herein. According to example 22, which encompasses any one of examples 1-21, above, the sole portion comprises a sole opening, a sole-opening recessed ledge defining the sole opening, and a sole insert attached to the sole-opening recessed ledge and covering the sole opening. A first portion of the sole-opening recessed ledge is made of the first material. A second portion of the sole-opening recessed ledge is made of the second material.

The following portion of this paragraph delineates example 23 of the subject matter, disclosed herein. According to example 23, which encompasses example 22, above, the forward portion comprises a continuous collar and a forward insert attached to the continuous collar. The continuous collar is made of the first material, defines the at least the portion of the top half of the plate-opening recessed ledge, and defines the first portion of the sole-opening recessed ledge. The forward insert is made of the second material, defines the at least the portion of the bottom half of the plate-opening recessed ledge, and defines the second portion of the sole-opening recessed ledge.

The following portion of this paragraph delineates example 24 of the subject matter, disclosed herein. According to example 24, which encompasses example 23, above, the sole insert is made of a third material having a third density that is less than the first density.

The following portion of this paragraph delineates example 25 of the subject matter, disclosed herein. According to example 25, which encompasses example 24, above, the first material is a titanium alloy, the second material is one of a steel alloy or a tungsten alloy, and the third material is a fiber-reinforced polymer.

The following portion of this paragraph delineates example 26 of the subject matter, disclosed herein. According to example 26, which encompasses any one of examples 1-25, above, the golf club head further comprises at least six pieces adhesively bonded together.

The following portion of this paragraph delineates example 27 of the subject matter, disclosed herein. According to example 27, which encompasses example 26, above, the at least six pieces comprises a continuous collar, made of the first material and defining the at least the portion of the top half of the plate-opening recessed ledge, a forward insert made of the second material, defining the at least the portion of the bottom half of the plate-opening recessed ledge, and adhesively bonded directly to the continuous collar, a strike plate, adhesively bonded directly to both the continuous collar and the forward insert, a ring, adhesively bonded directly to the continuous collar, a crown insert, adhesively bonded directly to the continuous collar and the ring, and a sole insert, adhesively bonded directly to the continuous collar, the ring, and the forward insert.

The following portion of this paragraph delineates example 28 of the subject matter, disclosed herein. According to example 28, which encompasses example 27, above, the ring is made of a third material having a third density less than the first density. The strike plate, the crown insert, and the sole insert are made of a fourth material having a fourth density less than the third density.

The following portion of this paragraph delineates example 29 of the subject matter, disclosed herein. According to example 29, which encompasses example 28, above, the first material is a titanium alloy, the second material is one of a steel alloy or a tungsten alloy, the third material is one of an aluminum alloy or plastic, and the fourth material is a fiber-reinforced polymer.

The described features, structures, advantages, and/or characteristics of the subject matter of the present disclosure may be combined in any suitable manner in one or more examples and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example or implementation. In other examples, additional features and advantages may be recognized in certain examples and/or implementations that may not be present in all examples or implementations. Further, in some examples, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings depict only typical examples of the subject matter and are not therefore to be considered to be limiting of its scope, the subject matter will be described and explained with additional specificity and detail through the use of the drawings, in which.

DETAILED DESCRIPTION

Figure 1:
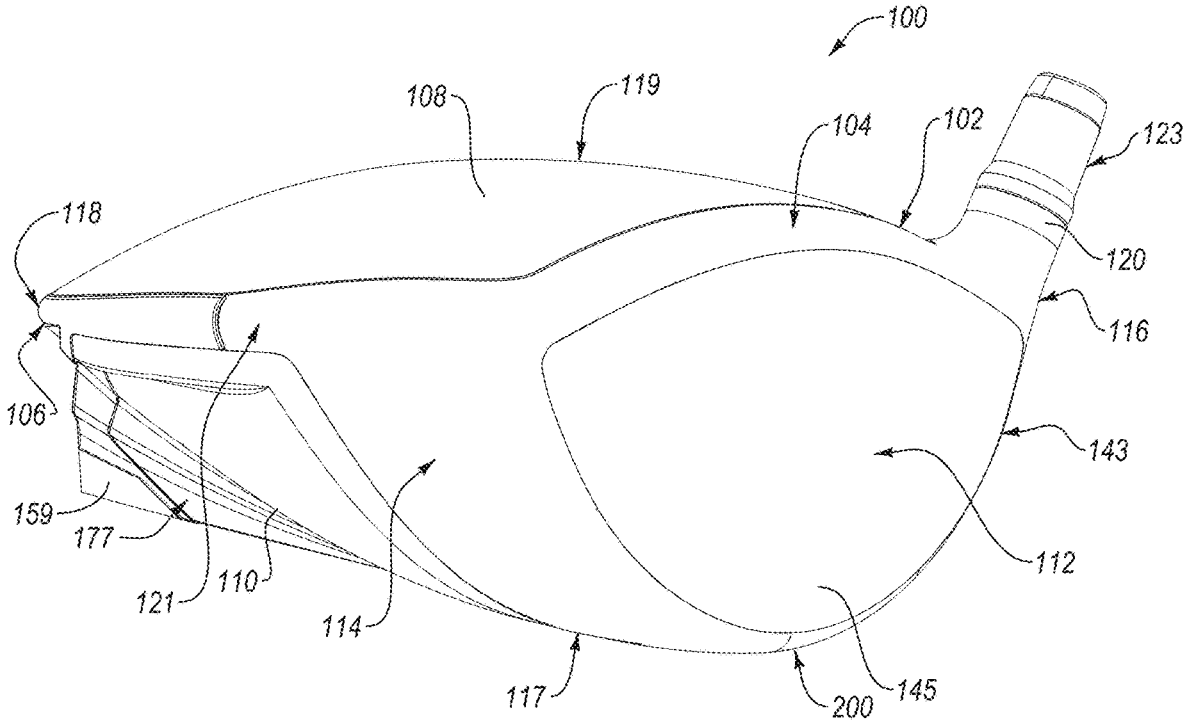
FIG. 1 is a schematic, perspective view of a golf club head, according to one or more examples of the present disclosure.
Figure 2:
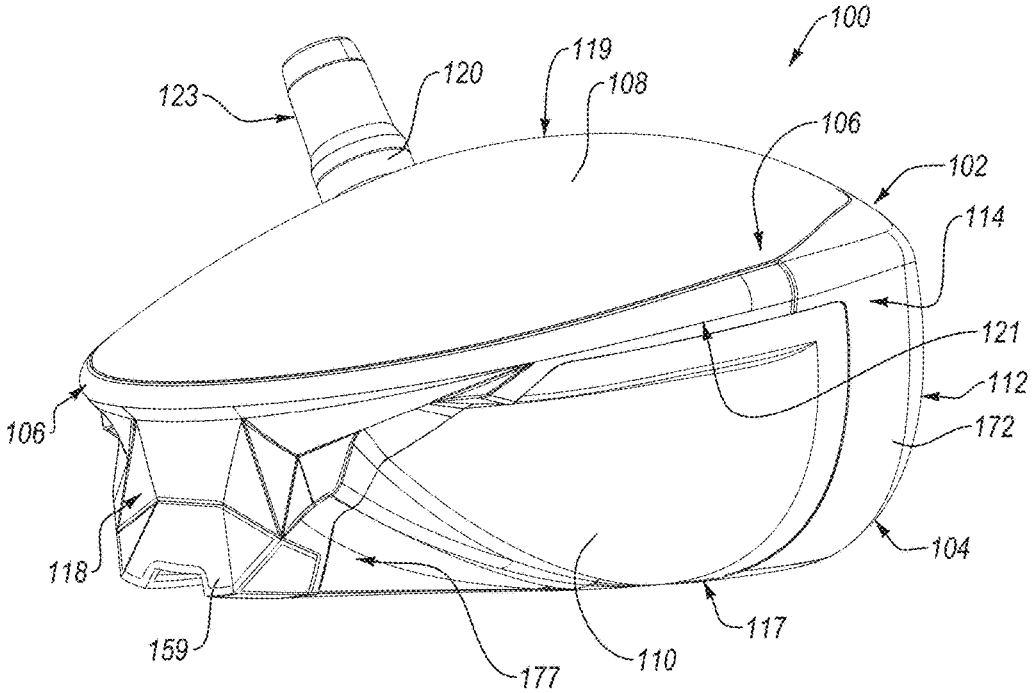
FIG. 2 is a schematic, perspective view of the golf club head of FIG. 1, according to one or more examples of the present disclosure.

The following describes examples of golf club heads in the context of a driver-type golf club head having a multi-piece construction, but the principles, methods and designs described may be applicable, in whole or in part, to fairway wood golf club heads, utility golf club heads (also known as hybrid golf club heads), iron-type golf club heads, and the like, because such golf club heads can also be made to have a multi-piece construction.

In some examples disclosed herein, the golf club head has a strike face formed of a non-metallic material, such as a fiber-reinforced polymeric material. A breakdown of the adhesive joint formed between a metallic portion of the golf club head and a non-metallic strike plate can cause characteristic time (CT) creep. USGA regulations require the CT of a golf club head to remain within the regulated limit regardless of the number of impacts the golf club head has with a golf ball. The CT of conventional driver-type golf club heads tends to increase after multiple impacts with a golf ball. The increase of CT due to impacts with a golf ball is known as CT creep. In certain examples disclosed herein, the golf club heads are configured to strengthen the adhesive joint formed between the metallic portion of the golf club heads and the non-metallic strike plate, such as by optimizing the surface structure of the golf club head for stronger adhesive bonds.

Additionally, because fiber-reinforced polymeric materials have a lower density than other materials (e.g., steel alloys, titanium alloys, and the like) that form conventional strike faces, making a strike face out of a fiber-reinforced polymeric material results in less mass at the forward extents of the golf club, which has a tendency to decrease the inertia of the golf club head. Traditionally, a higher inertia, which usually results in an increase in performance and forgiveness of a golf club head, is desired. Some golf club heads incorporate high density weights or mass pads into the sole portion of the golf club heads. However, such configurations fail to concentrate mass adequately forward and low enough on the golf club head to properly compensate for the forward reduction of mass introduced by strike faces made of a fiber-reinforced polymeric material. Accordingly, in some examples disclosed herein, the golf club head of the present disclosure includes features that compensate for the drop in forwardly-located mass associated with a strike face made of a fiber-reinforced polymeric material by concentrating mass as forwardly and as low on the golf club head as possible.

U.S. Patent Application Publication No. 2014/0302946 A1 ('946 App), published Oct. 9, 2014, which is incorporated herein by reference in its entirety, describes a "reference position" similar to the address position used to measure the various parameters discussed throughout this application. The address or reference position is based on the procedures described in the United States Golf Association and R&A Rules Limited, "Procedure for Measuring the Club Head Size of Wood Clubs," Revision 1.0.0, (Nov. 21, 2003). Unless otherwise indicated, all parameters are specified with the club head in the reference position.

FIGS. 3, 4, 5, and 10 are examples that show a golf club head 100 of the present disclosure in the address or reference position on a ground plane 181. The golf club head 100 is in the address or reference position on the ground plane 181 when a centerface target line vector normal to the club face (or "ball striking surface" or "striking surface") 145 substantially lies in a first vertical plane (a vertical plane is perpendicular to the ground plane 181), a centerline axis or hosel axis 191 of the club shaft (or "club shaft axis"), substantially lies in a second substantially vertical plane ("shaft plane"), and the first vertical plane and the second substantially vertical plane substantially perpendicularly intersect. The centerface target line vector is defined as a horizontal vector that points forward (along the y-axis) from the center face 183. For purposes of this disclosure, the center face 183 is also be referred to as the "geometric center" of the ball striking surface 145. See also U.S.G.A. "Procedure for Measuring the Flexibility of a Golf Clubhead," Revision 2.0 for the methodology to measure the geometric center of the striking face. At normal address position, the club shaft axis 191 defines a lie angle relative to the ground plane such that the scorelines on the face of the club are horizontal. If the club does not have scorelines, then the normal address position lie angle is typically 60-degrees.

As shown in FIGS. 3, 4, 5, and 10, positioning the golf club head 100 in the address or reference position lends itself to using a club head origin coordinate system 185, centered at a geometric center (e.g., center face 183) of the strike face 145, for making various measurements. With the golf club head in the address or reference position, using the USGA methodology, various parameters described throughout this application including head height, club head center of gravity (CG) location, and moments of inertia (MOI), can be measured relative to the club head origin coordinate system 185 or relative to another reference or references.

For further details or clarity, the reader is advised to refer to the measurement methods described in the '946 App and the USGA procedure. Notably, however, the origin and axes associated with the club head origin coordinate system 185 used in this application may not necessarily be aligned or oriented in the same manner as those described in the '946 App or the USGA procedure. Further details are provided below on locating the club head origin coordinate system 185.

In some examples, the golf club heads described herein include driver-type golf club heads, which can be identified, at least partially, as golf club heads with strike faces that have a total surface area of at least 3,500 mm^2, preferably at least 3,800 mm^2, and even more preferably at least 3,900 mm^2 (e.g., between 3,500 $mm^2$ and 5,000 $mm^2$ in one example, less than 5,000 $mm^2$ in various examples, and between 3,700 $mm^2$ and 4,300 $mm^2$ in another example). In some examples, such as when the strike face is defined by a non-metal material, the total surface area of the strike face is no more than 4,300 $mm^2$ and no less than 3,300 $mm^2$. The total surface area of the strike face is the outermost area of the striking face, which can be the outermost area of a face insert in some examples. In certain examples, the total surface area of the strike face is the surface area of the surface of the striking face that is bounded on its periphery by all points where the face transitions from a substantially uniform bulge radius (i.e., face heel-to-toe radius of curvature) and a substantially uniform roll radius (i.e., face crown-to-sole radius of curvature) to the body of the golf club head. In certain examples, the strike face of the golf club head disclosed herein is defined in the same manner as in one or more of U.S. Patent Application Publication No. 2020/0139208, filed Oct. 22, 2019, U.S. Pat. No. 8,801,541, issued Aug. 12, 2014, and U.S. Pat. No. 8,012,039, issued Sep. 6, 2011, all of which are incorporated herein by reference in their entirety. In yet some examples, the strike face has a uniform bulge radius and a uniform roll radius, except for portions that have a higher lofted toe and a lower lofted heel, such as described in U.S. patent application Ser. No. 17/006,561, filed Aug. 28, 2020, U.S. Pat. No. 9,814,944, issued Nov. 14, 2017, U.S. Pat. No. 10,265,586, issued Apr. 23, 2019, and U.S. Patent Application Publication No. 2019/0076705, filed Oct. 15, 2018, which are incorporated herein by reference in their entirety.

Additionally, in certain examples, the golf club head 100 includes a center-of-gravity (CG) projection, parallel to a longitudinal horizontal axis (i.e., the y-axis of the club head origin coordinate system 185), which is, in one example, at most 3 mm above or below the center face 183 of the strike face 145, and preferably at most 1 mm above or below the center face 183, as measured along a vertical axis (i.e., the z-axis of the golf club head origin coordinate system 185), or in another example, at most 5 mm below the center face 183 of the strike face 145, and preferably at most 4 mm below the center face 183, as measured along the vertical axis (i.e., the z-axis). In some examples, the CG projection is toe-ward of the geometric center of the strike face 145. According to certain examples, the CG projection is from zero to 4 mm above center face 183, such as from zero to 3 mm above center face 183, or zero to 2.5 mm above center face 183, or from 1.8 mm to 2.2 mm above center face 183.

Moreover, in some examples, the golf club head 100 has a relatively high Izz or moment of inertia about a vertical axis (i.e., a CG z-axis passing through the CG and parallel with the z-axis of the club head origin coordinate system 185). In some examples, Izz >450 kg-mm^2 and preferably Izz >480 kg-mm^2, and more preferably Izz >510 kg-mm^2, but less than 590 kg-mm^2 in certain implementations. According to some examples, the golf club head 100 has a relatively high Ixx or moment of inertia about a horizontal axis (e.g., a CG x-axis passing through the CG and parallel with the x-axis of the club head origin coordinate system 185). In some examples, Ixx >300 kg-mm^2 or 320 kg-mm^2, and more preferably Ixx >320 kg-mm^2, more preferably Ixx >350 kg-mm^2, or 360 kg-mm^2. According to various examples of the golf club head 100, a ratio of Ixx/Izz >0.70. According to certain examples, a summation of Ixx and Izz is greater than 780 kg-mm^2, 800 kg-mm^2, 820 kg-mm^2, 825 kg-mm^2, 850 kg-mm^2, 860 kg-mm^2, 875 kg-mm^2, 900 kg-mm^2, 925 kg-mm^2, 950 kg-mm^2, 975 kg-mm^2, or 1000 kg-mm^2, but less than 1,100 kg-mm^2. For example, the summation of Ixx and Izz can be between 780 kg-mm^2 and 1,000 kg-mm^2, such as greater than 820 kg-mm^2 or greater than 870 kg-mm^2. Ixx is at least 65% of Izz in some examples, even more preferably Ixx is at least 68% of Izz in some examples. The larger inertia values and lower CG projection e.g. no more than 3 mm above the center face 183 can be achieved by including a forward insert and/or a rearward weight as discussed in more detail below. More details about inertia Izz and Ixx can be found in U.S. Patent Application Publication No. 2020/0139208, Published May 7, 2020, which is incorporate herein by reference in its entirety.

In some example, an assembly mass of the golf club head 100 ranges from 190 grams to 210 grams, preferably between 195 grams and 205 grams, preferably between 200 grams and 202 grams, and in some cases less than 203 grams. The golf club head mass includes the mass of any FCT system and fastener to tighten the FCT system, but not the shaft of a golf club of which the golf club head 100 forms a part or the grip of the golf club.

According to certain examples, a maximum distance from a leading edge to a trailing edge of the club head as measured parallel to the y-axis of the golf club head origin coordinate system 185 is preferably between 112 mm and 127 mm, preferably between 115 mm and 127 mm, even more preferably between 119 mm and 127 mm.

The delta-1 of the golf club head 100 is a distance, along the y-axis of the head center face origin coordinate system 185, between the CG of the golf club head 100 and a shaft plane, in which lies the hosel axis 191. The shaft plane is a substantially vertical plane, parallel to the x-axis of the head center face origin coordinate system 185 and perpendicular to the ground plane 181, when the golf club head 100 is in the proper address position on the ground plane 181. The delta-1 can be more than 32 mm in some examples, but in other more preferable examples, the delta-1 is no more than 32 mm, such as from 13 mm to 36 mm, from 15 mm to 27 mm, from 18 mm to 22 mm, from 22 mm to 26 mm, or from 24 mm to 26 mm, in other examples. In certain examples, the Ixx of the golf club head is at least 335 $kg \cdot mm^2$ and the delta-1 is no more than 32 mm, the Ixx of the golf club head is at least 345 $kg \cdot mm^2$ and the delta-1 is no more than 32 mm, the Ixx of the golf club head is at least 355 $kg \cdot mm^2$ and the delta-1 is no more than 32 mm, the Ixx of the golf club head is at least 365 $kg \cdot mm^2$ and the delta-1 is no more than 32 mm, or the Ixx of the golf club head is at least 375 $kg \cdot mm^2$ and the delta-1 is no more than 32 mm. In certain examples, the Ixx of the golf club head 100 is at least 335 $kg \cdot mm^2$ and the delta-1 is between 22 mm and 32 mm, the Ixx of the golf club head 100 is at least 345 $kg \cdot mm^2$ and the delta-1 is between 22 mm and 32 mm, the Ixx of the golf club head 100 is at least 355 $kg \cdot mm^2$ and the delta-1 is between 22 mm and 32 mm, the Ixx of the golf club head 100 is at least 365 $kg \cdot mm^2$ and the delta-1 is between 22 mm and 32 mm, the Ixx of the golf club head 100 is at least 375 $kg \cdot mm^2$ and the delta-1 is between 23 mm and 32 mm, the Ixx of the golf club head 100 is at least 385 $kg \cdot mm^2$ and the delta-1 is between 24 mm and 32 mm, the Ixx of the golf club head 100 is at least 395 $kg \cdot mm^2$ and the delta-1 is between 25 mm and 32 mm, or the Ixx of the golf club head 100 is at least 405 $kg \cdot mm^2$ and the delta-1 is between 27 mm and 32 mm.

Figure 10A:
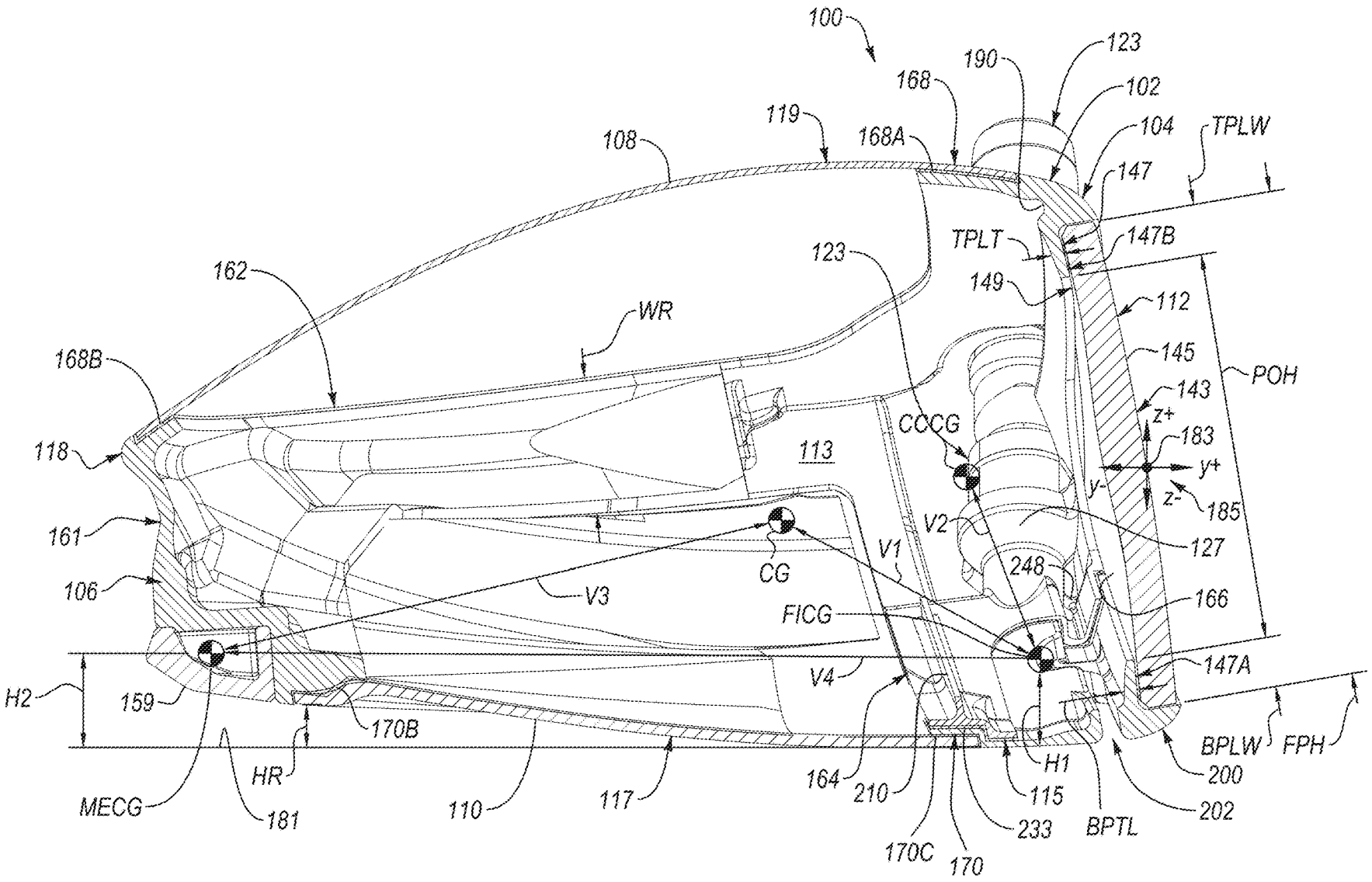
FIG. 10A is a schematic, cross-sectional, side elevation view of the golf club head of FIG. 1, taken along the line 10-10 of FIG. 5, according to one or more examples of the present disclosure.

Referring to FIGS. 1-8, according to some examples, the golf club head 100 of the present disclosure includes a toe portion 114 and a heel portion 116, opposite the toe portion 114. The toe portion 114 includes a toe of the golf club head 100, which is defined as at least a rightmost (e.g., toewardmost) point of the golf club head 100 (not including a hosel 120) as viewed in FIG. 5. Similarly, the heel portion 116 includes a heel of the golf club head 100, which is defined as at least a leftmost (e.g., heelwardmost) point of the golf club head 100 as viewed in FIG. 5. Additionally, the golf club head 100 includes a forward portion 112 (e.g., face portion) and a rearward portion 118, opposite the forward portion 112. The golf club head 100 additionally includes a sole portion 117, at a bottom region of the golf club head 100, and a crown portion 119, opposite the sole portion 117 and at a top region of the golf club head 100. The sole portion 117 includes a sole of the golf club head 100, which is defined as at least a bottommost point of the golf club head 100. The crown portion 119 includes a crown of the golf club head 100, which is defined as at least a topmost point of the golf club head 100. Also, the golf club head 100 includes a skirt portion 121 that defines a transition region where the golf club head 100 transitions between the crown portion 119 and the sole portion 117. Accordingly, the skirt portion 121 is located between the crown portion 119 and the sole portion 117 and extends about a periphery of the golf club head 100. Referring to FIG. 10A, the golf club head 100 further includes an interior cavity 113 that is collectively defined and enclosed by the forward portion 112, the rearward portion 118, the crown portion 119, the sole portion 117, the heel portion 116, the toe portion 114, and the skirt portion 121.

Figure 9:
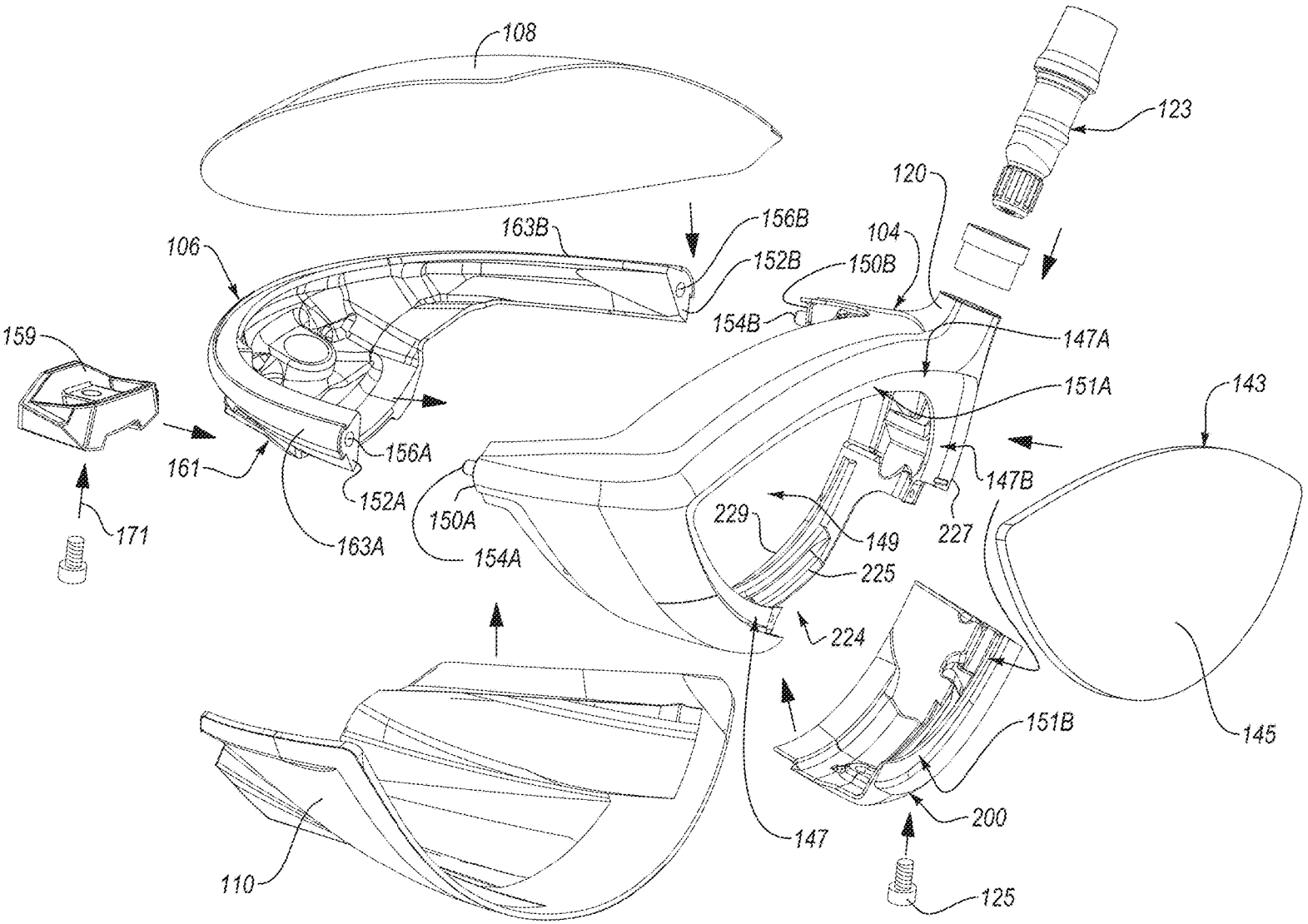
FIG. 9 is a schematic, exploded, perspective view of the golf clubhead of FIG. 1, according to one or more examples of the present disclosure.

The strike face 145 extends upward along the forward portion 112 from the sole portion 117 to the crown portion 119, and heelwardly from the toe portion 114 to the heel portion 116. As further defined, the strike face 145 faces in a generally forward direction. Referring to FIGS. 9 and 10, in some examples, the forward portion 112 of the golf club head 100 includes a strike plate 143. The strike plate 143 is formed separately from other portions of the golf club head 100 and attached to one or more other portions of the golf club head 100, such as via adhesive bonding, welding, brazing, fastening, and the like. According to certain examples, the strike plate 143 defining the strike face 145 includes variable thickness features similar to those described in more detail in U.S. patent application Ser. No. 12/006,060; and U.S. Pat. Nos. 6,997,820; 6,800,038; and 6,824,475, which are incorporated herein by reference in their entirety.

As shown, the strike plate 143 defines the strike face 145 of the golf club head 100. In the illustrated examples, the forward portion 112 of the golf club head 100 further includes a plate opening 149 and a plate-opening recessed ledge 147 that extends continuously about the plate opening 149. The strike plate 143 is attached to the plate-opening recessed ledge 147 and covers the plate opening 149. Although the plate-opening recessed ledge 147 can be planar, in some examples, the plate opening recessed ledge 147 is non-planar or curved. An inner periphery of the plate-opening recessed ledge 147 defines the plate opening 149. The plate-opening recessed ledge 147 is divided into a top half, or top plate-opening recessed ledge 147A and a bottom half, or bottom plate-opening recessed ledge 147B. The top plate-opening recessed ledge 147A extends adjacently along the crown portion 119 of the golf club head 100 in a heel-toe direction, and the bottom plate-opening recessed ledge 147B extends adjacently along the sole portion 117 of the golf club head 100 in a heel-toe direction. Accordingly, the top plate-opening recessed ledge 147A is closer to the crown portion 119 than the bottom plate-opening recessed ledge 147B and the bottom plate-opening recessed ledge 147B is closer to the sole portion 117 than the top plate-opening recessed ledge 147A. Opposing portions of both the top plate-opening recessed ledge 147A and the bottom plate-opening recessed ledge 147B extend in a crown-sole direction along the heel portion 116 and the toe portion 114 of the golf club head 100, respectively. Some properties of a plate-opening recessed ledge can be found in U.S. Pat. No. 9,278,267, issued Mar. 8, 2016, which is incorporated herein by reference in its entirety.

As shown in FIG. 10, the top plate-opening recessed ledge 147A has a width (TPLW) and a thickness (TPLT). The width TPLW is defined as the distance from the inner periphery of the top plate-opening recessed ledge 147A defining the plate opening 149 to the furthest extent of the surface of the top plate-opening recessed ledge 147A away from the inner periphery. The thickness TPLT is defined as the thickness of the material defining the surface of the top plate-opening recessed ledge 147A. In some examples, a recess 190 (e.g., an internal recess) is formed in an internal surface of a continuous collar 104 of the golf club head 100, which defines top plate-opening recessed ledge 147A, and has depth that extends in a back-to-front direction such that in a sole-to-crown direction, the recess 190 is between the top plate-opening recessed ledge 147A and a top of the golf club head 100. In other words, the recess 190 overlaps the top plate-opening recessed ledge 147A in a crown-to-sole direction. Notably, rearward of the recess 190 the thickness of the crown may increase locally such that the thickness of the crown portion proximate to where a crown insert 108 joins the golf club head 100 is thicker than at the recess 190. This may be done to stiffen the overall structure of the crown joint and mitigate stress in the composite crown joint. Otherwise, the composite crown joint may be prone to cracking in that region resulting in a premature failure of the composite crown joint due to the casting cracking and/or the glue failing.

In certain examples, the width TPLW of the top plate-opening recessed ledge 147A is greater than 4.5 mm (e.g., greater than 5.0 mm in some examples and greater than 5.5 mm in other examples, but less than 8.0 mm, preferably less than 7.0 mm in some examples). In some examples, a ratio of the width TPLW to a maximum face plate height (FPH) of the strike plate 143 is between 0.08 and 0.15. In the same or different examples, a ratio of the width TPLW to a maximum plate-opening height (POH) of the plate opening 149 is between 0.07 and 0.15, such as 0.1, where in some examples the maximum POH of the plate opening 149 is between 50-60 mm, such as 53 mm.

According to some examples, the thickness TPLT of the top plate-opening recessed ledge 147A is between a minimum value of 0.8 mm and a maximum value of 1.7 mm (e.g., between 0.9 mm and 1.6 mm in some examples and between 0.95 mm and 1.5 mm in other examples). As shown, the thickness TPLT is greater away from the inner periphery of the top plate-opening recessed ledge 147A (e.g., at a base of the ledge) than at the inner periphery of the top plate-opening recessed ledge 147A (e.g., at a tip of the ledge). Accordingly, the thickness TPLT varies along the width TPLW of the top plate-opening recessed ledge 147A in some examples. For example, as shown, the thickness TPLT tapers or decreases in a crown-to-sole direction (e.g., toward a center of the plate opening 149 or from the base of the ledge to the tip of the ledge). In some examples, the top ledge thickness TPLT of the top plate-opening recessed ledge 147A varies such that a maximum value of the top ledge thickness TPLT is between 30% and 60% greater than a minimum value of the top ledge thickness TPLT. In certain examples, a ratio of the thickness TPLT to a thickness of the strike plate is between 0.2 and 1.2. According to certain examples, a ratio of the width TPLW to the thickness TPLT is between 2.6 and 10.

The bottom plate-opening recessed ledge 147B has a width (BPLW) and a thickness (BPLT). The width BPLW is defined as the distance from the inner periphery of the bottom plate-opening recessed ledge 147B defining the plate opening 149 to the furthest extent of the adhering surface of the bottom plate-opening recessed ledge 147B away from the inner periphery. The thickness BPLT is defined as the thickness of the material defining the adhering surface of the bottom plate-opening recessed ledge 147B.

In certain examples, the width BPLW of the bottom plate-opening recessed ledge 147B is greater than 4.5 mm (e.g., greater than 5.0 mm in some examples and greater than 5.5 mm in other examples, but less than 8.0 mm, preferably less than 7.0 mm in some examples). In some examples, a ratio of the width BPLW to a maximum FPH of the strike plate 143 is between 0.08 and 0.15. In the same or different examples, a ratio of the width BPLW to a maximum POH of the plate opening 149 is between 0.07 and 0.15, such as 0.1, where in some examples the maximum POH of the plate opening 149 is between 50-60 mm, such as 53 mm.

According to some examples, the thickness BPLT of the bottom plate-opening recessed ledge 147B is between 0.8 mm and 1.7 mm (e.g., between 0.9 mm and 1.6 mm in some examples and between 0.95 mm and 1.5 mm in other examples). As shown, the thickness BPLT is greater away from the inner periphery of the bottom plate-opening recessed ledge 147B (e.g., at a base of the ledge) than at the inner periphery of the bottom plate-opening recessed ledge 147B (e.g., at a tip of the ledge). Accordingly, the thickness BPLT varies along the width BPLW of the bottom plate-opening recessed ledge 147B in some examples. For example, as shown, the thickness BPLT decreases in a sole-to-crown direction (e.g., toward a center of the plate opening 149 or from the base of the ledge to the tip of the ledge). In some examples, the thickness BPLT of the bottom plate-opening recessed ledge 147B varies such that a maximum value of the bottom ledge thickness BPLT is between 30% and 60% greater than a minimum value of the bottom ledge thickness BPLT. In certain examples, a ratio of the thickness BPLT to a thickness of the strike plate is between 0.2 and 1.2. According to certain examples, a ratio of the width BPLW to the thickness BPLT is between 2.6 and 10.

As shown in FIGS. 9 and 10, the strike plate 143 is attached, in seated engagement, to the plate-opening recessed ledge 147. When attached to the plate-opening recessed ledge 147 in this manner, the strike plate 143 covers or encloses the plate opening 149. Moreover, the top plate-opening recessed ledge 147A and the strike plate 143 are sized, shaped, and positioned relative to the crown portion 119 of the golf club head 100 such that the strike plate 143 abuts the crown portion 119 when seatably engaged with the top plate-opening recessed ledge 147A. The strike plate 143, abutting the crown portion 119, defines a topline of the golf club head 100. Moreover, in some examples, the visible appearance of the strike plate 143 contrasts enough with that of the crown portion 119 of the golf club head 100 that the topline of the golf club head 100 is visibly enhanced.

Notably, the TPLW, TPLT, BPLW, and BPLT dimensions help to control the local stiffness of the golf club head 100 and to ensure sufficient bonding area to bond the strike plate 143 to the plate-opening recessed ledge 147. The modulus of the strike plate 143, if formed from a fiber-reinforced polymeric material, will be much different than the modulus of the plate-opening recessed ledge 147, if formed from a metal material, such that the stiffness or compliance of the two are different, and during impact the strike plate 143 and the plate-opening recessed ledge 147 will move at different rates due to the different moduli unless precautions are taken in the design to account for the stiffness differences. The recess 190, TPLW, TPLT, BPLW, and BPLT dimensions all play a role in controlling the overall compliance and rate with which the strike plate 143 and the plate-opening recessed ledge 147 move during impact. Additionally, TPLW and BPLW contribute to ensuring sufficient bond area and face performance. Too little bond area and the glue joint will fail, too much bond area and the face will not perform (i.e. the coefficient of restitution will not be optimized), and in some examples too much bond area will result in the face peeling away from the club head due to the differences in stiffness. Thus, TPLW, TPLT, BPLW, and BPLT dimensions contribute to the overall performance of the club head and to the avoidance of bond or glue joint failure. In some examples, the bond area will range from 850 $mm^2$ to 1800 $mm^2$, preferably between 1,300 $mm^2$ to 1,500 $mm^2$. In some examples, a ratio of the bond area to the inner surface area of the strike plate 143 (rear surface area of the strike plate) will range from 21% to 45%. In some examples, a total bond area of the strike plate 143 will be less than a total bond area of the crown insert 108, as will be described in more detail. In some examples, a ledge width TPLW and/or BPLW will be less than a ledge width of a forward crown-opening recessed ledge 168A (front-back as measured along the y-axis of the club head origin coordinate system 185).

Figure 30A:
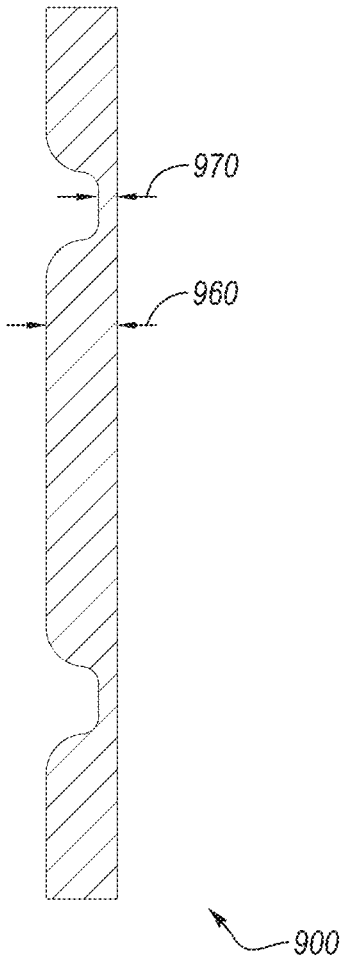
FIG. 30A is a schematic, sectional view of a polymer layer of a strike plate of a golf club head, according to one or more examples of the present disclosure.
Figure 30B:
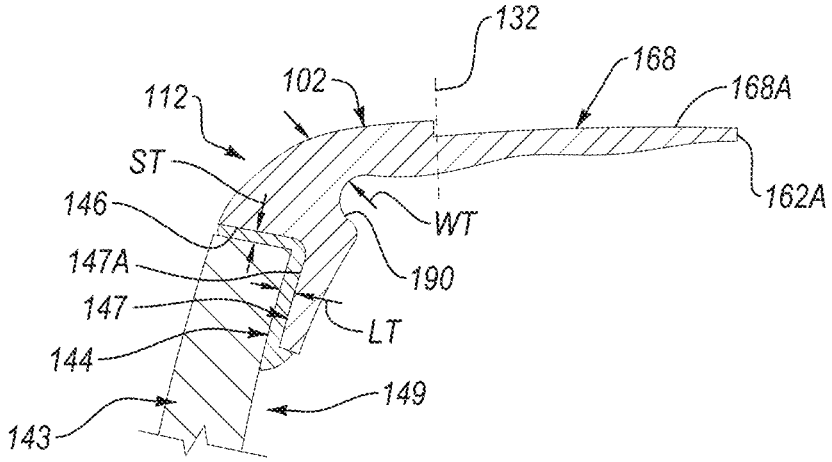
FIG. 30B is a schematic, sectional view of a strike plate attached to a plate-opening recessed ledge of a golf club head, according to one or more examples of the present disclosure.

Referring to FIG. 30B, a layer of adhesive 144 adhesively bonds the strike plate 143 to the plate-opening recessed ledge 147. The forward portion 112 includes a sidewall 146 that defines a depth of the plate-opening recessed ledge 147 and defines a radially outer periphery of the plate-opening recessed ledge 147 away from a center of the plate opening 149. The sidewall 146 is angled (e.g., acute, obtuse, or perpendicular) relative to the plate-opening recessed ledge 147. In some examples, the angle defined between the sidewall 146 and the plate-opening recessed ledge 147 is between 70° and 120°. In certain examples, the angle defined between the sidewall 146 and the plate-opening recessed ledge 147 is greater than 90°. The forward portion 112 further includes a transition portion between the plate-opening recessed ledge 147 and the sidewall 146. The transition portion defines a radiused surface, in some examples, which couples together the surfaces of the plate-opening recessed ledge 147 and the sidewall 146. The layer of adhesive 144 is interposed between the plate-opening recessed ledge 147 and the strike plate 143 and interposed between the sidewall 146 and the strike plate 143. A thickness (LT) of the layer of adhesive 144 between the plate-opening recessed ledge 147 and the strike plate 143 is greater than a thickness (ST) of the layer of adhesive 144 between the sidewall 146 and the strike plate 143, in some examples. According to one particular example, the thickness LT of the layer of adhesive 144 between the plate-opening recessed ledge 147 and the strike plate 143 is between 0.25 mm and 0.45 mm, and the thickness ST of the layer of adhesive 144 between the sidewall 146 and the strike plate 143 is between 0.15 mm and 0.25 mm.

In some examples, the strike plate 143 may have a maximum face plate height FPH of no more than 55 mm as measured along the z-axis through the club head origin, preferably no more than 55 mm and no less than 40 mm, even more preferably between 49 mm and 54 mm. In some instance, the strike plate 143, when formed of a fiber-reinforced polymeric material, may have a front surface area of no more than 4,180 $mm^2$, and preferably between 3,200 $mm^2$ and 4,180 $mm^2$, more preferably between 3,500 $mm^2$ and 4,180 $mm^2$. According to certain examples, the strike face 145 has a first bulge radius of at least 300 mm and a first roll radius of at least 250 mm. Generally, a bulge radius greater than 300 mm has a better CT creep rate and club heads with a bulge no less 300 mm bulge radius and a roll radius within 30-50 mm of the bulge radius performed well.

Figure 11:
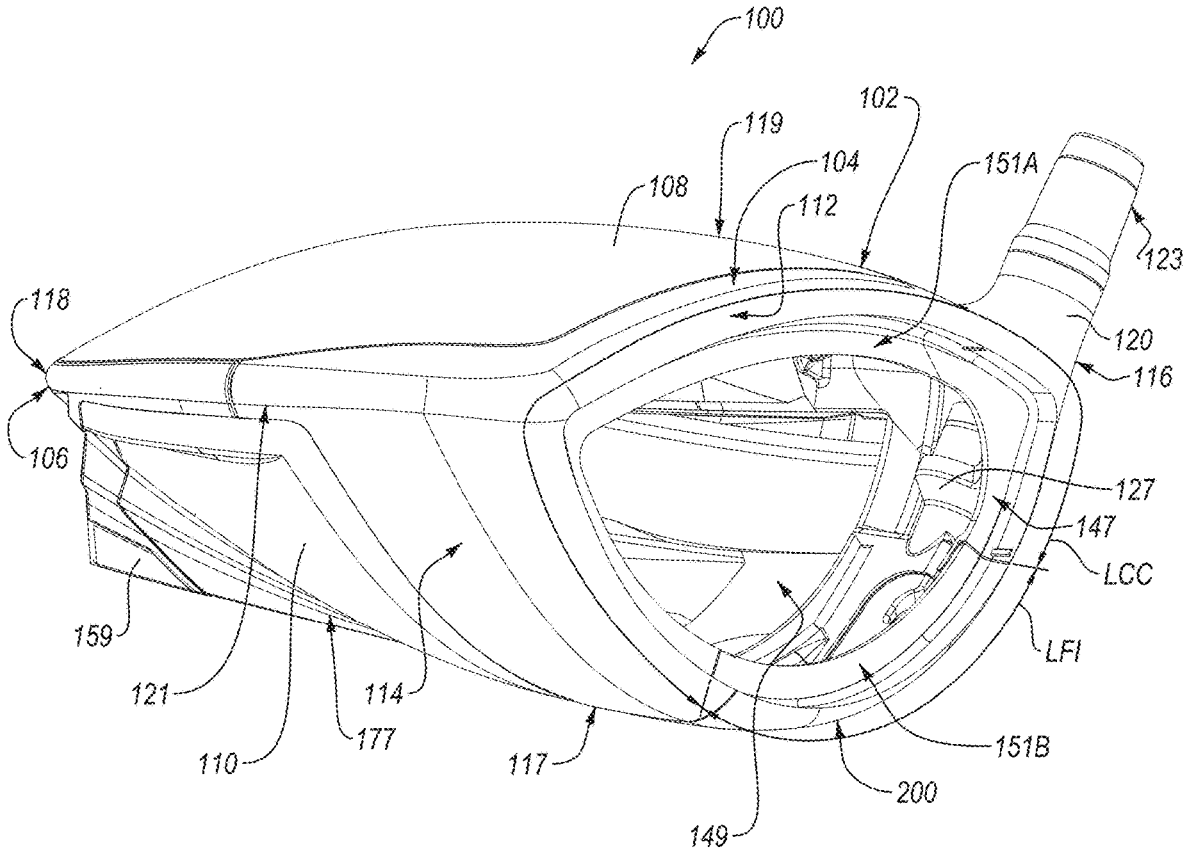
FIG. 11 is a schematic, perspective view of the golf club head of FIG. 1, shown with a strike plate removed, according to one or more examples of the present disclosure.

Referring again to FIGS. 1-8, the forward portion 112 of the golf club head 100 further includes a continuous collar 104 (e.g., cast cup) and a forward insert 200 attached to the continuous collar 104. The forward insert 200 can be attached to the continuous collar 104 using any of various attachment techniques, such as adhesive bonding, brazing, welding, and the like. As shown in FIGS. 9 and 11, the continuous collar 104 includes a first portion 151A of the plate-opening recessed ledge 147 and the forward insert 200 includes a second portion 151B of the plate-opening recessed ledge 147. In some examples, the first portion 151A and the second portion 151B of the plate-opening recessed ledge 147 make up an entirety of the plate-opening recessed ledge 147. The first portion 151A of the plate-opening recessed ledge 147 is larger (e.g., circumferentially longer) than the second portion 151B of the plate-opening recessed ledge 147. In some examples, the first portion 151A of the plate-opening recessed ledge 147, formed in the continuous collar 104, includes an entirety of the top plate-opening recessed ledge 147A and a portion of the bottom plate-opening recessed ledge 147B. According to the same examples, the second portion 151B of the plate-opening recessed ledge 147, formed in the forward insert 200, includes only a portion of the bottom-plate opening recessed ledge 147B.

Figure 5:
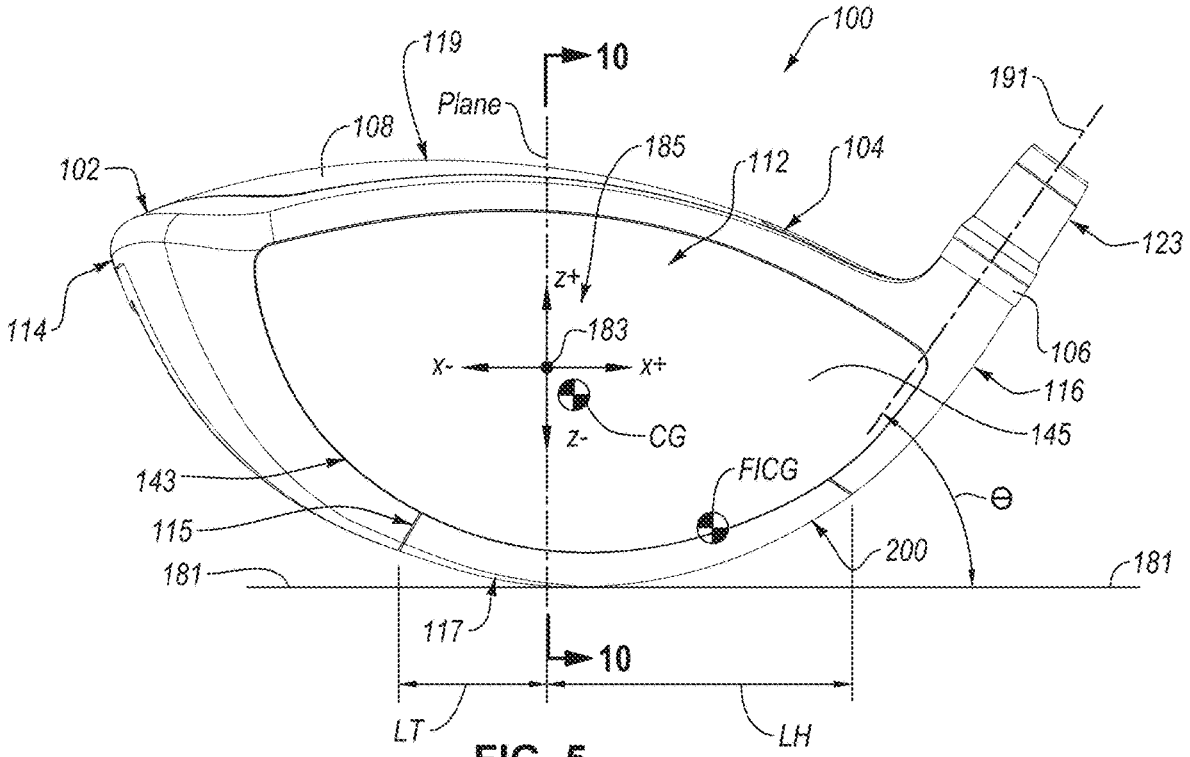
FIG. 5 is a schematic, front view of the golf club head of FIG. 1, according to one or more examples of the present disclosure.

Moreover, in certain examples, the portion of the bottom-plate opening recessed ledge 147B defined by the forward insert 200 is off-center relative to the center face 183 of the strike face 145 (see, e.g., FIG. 5). More specifically, in certain examples, the portion of the bottom-plate opening recessed ledge 147B defined by the forward insert 200 is more heelward than toeward. As shown in FIG. 5, the forward insert 200 is located along the sole portion 117 and the front portion 112 such that a toeward projected length $L_T$, defined as the portion of a total projected length of the forward insert 200, as projected onto the ground plane 181, toeward of a y-z plane, is less than a heelward projected length $L_H$, defined as the portion of the total projected length of the forward insert 200, as projected onto the ground plane 181, heelward of the y-z plane. The y-z plane is a plane that contains both the y-axis and the z-axis of the club head origin coordinate system 185. In some examples, the toeward projected length $L_T$ is no more than 40% of the total projected length and the heelward projected length $L_H$ is no less than 60% of the total projected length. According to one specific example, the toeward projected length $L_T$ is no more than 30% of the total projected length and the heelward projected length $L_H$ is no less than 70% of the total projected length. In yet another specific example, the toeward projected length $L_T$ is no more than 20% of the total projected length and the heelward projected length $L_H$ is no less than 80% of the total projected length.

Referring to FIG. 11, the plate-opening recessed ledge 147 has a total circumferential length that is equal to the circumferential length $L_{CC}$ of the first portion 151A of the plate-opening recessed ledge 147, defined by the continuous collar 104, plus the circumferential length $L_{FI}$ of the second portion 151B of the plate-opening recessed ledge 147, defined by the forward insert 200. With regard to the plate-opening recessed ledge 147, a circumferential length means the length of the outer circumference of the ledge or portion of the ledge. In some examples, the circumferential length $L_{FI}$ of the second portion 151B is no less than 15% of the total circumferential length of the plate-opening recessed ledge 147. According to one example, the circumferential length $L_{FI}$ of the second portion 151B is no less than 25% of the total circumferential length of the plate-opening recessed ledge 147. In yet another example, the circumferential length $L_{FI}$ of the second portion 151B is no less than 35% of the total circumferential length of the plate-opening recessed ledge 147.

The continuous collar 104 is made of a first material having a first density. The forward insert 200 is made of a second material having a second density. The second density is greater than the first density. Accordingly, the top plate-opening recessed ledge 147A (e.g., the top half of the plate-opening recessed ledge 147) and a portion of the bottom plate-opening recessed ledge 147B (e.g., the bottom half of the plate-opening recessed ledge 147) is made of the first material and a portion of the bottom plate-opening recessed ledge 147B is made of the second material. In other words, the plate-opening recessed ledge 147 is defined by at least two different materials having different densities.

In some examples, the thickness BPLT of the bottom plate-opening recessed ledge 147B, defined by the continuous collar 104, is more than the thickness BPLT of the bottom plate-opening recessed ledge 147B, defined by the forward insert 200. Because the forward insert 200 is made from a material (e.g., steel or tungsten alloy) having a greater density than the material (e.g., titanium alloy or aluminum alloy) of the continuous collar 104, the thickness of the ledge defined by the forward insert 200 can be less the thickness of the ledge defined by the continuous collar 104. In one example, the thickness BPLT of the bottom plate-opening recessed ledge 147B (or the thickness TPLT of the top plate-opening recessed ledge 147A), defined by the continuous collar 104, is at least 10% greater, 15% greater, or 20% greater than the thickness BPLT of the bottom plate-opening recessed ledge 147B, defined by the forward insert 200. In certain specific examples, a maximum thickness and a minimum thickness of the plate-opening recessed ledge 147 defined by the continuous collar 104 is 1.8 mm and 0.95 mm, respectively, and a maximum thickness and a minimum thickness of the plate-opening recessed ledge 147 defined by the forward insert 200 is 1.53 mm and 0.81 mm, respectively.

Referring to FIG. 9, the continuous collar 104 has an annular shape, ring-like shape, or is otherwise circumferentially closed. Moreover, as defined herein, an annular shape or ring-like shape is not necessarily a circular shape, but can be a non-circular shape, such as the illustrated shape of the continuous collar 104. The continuous collar 104 is considered a continuous or annular shape because in a circumferential direction, about the y-axis of the club head origin coordinate system 185, the continuous collar 104 has no free ends or breaks.

Referring to FIGS. 9 and 14-16, the continuous collar 104 includes a forward notch 224 at a forward edge 227 of the continuous collar 104. The forward notch 224 faces in a forward direction. More specifically, the forward notch 224 initiates at the forward edge 227 of the continuous collar 104, which can be a forwardmost edge of the continuous collar 104, and extends rearwardly from the forward edge 227 of the continuous collar 104. The forward notch 224, extending rearwardly, terminates before a rearward edge 229 of the continuous collar 104, such that the forward notch 224 does not extend entirely through a width of the continuous collar 104. In this manner, the continuous collar 104 includes a bridge portion 225, at the sole 117 portion of the golf club head 100, that spans between a toe side and a heel side of the continuous collar 104, along the forward notch 224, and along the sole portion 117 of the golf club head 100. The forward notch 224 is sized such that a gap is defined between opposing toe and heel sides of the plate-opening recessed ledge 147 defined by the continuous collar 104.

The bridge portion 225 of the continuous collar 104 includes an exterior surface 230 and an interior surface 231 that is opposite the exterior surface 230. A thickness of the bridge portion 225 of the continuous collar 104 is defined between the exterior surface 230 and the interior surface 231. The exterior surface 230 faces substantially away from the interior cavity 113 of the golf club head 100. In contrast, the interior surface 231 faces substantially toward the interior cavity 113 of the golf club head 100. To promote rigidity and vibration dampening of the bridge portion 225, in some examples, the continuous collar 104 further includes an internal rib 210 that protrudes from the interior surface 231, inwardly toward the interior cavity 113. The internal rib 210 is substantially parallel to the strike face 145 (e.g., parallel to the x-axis of club head origin coordinate system 185) and rearwardly offset from the strike plate 143 and at least the second portion 151B of the plate-opening recessed ledge 147 defined by the forward insert 200.

The bridge portion 225 further includes insert-retention features that help retain the forward insert 200 when the forward insert 200 is attached to the continuous collar 104. In some examples, the bridge portion 225 includes an insert-retention receptacle 222 and an insert-retention ridge 240. In some examples, the insert-retention receptacle 222 and the insert-retention ridge 240 are located on opposite sides of the bridge portion 225. For example, the insert-retention receptacle 222 can be located on a toeward side of the bridge portion 225 and the insert-retention ridge 240 can be located on a heelward side of the bridge portion 225.

Figure 13:
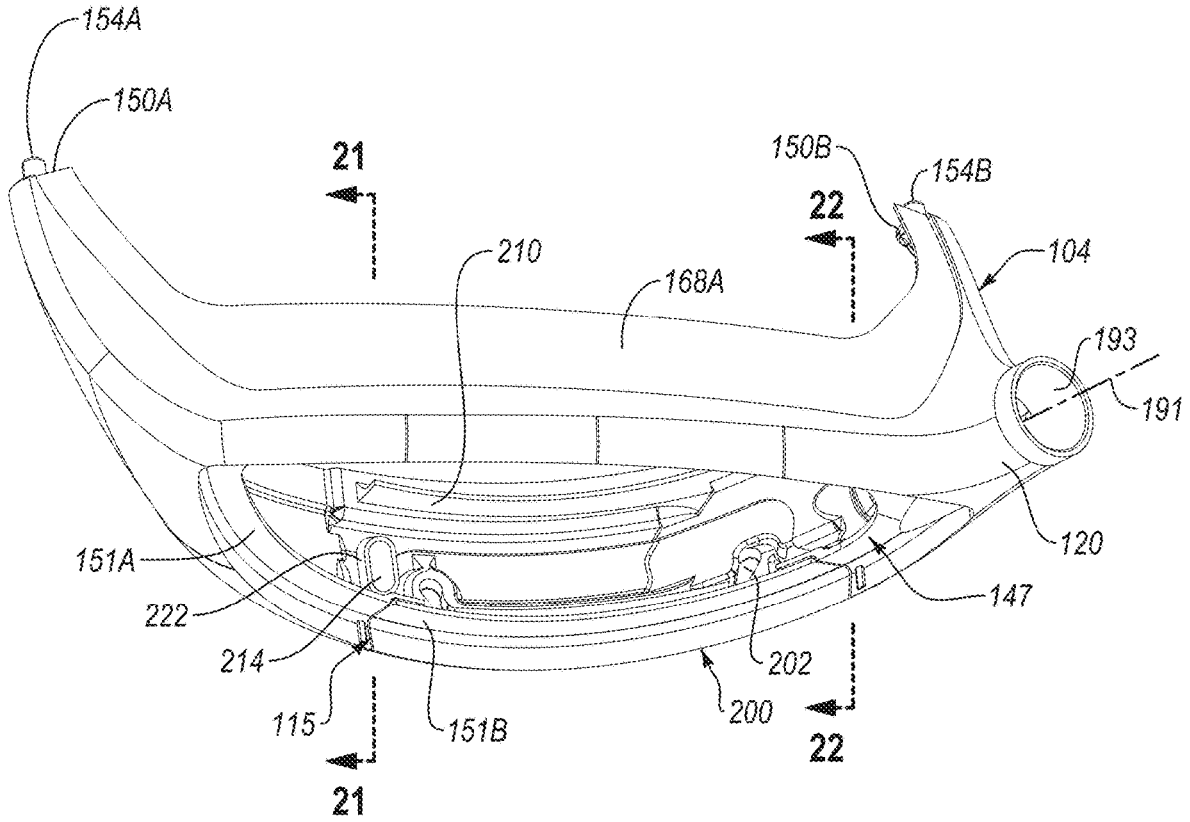
FIG. 13 is a schematic, perspective view of a continuous collar and forward insert of the golf club head of FIG. 1, according to one or more examples of the present disclosure.

The insert-retention receptacle 222 is a through-hole that extends through the thickness of the bridge portion 225. Accordingly, the insert-retention receptacle 222 extends from the exterior surface 230 of the bridge portion 225 to at least the interior surface 231 of the bridge portion 225. Moreover, as shown in FIG. 13, the insert-retention receptacle 222 is defined by a circumferentially closed or annular rib that extends inwardly away from the interior surface 231 towards the interior cavity 113. In this manner, the insert-retention receptacle 222 has a length greater than a thickness of the bridge portion 225, which helps to prevent twisting and rotation of the forward insert 200 relative to the continuous collar 104.

Figure 12A:
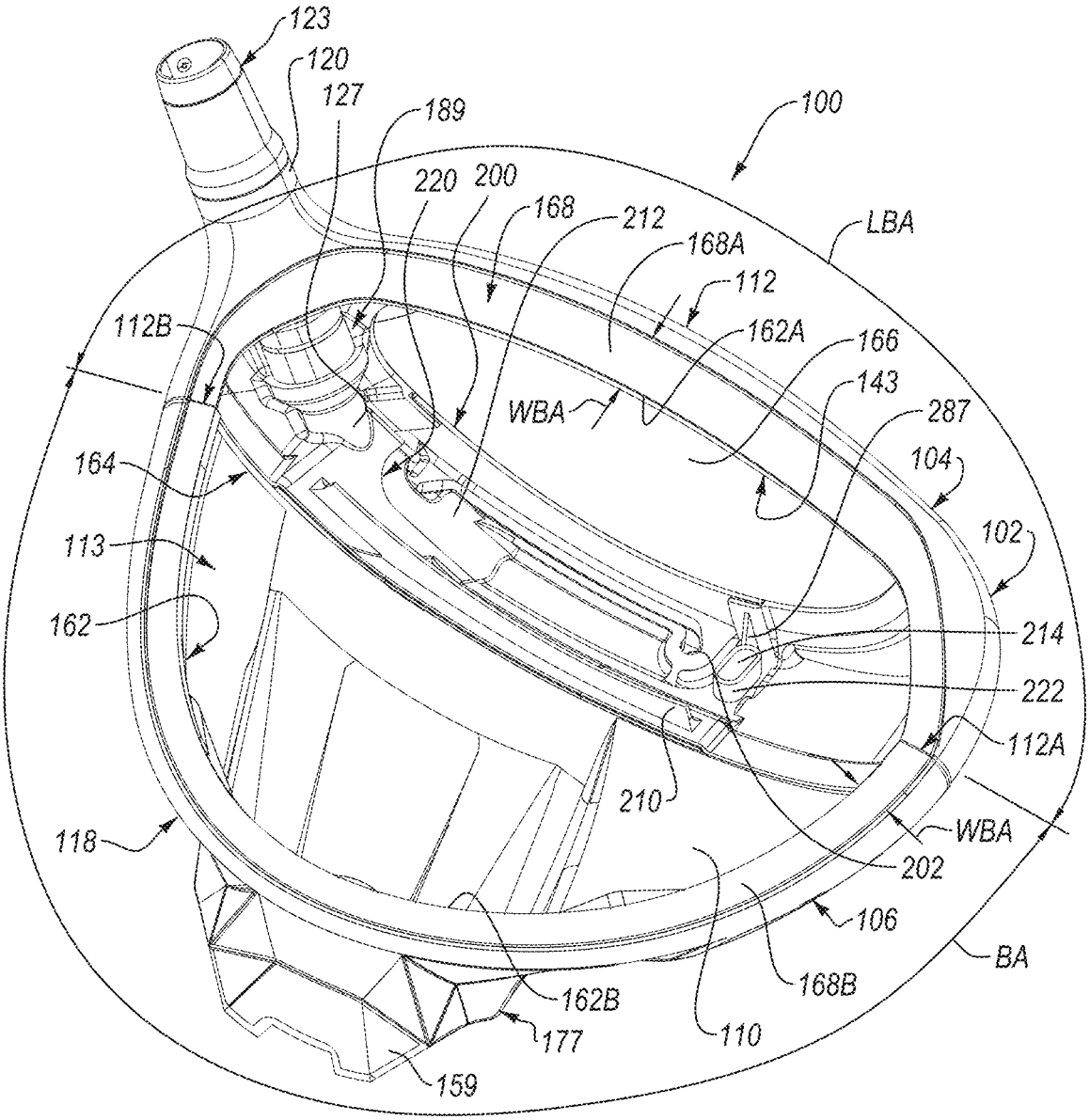
FIG. 12A is a schematic, perspective view of the golf club head of FIG. 1, shown with a crown insert removed, according to one or more examples of the present disclosure.

Referring to FIG. 12A, in some examples, the continuous collar 104 further includes a receptacle rib 287 co-formed with other portions of the continuous collar 104. The receptacle rib 287 extends in a forward-rearward direction between the insert-retention receptacle 222 and a front wall of the continuous collar 104. The receptacle ribs 287 helps to stiffen and strengthen the insert-retention receptacle 222 and further promote desirable acoustic properties of the golf club head 100.

Figure 16:
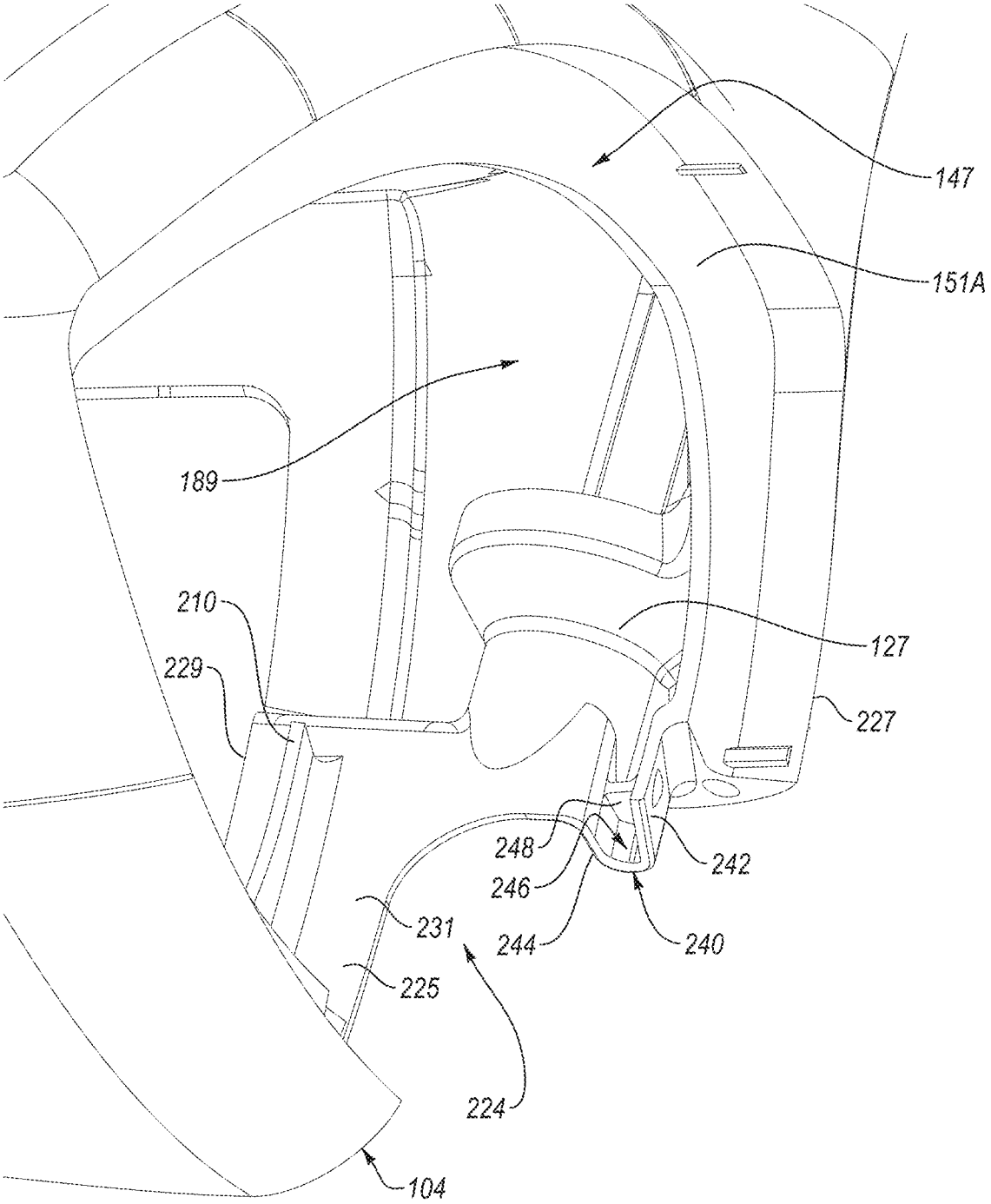
FIG. 16 is a schematic, perspective view of a portion of a continuous collar of the golf club head of FIG. 1, according to one or more examples of the present disclosure.
Figure 17:
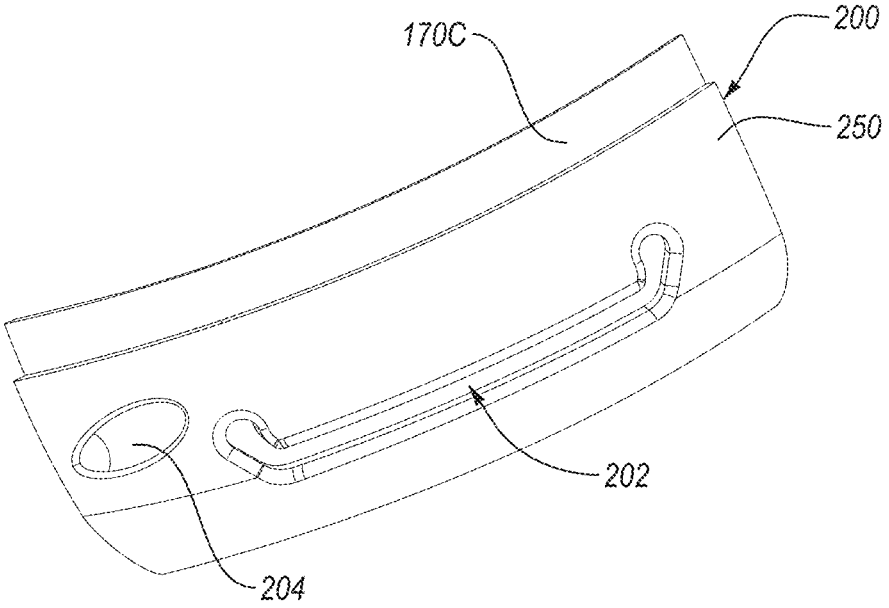
FIG. 17 is a schematic, perspective view of a forward insert of the golf club head of FIG. 1, according to one or more examples of the present disclosure.

The insert-retention ridge 240 is a protrusion formed in the exterior surface 230 of the bridge portion 225 that protrudes in a crown-to-sole direction. In other words, the insert-retention ridge 240 protrudes outwardly away from the interior cavity 113. The insert-retention ridge 240 has a forward-facing surface 242 and a rearward-facing surface 244. The forward-facing surface 242 and the rearward-facing surface 244 face away from each other in substantially opposite directions. The insert-retention ridge 240 is defined by an internal valley 246 formed in the interior surface 231 of the bridge portion 225. The internal valley 246 is opposite and complementary to the insert-retention ridge 240. Both the insert-retention ridge 240 and the internal valley 246 extend in a substantially toe-heel direction, such as substantially parallel to the strike face 145 or the x-axis of the club head origin coordinate system 185. In some examples, as shown in FIGS. 10A and 16, the bridge portion 225 of the continuous collar 104 further includes a valley rib 248 that extends across the internal valley 246 in a direction substantially perpendicular to the strike face 145 or the x-axis of the club head origin coordinate system 185. The valley rib 248 promotes rigidity of the insert-retention ridge 240 in a front-rear direction.

The continuous collar 104 also includes the hosel 120, which defines the hosel axis 191 extending coaxially through a bore 193 of the hosel 120 (see, e.g., FIG. 13). The hosel 120 is configured to be attached to a shaft of a golf club. In some examples, the hosel 120 facilitates the inclusion of a flight control technology (FCT) system 123 between the hosel 120 and the shaft to control the positioning of the golf club head 100 relative to the shaft (see, e.g., FIGS. 1-9). The FCT system 123 may include a fastener 125 that is accessible through a lower opening 204 formed in the forward insert 200. The FCT system 123 includes multiple movable parts that fit within the and extend from the hosel 120. The fastener 125 facilitates adjustability of the FCT system 123 system by loosening the fastener 125 and maintaining an adjustable position of the golf club head relative to the shaft by tightening the fastener 125. The lower opening 195 is open to the bore 193 of the hosel 120.

Figure 14:
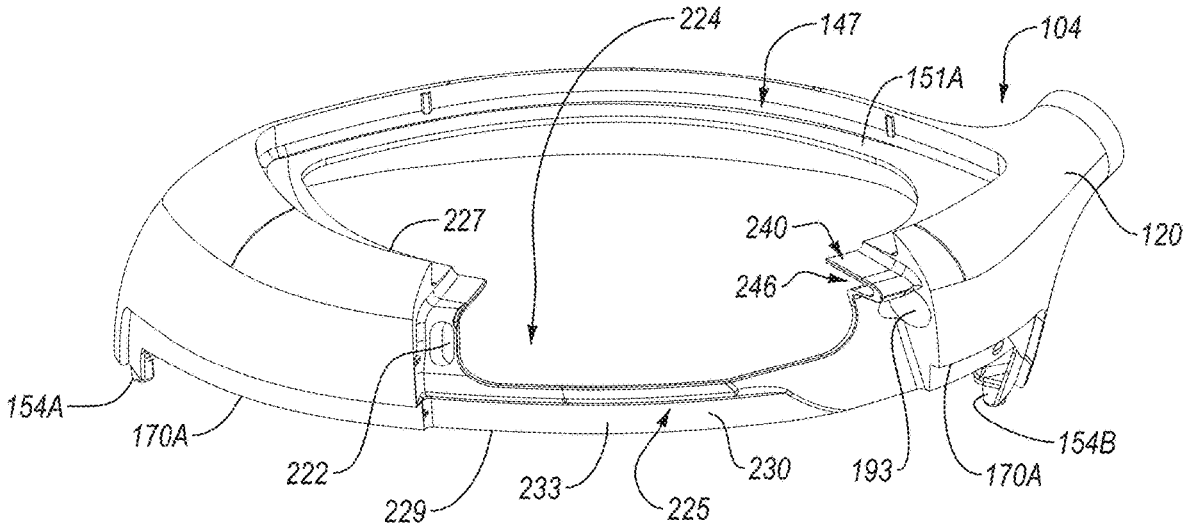
FIG. 14 is a schematic, perspective view of a continuous collar of the golf club head of FIG. 1, according to one or more examples of the present disclosure.

As shown in FIGS. 10A-12, the hosel 120 further includes an internal portion 127 (i.e., a portion of the hosel 120 that is within the interior cavity 113). The internal portion 127 of the hosel 120 further defines the bore 193 and surrounds FCT components extending through the bore 193 of the hosel 120. As shown in FIG. 14, the bore 193 of the hosel 120 is open to the notch 224 of the continuous collar 104. To promote an increase in discretionary mass, in some examples, a lateral opening 189 is formed in the internal portion 127. The lateral opening 189 is open to the interior cavity 113. Because of the lateral opening 189, the internal portion 127 of the hosel 120 only partially surrounds FCT components extending through the bore 193 of the hosel 120. In some examples a height of the lateral opening 189, in a direction parallel to the hosel axis 191, is between 10 mm and 15 mm, a width of the lateral opening 189, in a direction perpendicular to the hosel axis 191, is at least 1 radian, and/or a projected area of the lateral opening 189 is at least 75 $mm^2$.

The interior surface 231 of the bridge portion 225 defines an interior surface of the golf club head 100. More specifically, the interior surface 231 of the bridge portion 225 directly defines or faces the interior cavity 113. The exterior surface 230 of the bridge portion 225 defines an interface surface that interfaces with a corresponding interface surface of the forward insert. The interface surfaces of the bridge portion 225 of the continuous collar 104 and the forward insert 200 define a joint (e.g., a bonded joint) where the continuous collar 104 is joined to the forward insert 200.

Figure 15:
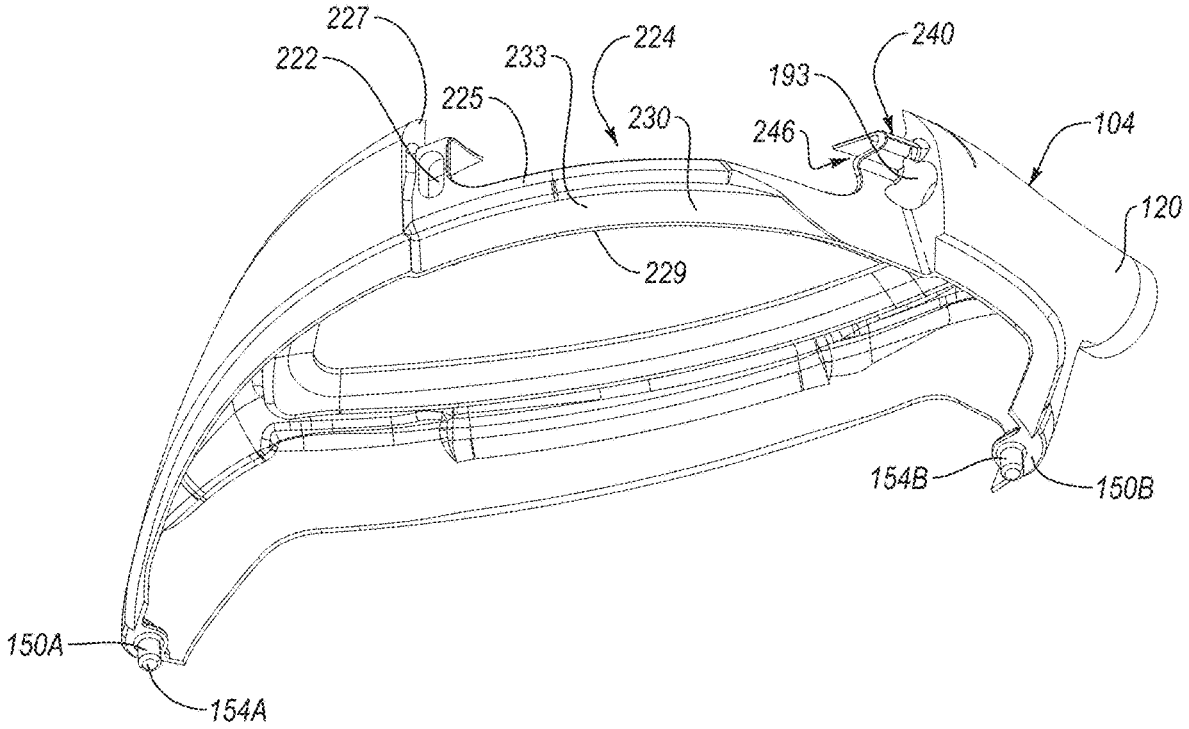
FIG. 15 is a schematic, perspective view of a continuous collar of the golf club head of FIG. 1, according to one or more examples of the present disclosure.

Referring to FIG. 12, the continuous collar 104 further includes a forward crown-opening recessed ledge 168A of a crown-opening recessed ledge 168 of the golf club head 100. Additionally, as shown in FIGS. 14 and 15, the continuous collar 104 further includes a first forward sole-opening recessed ledge 170A of a sole-opening recessed ledge 170 of the golf club head 100. The first forward sole-opening recessed ledge 170A of the continuous collar 104 is divided into two sections, spaced apart by the notch 224. In other words, there is a gap between the two sections of the first forward sole-opening recessed ledge 170A. As described below, the gap is filled by a second forward sole-opening recessed ledge 170C of the forward insert 200. In this manner, the first forward sole-opening recessed ledge 170A and the second forward sole-opening recessed ledge 170C collectively define a forward sole-opening recessed ledge of the sole-opening recessed ledge 170. The forward crown-opening recessed ledge 168A is configured to receive a forward portion of a crown insert 108 of the golf club head 100. Similarly, the first forward sole-opening recessed ledge 170A and the second forward sole-opening recessed ledge 170C are configured to receive a forward portion of a sole insert 110 of the golf club head 100.

As shown in FIGS. 14 and 15, the exterior surface 230 of the bridge portion 225 of the continuous collar 104 includes an insert-engagement recessed ledge 233. The insert-engagement recessed ledge 233 is recessed relative to the first forward sole-opening recessed ledge 170A and recessed relative to forward portions of the exterior surface 230. The insert-engagement recessed ledge 233 is configured to receive, in nested engagement, for example, the second forward sole-opening recessed ledge 170C of the forward insert 200.

Referring to FIGS. 17-20, the forward insert 200 includes an exterior surface 250 and an interior surface 251 that is opposite the exterior surface 250. A thickness t of the forward insert 200 is defined between the exterior surface 250 and the interior surface 251. The exterior surface 250 faces substantially away from the interior cavity 113 of the golf club head 100. In contrast, the interior surface 251 faces substantially toward the interior cavity 113 of the golf club head 100.

The forward insert 200 further includes insert-retention features that help retain the forward insert 200 when the forward insert 200 is attached to the continuous collar 104. In some examples, the forward insert 200 includes an insert-retention projection 214 and an insert-retention groove 252. In some examples, the insert-retention projection 214 and the insert-retention groove 252 are located on opposite sides of the forward insert 200. For example, the insert-retention projection 214 can be located on a toeward side of the forward insert 200 and the insert-retention groove 252 can be located on a heelward side of the forward insert 200.

Figure 21:
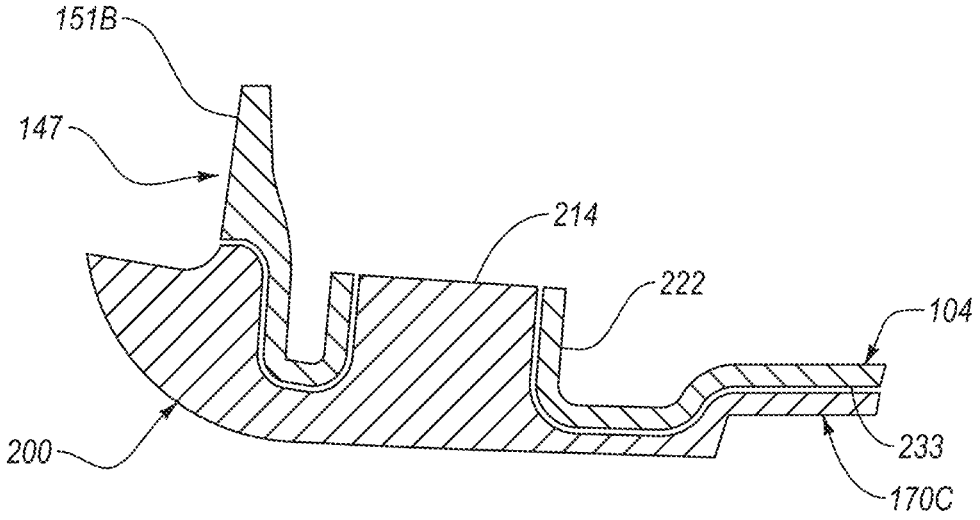
FIG. 21 is a schematic, cross-sectional, side elevation view of the continuous collar and forward insert of FIG. 13, taken along the line 21-21 of FIG. 13, according to one or more examples of the present disclosure.

The insert-retention projection 214 protrudes from the interior surface 251 inwardly toward the interior cavity 213. Moreover, the insert-retention projection 214 has a size and shape that complements the size and shape of the insert-retention receptacle 222 of the continuous collar 104. As shown in FIGS. 13 and 21, the insert-retention projection 214 is received, in nested engagement for example, within the insert-retention receptacle 222. Because the size and shape of the insert-retention projection 214 and the insert-retention receptacle 222 complement each other, the insert-retention projection 214 forms a nested fit (e.g., slip fit or interference fit) with the insert-retention receptacle 222, which helps to prevent movement of the forward insert 200 relative to the continuous collar 104. In some examples, the insert-retention projection 214 and the insert-retention receptacle 222 have a non-circular cross-sectional shape, such as oval, rectangular, square, or the like, which helps to prevent relative rotation of the insert-retention projection 214 and the insert-retention receptacle 222, and thus relative rotation of the continuous collar 104 and the forward insert 200.

The insert-retention groove 252 is formed in the interior surface 251 of the forward insert 200 and has a depth that extends in a crown-to-sole direction. In other words, a depth of the insert-retention groove 252 extends outwardly away from the interior cavity 113. The insert-retention groove 252 has a forward-facing surface 254 and a rearward-facing surface 255. The forward-facing surface 254 and the rearward-facing surface 255 face each other. The insert-retention groove 252 extends in a substantially toe-heel direction, such as substantially parallel to the strike face 145 or the x-axis of the club head origin coordinate system 185. The cross-sectional size and shape of the insert-retention groove 252 of the forward insert 200 complements the cross-sectional size and shape of the insert-retention ridge 240 of the continuous collar 104.

Figure 22:
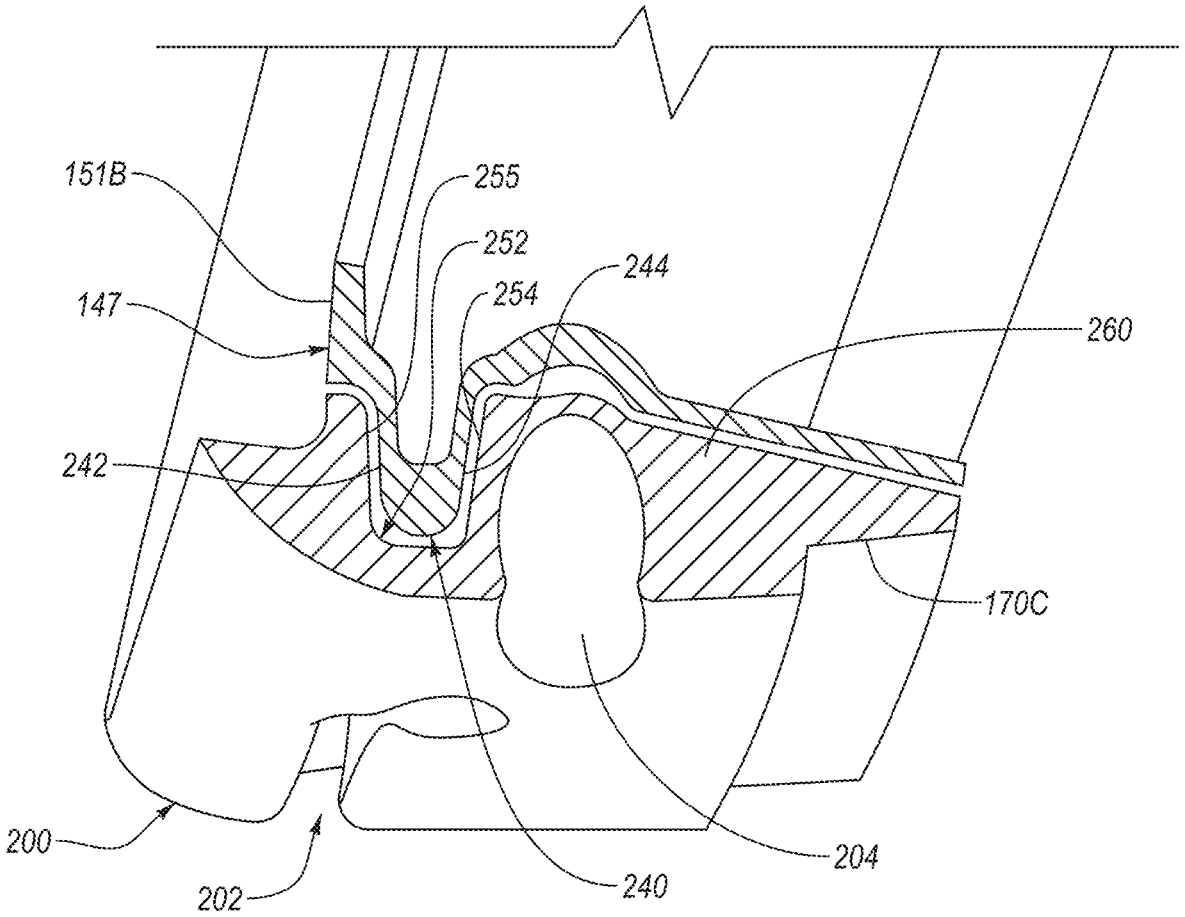
FIG. 22 is a schematic, cross-sectional, side elevation view of the continuous collar and forward insert of FIG. 13, taken along the line 22-22 of FIG. 13, according to one or more examples of the present disclosure.

As shown in FIGS. 10A and 22, the insert-retention ridge 240 of the continuous collar 104 is received, in nested engagement, for example, within the insert-retention groove 252. Because the size and shape of the insert-retention ridge 240 and the insert-retention groove 252 complement each other, the insert-retention ridge 240 forms a nested fit (e.g., slip fit or interference fit) with the insert-retention groove 252, which helps to prevent movement (e.g., forward-rearward movement) of the forward insert 200 relative to the continuous collar 104.

Figure 18:
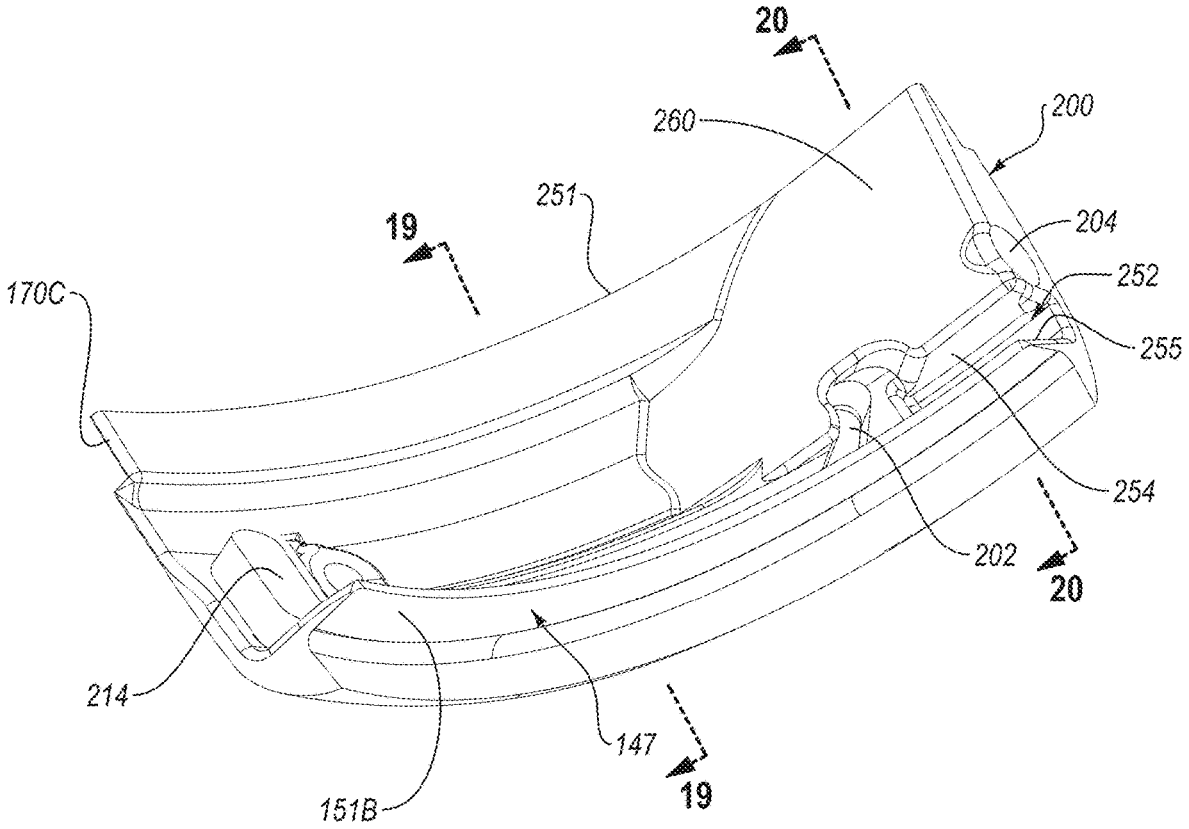
FIG. 18 is a schematic, perspective view of a forward insert of the golf club head of FIG. 1, according to one or more examples of the present disclosure.
Figure 19:
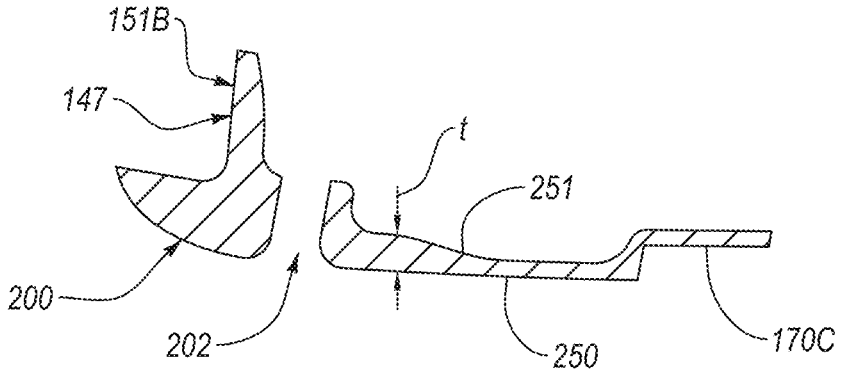
FIG. 19 is a schematic, cross-sectional, side elevation view of the forward insert of FIG. 18, taken along the line 19-19 of FIG. 18, according to one or more examples of the present disclosure.
Figure 20:
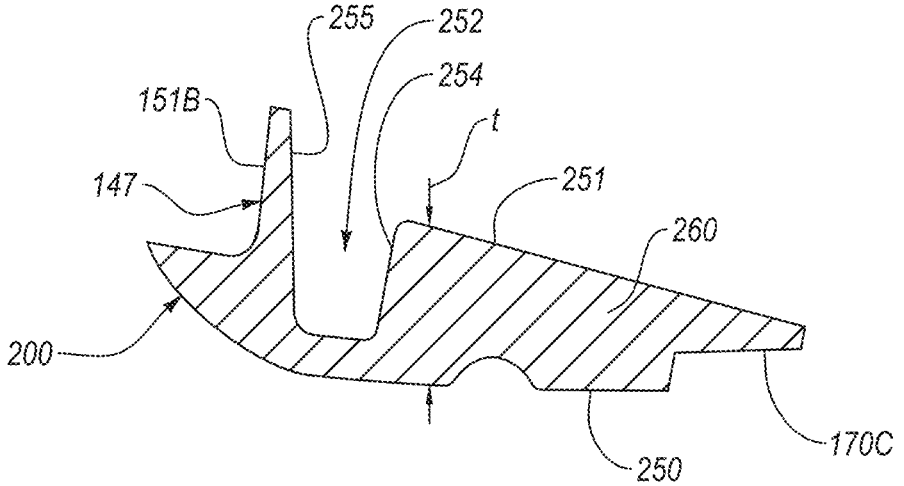
FIG. 20 is a schematic, cross-sectional, side elevation view of the forward insert of FIG. 18, taken along the line 20-20 of FIG. 18, according to one or more examples of the present disclosure.

Referring to FIG. 18, in some examples, the forward insert 200 includes a mass pad 260. The mass pad 260 is defined as a portion of the forward insert 200 having an increased thickness relative to adjacent portions of the forward insert 200. For example, the thickness t of the forward insert 200 adjacent the mass pad 260 (see, e.g., FIG. 19) is less than the thickness t of the forward insert 200 at the mass pad 260 (see, e.g., FIG. 20). In some examples, the thickness t of the forward insert 200 along the mass pad 260 steadily changes. In one particular example, the thickness t of the forward insert 200 along the mass pad 260 steadily increases in a toe-to-heel direction. The increased thickness of the mass pad 260 provides a mass concentration or discrete location with increased mass at the location of the mass pad 260. Accordingly, the mass pad 260 can be located on the golf club head 100 at a location where a discrete increase in mass is desired. In one example, the mass pad 260 is located on a heelward side of the forward insert 200, such that the mass pad 260 is closer to the heel of the golf club head 100 than the toe of the golf club head 100.

As presented below, the continuous collar 104 and the forward insert 200 are made of any of various materials, have any of various volumes (i.e., water displacement volume), and have any of various masses. In some examples, a ratio of the volume of the forward insert 200 relative to a volume of the golf club head 100 is between 0.008 and 0.01. According to certain examples, a ratio of the volume of the forward insert 200 relative to a volume of the continuous collar 104 is between 0.25 and 0.5 (e.g., 0.33). In various examples, a ratio of the density of the forward insert 200 relative to the density of the continuous collar 104 is between 1.0 and 2.5 (e.g., 1.7). The volume of the forward insert 200 is around 3.8 $cm^3$, the volume of the continuous collar 51 is about 11.7 $cm^3$, and the volume of the golf club head 100 is between about 400 $cm^3$ and 470 $cm^3$, in some examples.

In certain examples, a ratio of the mass of the forward insert 200 relative to the mass of the golf club head 100 is between 0.14 and 0.16. According to certain examples, a ratio of the mass of the forward insert 200 relative to the mass of the continuous collar 104 is between 0.4 and 0.85, such as between 0.45 and 0.65 (e.g., 0.59). The mass of the forward insert 200 is between 27 grams and 33 grams, such as about 27.5 grams, about 30 grams, or about 32.5 grams, in some examples. The mass of the continuous collar 104 is between 45 grams and 60 grams, such as about 50 grams, about 55 grams, or about 57.5 grams, in some examples. The mass of the golf club head 100 is between about 190 grams and 210 grams in some examples.

In certain examples, an exterior surface area of the forward insert 200 is about 1,382 $mm^2$ and an exterior surface area of the continuous collar 104 is about 4,658 $mm^2$, such that a ratio of the surface areas is about 0.3. In some examples, a ratio of the exterior surface area of the forward insert 200 to the exterior surface area of the continuous collar 104 is between about 0.1 and 0.5, or between 0.2 and 0.5. The exterior surface areas of the forward insert 200 and the continuous collar 104 are those surface areas that are visible from an exterior of the golf club head 100 when fully assembled.

As shown in FIGS. 3, 4, 8, 10, 12, 13, 17-29 and 22, in some examples, the forward insert 200 further includes a slot 202, which is located in the sole portion 117 of the golf club head 100. The slot 202 is open to an exterior of the golf club head 100 and extends lengthwise from the heel portion 116 to the toe portion 114. More specifically, the slot 202 is elongate in a lengthwise direction substantially parallel to, but offset from, the strike face 145. In some examples, although most of the slot 202 is substantially parallel to the strike face 145, the slot 202 can include angled end portions that are angled in a forward-to-rearward direction away from the strike face 145. Generally, the slot 202 is a groove or channel formed in the forward insert 200 at the sole portion 117 of the golf club head 100. In some examples, the slot 202 is a through-slot, or a slot that is open to the interior cavity 113 from outside of the golf club head 100. However, in other implementations, the slot 202 is not a through-slot, but rather is closed on an interior cavity side or interior side of the slot 202. For example, the slot 202 can be defined by a portion of forward insert 200 that protrudes into the interior cavity 113 and has a concave exterior surface having any of various cross-sectional shapes, such as a substantially U-shape, V-shape, and the like.

In some examples, the slot 202 is offset from the strike face 145 by an offset distance, which is the minimum distance between a first vertical plane passing through a center of the strike face 145 and the slot at the same x-axis coordinate as the center of the strike face 145, between about 5 mm and about 50 mm, such as between about 5 mm and about 35 mm, such as between about 5 mm and about 30 mm, such as between about 5 mm and about 20 mm, or such as between about 5 mm and about 15 mm.

In certain examples, the slot 202 has a certain slot width, which is measured as a horizontal distance between a first slot wall and a second slot wall. For the slot 202, the slot width may be between about 5 mm and about 20 mm, such as between about 10 mm and about 18 mm, or such as between about 12 mm and about 16 mm. According to some examples, a depth of the slot 202 (i.e., the vertical distance between a bottom slot wall and an imaginary plane containing the regions of the sole portion 117 adjacent opposing slot walls of the slot 202) may be between about 6 mm and about 20 mm, such as between about 8 mm and about 18 mm, or such as between about 10 mm and about 16 mm. Additionally, the slot 202 has a certain slot length, which can be measured as the horizontal distance between a slot end wall and another slot end wall. For the slot 202, the slot length may be between about 30 mm and about 120 mm, such as between about 50 mm and about 100 mm, or such as between about 60 mm and about 90 mm. Additionally, or alternatively, the length of the slot 202 may be represented as a percentage of a total length of the strike face 145. For example, the slot 202 may be between about 30% and about 100% of the length of the strike face 145, such as between about 50% and about 90%, or such as between about 60% and about 80% mm of the length of the strike face 145.

In some examples, the slot 202 is a feature to improve and/or increase the coefficient of restitution (COR) across the strike face 145. With regards to a COR feature, the slot 202 may take on various forms such as a channel or through slot. The COR of the golf club head 100 is a measurement of the energy loss or retention between the golf club head 100 and a golf ball when the golf ball is struck by the golf club head 100. Desirably, the COR of the golf club head 100 is high to promote the efficient transfer of energy from the golf club head 100 to the ball during impact with the ball. Accordingly, the COR feature of the golf club head 100 promotes an increase in the COR of the golf club head 100. Generally, the slot 202 increases the COR of the golf club head 100 by increasing or enhancing the pelipeter flexibility of the strike face 145. In some examples of the golf club heads disclosed herein, the COR is at least 0.8 for at least 25% of the strike face within the central region, as defined below.

Further details concerning the slot 202 as a COR feature of the golf club head 100 can be found in U.S. patent application Ser. Nos. 13/338,197, 13/469,031, 13/828,675, filed Dec. 27, 2011, May 10, 2012, and Mar. 14, 2013, respectively, U.S. patent application Ser. No. 13/839,727, filed Mar. 15, 2013, U.S. Pat. No. 8,235,844, filed Jun. 1, 2010, U.S. Pat. No. 8,241,143, filed Dec. 13, 2011, U.S. Pat. No. 8,241,144, filed Dec. 14, 2011, all of which are incorporated herein by reference.

The slot 202 can be any of various flexible boundary structures (FBS) as described in U.S. Pat. No. 9,044,653, filed Mar. 14, 2013, which is incorporated by reference herein in its entirety. Additionally, or alternatively, the golf club head 100 can include one or more other FBS at any of various other locations on the golf club head 100. The slot 202 may be made up of curved sections, or several segments that may be a combination of curved and straight segments. Furthermore, the slot 202 may be machined or cast into the golf club head 100.

In some examples, the slot 202 is filled with a filler material. However, in other examples, the slot 202 is not filled with a filler material, but rather maintains an open, vacant, space within the slot 202. The filler material can be made from a non-metal, such as a thermoplastic material, thermoset material, and the like, in some implementations. The slot 202 may be filled with a material to prevent dirt and other debris from entering the slot and possibly the interior cavity 113 of the golf club head 100 when the slot 202 is a through-slot. The filler material may be any relatively low modulus materials including polyurethane, elastomeric rubber, polymer, various rubbers, foams, and fillers. The filler material should not substantially prevent deformation of the golf club head 100 when in use as this would counteract the flexibility of the golf club head 100.

According to one example, the filler material is initially a viscous material that is injected or otherwise inserted into the slot 202. Examples of materials that may be suitable for use as a filler to be placed into a slot, channel, or other flexible boundary structure include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd. In some examples, a solid filler material may be press-fit or adhesively bonded into a slot, channel, or other flexible boundary structure. In other examples, a filler material may poured, injected, or otherwise inserted into a slot or channel and allowed to cure in place, forming a sufficiently hardened or resilient outer surface. In still other examples, a filler material may be placed into a slot or channel and sealed in place with a resilient cap or other structure formed of a metal, metal alloy, metallic, composite, hard plastic, resilient elastomeric, or other suitable material.

Although not shown, in some examples, the forward insert 200 additionally includes a second slot or a port configured to receive a weight. The weight can be selectively attachable to and removable from the second slot or the port in some examples.

Figure 10B:
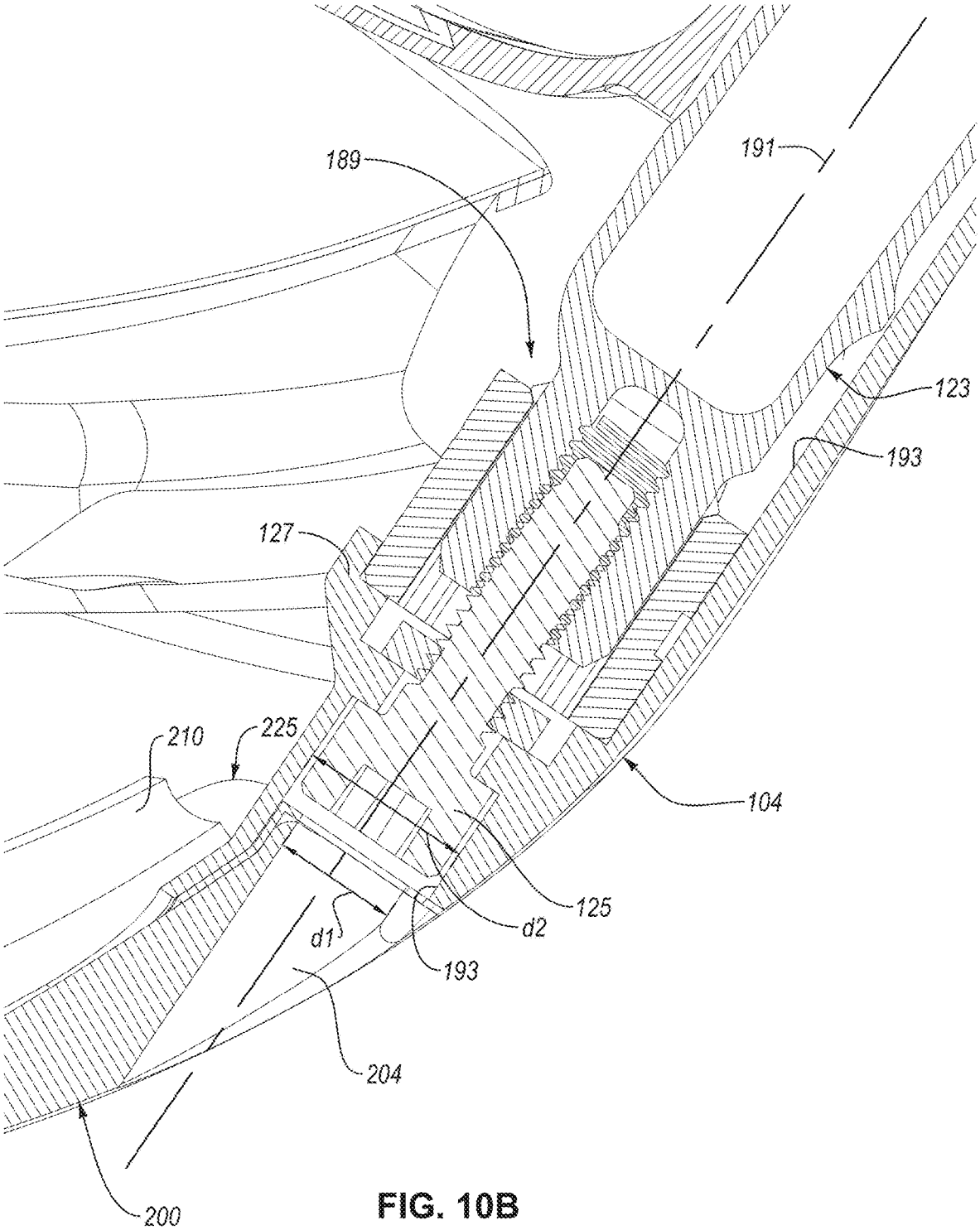
FIG. 10B is a schematic, cross-sectional, front elevation view of the golf club head of FIG. 1, according to one or more examples of the present disclosure.

Referring to FIG. 10B, the lower opening 204 is coaxial with the bore 193 of the hosel 120. Moreover, the lower opening 204 is sized to enable a tool to entirely pass through the lower opening 204, but not allow the fastener 125 to entirely pass through. For example, the lower opening 204 may have a diameter d1 that is less than a maximum diameter d2 of the fastener 125 (e.g., a diameter of a head of the fastener 125). Accordingly, in some examples, no portion of the fastener 125 is located in the lower opening 204. Instead, the fastener 125 is coupled to the continuous collar 104, or positioned within the bore 193 of the hosel 120, prior to attaching the forward insert 200 to the continuous collar 200. In this manner, when the forward insert 200 is attached to the continuous collar 104, the fastener 125 is suspended and retained between the forward insert 200 and the continuous collar 104. When adjustment of the shaft relative to the golf club head 100 is desired, the fastener 125 is accessed by passing just the tool through the lower opening 204 in the forward insert 200. As shown in FIGS. 18 and 22, at least a portion of the lower opening 204 is formed in the mass pad 260.

A forward portion of the interior surface 251 of the forward insert 200 defines an interior surface of the golf club head 100. More specifically, a forward portion of the interior surface 251 of the bridge portion 225 directly defines or faces the interior cavity 113. A rearward portion of the interior surface 251, which is overlapped by the bridge portion 225 of the continuous collar 104, does not define an interior surface of the golf club head 100 at that location. The rearward portion of the interior surface, overlapped with the continuous collar 104, defines an interface surface that interfaces with a corresponding interface surface on the exterior surface 230 of the continuous collar 104. More specifically, a stepped or raised portion of the interior surface 251 of the forward insert 200, which corresponds with the second forward sole-opening recessed ledge 170C, interfaces with (e.g., nestably engages) the insert-engagement recessed ledge 233 of the continuous collar 104 (see, e.g., FIG. 10).

The exterior surface 250 of the forward insert 200 defines an outermost surface of the golf club head 100, such as an outermost surface of a part of the forward portion 112 and a part of the sole portion 117 of the golf club head 100. In this manner, the forward insert 200 is located at and defines a forwardmost and bottommost location of the golf club head 100. Moreover, the forward insert 200 being located at a forwardmost and bottommost location of the golf club head 100 helps to locate significant mass forwardly and below the CG of the golf club head 100. In other words, referring to FIG. 10A, a center-of-gravity FICG of the forward insert 200 is located forwardly and below the CG of the golf club head 100. A first vector V1 initiating from and extending between the CG of the golf club head 100 and the FICG of the forward insert 200 has a length between 39 mm and 55 mm, in some examples. According to some examples, the FICG of the forward insert 200 has a coordinate on the y-axis of the head origin coordinate system 185 of greater than zero and no more than 35 mm. Also, the FICG is forwardly and below a center-of-gravity CCCG of the continuous collar 104. A second vector V2 initiating from and extending between the CCCG of the continuous collar 104 and the FICG of the forward insert 200 has a length between 5 mm and 30 mm, in some examples, such as at least 7.5 mm, at least 10 mm, at least 12.5 mm, at least 15 mm, and/or at least 17.5 mm.

Moreover, the forward insert 200 being more heelwardly than toewardly, helps to locate significant mass heelwardly of the CG of the golf club head 100. Referring to FIG. 5, according to some examples, the FICG of the forward insert 200 has a coordinate on the x-axis of the head origin coordinate system 185, abbreviated FICGx, that is more than the coordinate on the x-axis of the head origin coordinate system 185 of the CG, abbreviated CGx. In an example, the absolute value of FICGx is at least twice the absolute value of CGx, and is at least three times, four times, and five times in further examples. In a further example FICGx is at least 2 mm greater than CGx, and at least 3 mm, 4 mm, 5 mm, 6 mm, 7 mm, and 8 mm in additional examples. In a further series of examples FICGx is no more than 30 mm greater than CGx, and no more than 25 mm greater, 22 mm, 19 mm, 16 mm, and 13 mm in further examples. A Z-up value for the golf club head 100 is the vertical distance along a z-axis from the ground plane 181 to the CG of the golf club head 100, and likewise a FI Z-up value for the forward insert 200 is the vertical distance along a z-axis from the ground plane 181 to the FICG. In one example, FI Z-up is no more than 50% of Z-up, and no more than 35%, 30%, 25%, 20%, and 15% in further examples. Additionally, the coordinate on the y-axis of the head origin coordinate system 185 of the CG, abbreviated CGy, is greater than the coordinate on the y-axis of the head origin coordinate system 185 of the FICG, abbreviated FICGy. In a further example, FICGy is no more than 50% of CGy, and no more than 40%, 30%, 20%, and 15% in additional examples. In one example FICGy is at least 3 mm, and at least 5 mm, 7 mm, and 9 mm in further examples. However, in another series of examples, FICGy is no more than 30 mm, and no more than 25 mm, 20 mm, 17 mm, 14 mm, and 11 mm in additional examples. In an example FI Z-up is no more than 15 mm, and no more than 12.5 mm, 10 mm, and 7.5 mm in further examples.

The golf club head 100 additionally includes a ring 106 (e.g., a rear ring) that is joined to the continuous collar 104 at a toe-side joint 112A and a heel-side joint 112B (see, e.g., FIG. 12). As presented above, the continuous collar 104 defines at least part of the forward portion 112 of the golf club head 100. In contrast, the ring 106 defines at least part of the rearward portion 118 of the golf club head 100. Additionally, the continuous collar 104 defines part of the crown portion 119, the sole portion 117, the heel portion 116, the toe portion 114, and the skirt portion 121. Similarly, the ring 106 defines part of the heel portion 116, the toe portion 114, and the skirt portion 121. The ring 106 is not circumferentially closed or does not form a continuous annular or circular shape. Instead, the ring 106 is circumferentially open and defines a substantially semi-circular shape. Thus, as defined herein, the ring 106 is termed a ring because it has a ring-like, semi-circular shape, and, when joined to the continuous collar 104, forms a circumferentially closed or annular shape with the continuous collar 104.

The ring 106 is formed separately from the continuous collar 104 and subsequently joined to the continuous collar 104. Accordingly, the golf club head 100 has at least a four-piece construction where the continuous collar 104 defines one piece of the golf club head 100, the ring 106 defines another piece of the golf club head 100, the forward insert 200 defines another piece of the golf club head 100, and the strike plate 143 defines yet another piece of the golf club head 100. A seam between the ring 106 and the continuous collar 104 is defined at each of a toe-side joint 112A and a heel-side joint 112B where the continuous collar 104 and the ring 106 are adjoined (see, e.g., FIG. 12). Similarly, a seam between the forward insert 200 and the continuous collar 104 is defined at an insert-collar joint 115 where the forward insert 200 and the continuous collar 104 are adjoined (see, e.g., FIGS. 8, 10, and 13). As presented above, a seam is also defined between the strike plate 143 and the plate-opening recessed ledge 147.

The continuous collar 104, the ring 106, the forward insert 200, and the strike plate 143 are separately formed using any of various manufacturing techniques. In one example, each one of the continuous collar 104, the ring 106, and the forward insert 200 are formed using a casting process, and the strike plate 143 is formed using a fiber-reinforced polymer material layup and curing process. However, in other examples, one or more of the continuous collar 104, the ring 106, and the forward insert 200 are formed using another type of manufacturing process, such as molding, forging, extruding, and the like. Because the continuous collar 104, the ring 106, the forward insert 200, and the strike plate 143 are formed separately, the continuous collar 104, the ring 106, the forward insert 200, and the strike plate 143 can be made of different materials. For example, the continuous collar 104 can be made of a first material, the ring 106 can be made of a second material, the forward insert 200 can be made of a third material, and the strike plate 143 can be made of a fourth material, where the first, second, third, and fourth materials are different from each other. In some examples, each one of the continuous collar 104, the ring 106, and the forward insert 200 has a one-piece-monolithic and seamless construction.

However, in certain examples, one or more of the continuous collar 104, the ring 106, and the forward insert 200 has a multi-piece monolithic and seamless construction. According to one example, the continuous collar 104 has a two-piece construction. More specifically, the continuous collar 104 has a crown-toe piece and a crown-heel piece, in one example, where each one of the crown-toe piece and the crown-heel piece form a portion of the plate-opening recessed ledge 147. The crown-toe piece is attached to one end of the forward insert 200 and the crown-heel piece is attached to an opposite end of the forward insert 200. The crown-toe piece and the crown-heel piece of the continuous collar 104 are attached to each other at the crown portion 119 of the golf club head 100 and at the sole portion 117 of the golf club head 100 (e.g., to co-form the bridge portion 225). In certain implementations, the crown-toe piece is made of a first material, the crown-heel piece is made of a second material, and the forward insert 200 is made of a third material. The first material, the second material, and the third material are different from each other. According to some examples, the third material has a density greater than that of the second material, and the second material has a density greater than that of the third material. In one example, the first material is an aluminum alloy, the second material is made of a titanium alloy, and the third material is made of a tungsten alloy or a steel alloy.

Referring to FIGS. 9, 13, and 15, the continuous collar 104 includes a toe ring-engagement surface 150A and a heel ring-engagement surface 150B. Similarly, referring to FIG. 9, the ring 106 includes a toe collar-engagement surface 152A and a heel collar-engagement surface 152B. The toe-side joint 112A is formed by abutting and securing together the toe ring-engagement surface 150A of the continuous collar 104 and the toe collar-engagement surface 152A of the ring 106 and abutting and securing together the heel ring-engagement surface 150B of the continuous collar 104 and the heel collar-engagement surface 152B of the ring 106. In one example, the engagement surfaces are secured together via adhesive bonding, but can be secured together via any suitable securing techniques, such as welding, brazing, mechanical fasteners, and the like, in other examples.

To help strengthen and stiffen the toe-side joint 112A and the heel-side joint 112B, complementary mating elements can be incorporated into or coupled to the engagement surfaces. In the illustrated example, the continuous collar 104 includes a toe projection 154A protruding from the toe ring-engagement surface 150A and a heel projection 154B protruding from the heel ring-engagement surface 150B. In contrast, in the illustrated example, the ring 106 includes a toe receptacle 156A formed in the toe collar-engagement surface 152A and a heel receptacle 156B formed in the heel collar-engagement surface 152B. The toe projection 154A mates with (e.g., is received within) the toe receptacle 156A and the heel projection 154B mates with (e.g., is received within) the heel receptacle 156B as the engagement surfaces abut each other to form the joints. Although in the illustrated example, the toe projection 154A and the heel projection 154B form part of the continuous collar 104 and the toe receptacle and the heel receptacle 156B form part of the ring 106, in other examples, the mating elements can be reversed such that the toe projection 154A and the heel projection 154B form part of the ring 106 and the toe receptacle and the heel receptacle 156B form part of the continuous collar 104. Additionally, different types of complementary mating elements, such as tabs and notches, can be used in addition to or in place of the projections and receptacles.

Figure 3:
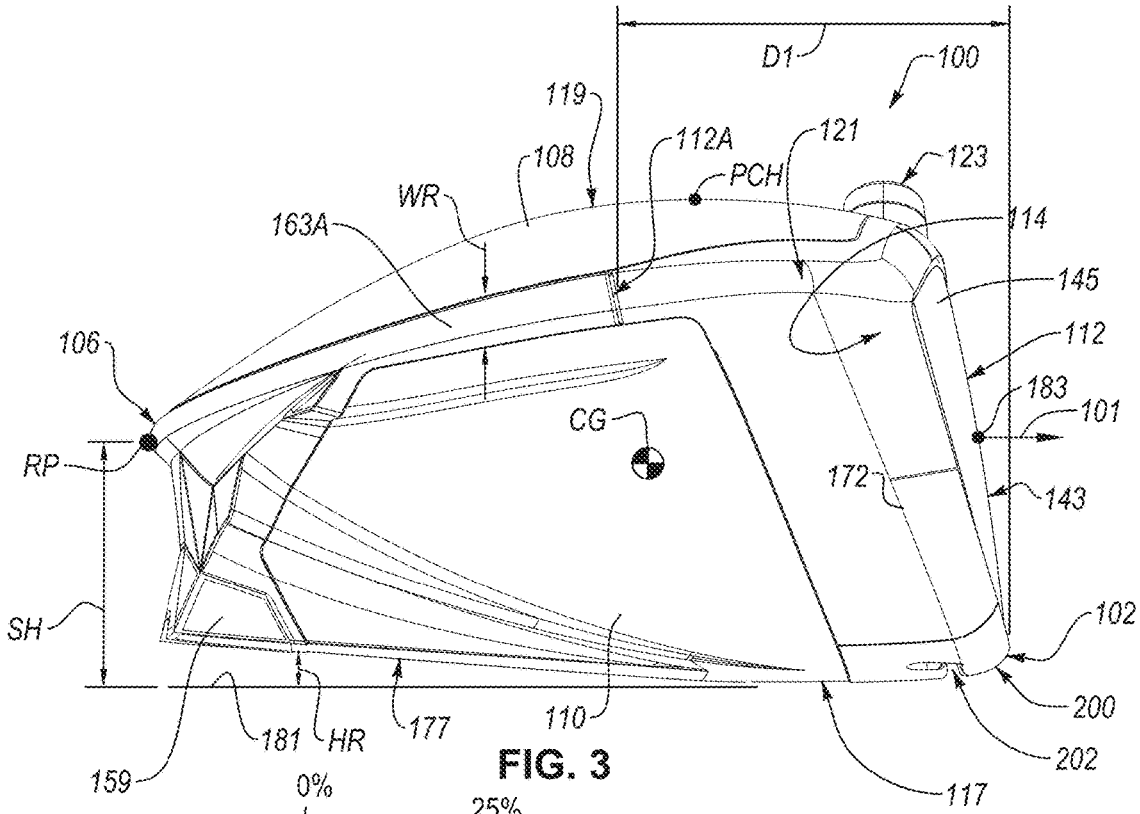
FIG. 3 is a schematic, side elevation view of the golf club head of FIG. 1, according to one or more examples of the present disclosure.
Figure 4:
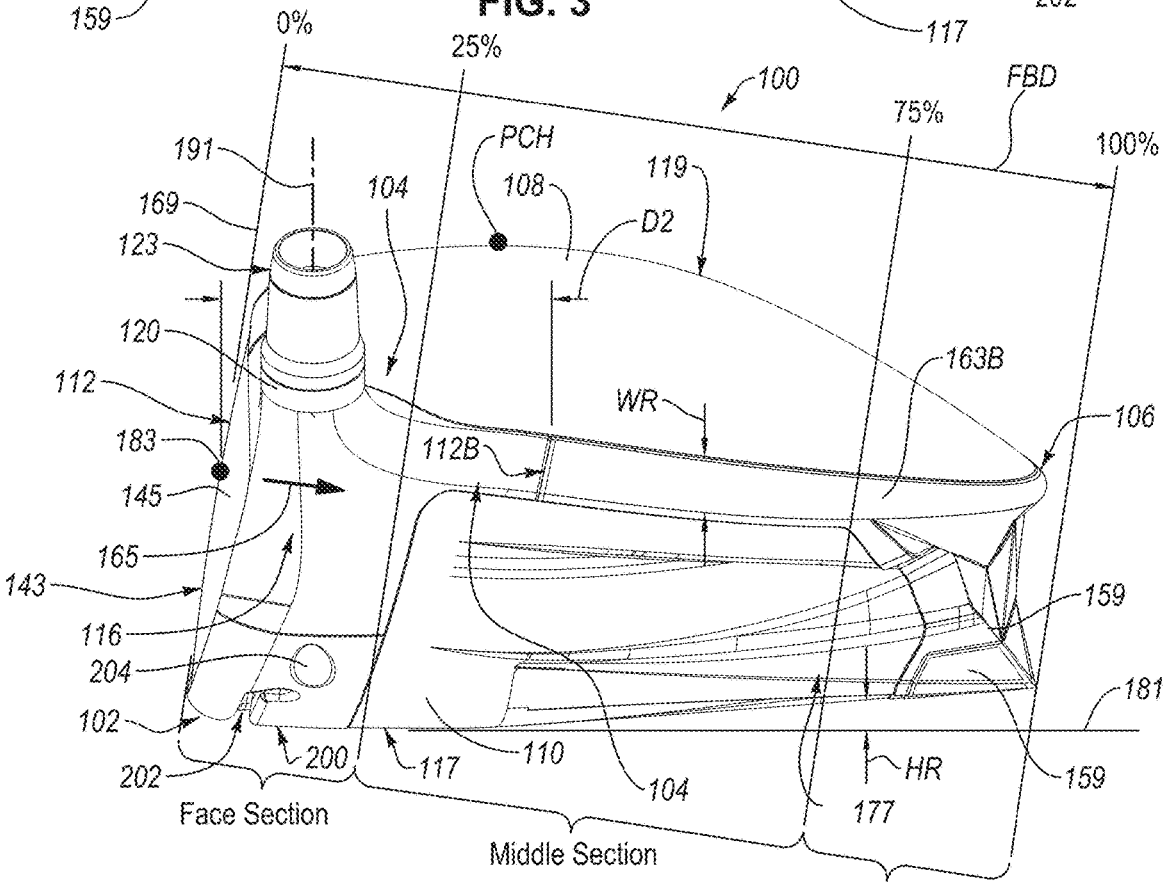
FIG. 4 is another schematic, side elevation view of the golf club head of FIG. 1, according to one or more examples of the present disclosure.

In some examples, the toe-side joint 112A and the heel-side joint 112B are located a sufficient distance from the strike face 145 to avoid potential failures due to severe impacts undergone by the golf club head 100 when striking a golf ball. For example, each one of the toe-side joint 112A and the heel-side joint 112B can be spaced at least 20 mm, at least 30 mm, at least 40 mm, at least 50 mm, at least 60 mm, and/or from 20 mm to 70 mm rearward of the center face 183 of the strike face 145, as measured along a y-axis (front-to-back direction) of the club head origin coordinate system 185. Referring to FIGS. 3 and 4, according to certain examples, a first distance D1, from the strike face 145 to the heel ring-engagement surface 150B, is less than a second distance D2, from the strike face 145 to the toe ring-engagement surface 150A. In other words, in some examples, the continuous collar 104 extends rearwardly from the strike face 145 a shorter distance at the heel portion 116 than at the toe portion 114.

Referring to FIGS. 6, 9, 10, and 12B, the ring 106 includes a cantilevered portion 161, and a toe arm portion 163A and a heel arm portion 163B extending from the cantilevered portion 161. The toe arm portion 163A and the heel arm portion 163B are on opposite sides of the golf club head 100, initiate at the cantilevered portion 161, and terminate at a corresponding one of the toe collar-engagement surface 152A and the heel collar-engagement surface 152B. The cantilevered portion 161 defines at least part of the rearward portion 118 of the golf club head 100 and further defines a rearmost end of the golf club head 100. Moreover, in the illustrated examples, the cantilevered portion 161 extends from the crown portion 119 to the sole portion 117. Accordingly, the cantilevered portion 161 defines part of the sole portion 117 of the golf club head 100 in some examples, such as defining an outwardly-facing surface of the sole portion 117 of the golf club head 100.

In some examples, the cantilevered portion 161 is close to the ground plane 181 when the golf club head 100 is in the address position. According to certain examples, a ratio of the peak crown height to a vertical distance from the peak crown height to a lowest surface of the cantilevered portion 161 of the ring 106 is at least 6.0, at least 5.0, at least 4.0, or more preferably at least 3.0. Alternatively, or additionally, in some examples, a vertical distance from a skirt height (SH) of the skirt portion, at a rearwardmost point (RP) of the golf club head 100, to a lowermost surface of the cantilevered portion 161 of the ring 106, when the golf club head 100 is in the address position, is no less than between 20 mm and 30 mm.

The toe arm portion 163A and the heel arm portion 163B define a toe side of the skirt portion 121 and a heel side of the skirt portion 121, respectively, as well as part of the toe portion 114 and heel portion 116, respectively, of the golf club head 100. The cantilevered portion 161 extends downwardly away from the toe arm portion 163A and the heel arm portion 163B, while the toe arm portion 163A and the heel arm portion 163B extend forwardly away from the cantilevered portion 161. Accordingly, the cantilevered portion 161 is closer to the ground plane 181 than the toe arm portion 163A and the heel arm portion 163B when the golf club head 100 is in the address position. In other words, referring to FIGS. 3, 4, and 10, a height (HR) of the lowest surface of the ring 106 above the ground plane 181, in a vertical direction when the golf club head 100 is in the address position, at any location along the cantilevered portion 161 is less than at any location along the toe arm portion 163A and the heel arm portion 163B.

In some examples, the height HR of the lowest surface of the toe arm portion 163A at the toe portion 114 of the golf club head 100 is different than the height HR of the lowest surface of the heel arm portion 163B at the heel portion 116 of the golf club head 100. More specifically, in one example, the height HR of the lowest surface of the toe arm portion 163A at the toe portion 114 of the golf club head 100 is greater than the height HR of the lowest surface of the heel arm portion 163B at the heel portion 116 of the golf club head 100.

According to certain examples, as shown in FIGS. 3, 4, and 10, a width (WR) of the of the ring 106, as measured in a vertical direction when the golf club head 100 is in the address position, varies in a forward-to-rearward direction (e.g., along a length of the ring 106). In one example, the width WR increases from a minimum width to a maximum width in the forward-to-rearward direction. In other words, the width WR of the ring 106 varies in the forward-to-rearward direction in certain examples. In some examples, the maximum width WR of the ring 106 is at the rearmost end of the golf club head 100. In one example, the maximum width WR of the ring 106 is as least 20 mm. According to certain examples, as shown in FIG. 14, the width WR of the ring 106 at the toe portion 114 is less than the width WR of the ring 106 at the heel portion 116. According to some additional examples, a thickness of the ring 106 can vary along the ring 106 in a forward-to-rearward direction.

The continuous collar 104, the forward insert 200, and the ring 106 collectively form a body 102 or frame of the golf club head 100. Other structural pieces of the golf club head 100, such as the crown insert 108, the sole insert 110, and the strike plate 143 can be attached to the body 102 of the golf club head 100.

Figure 12B:
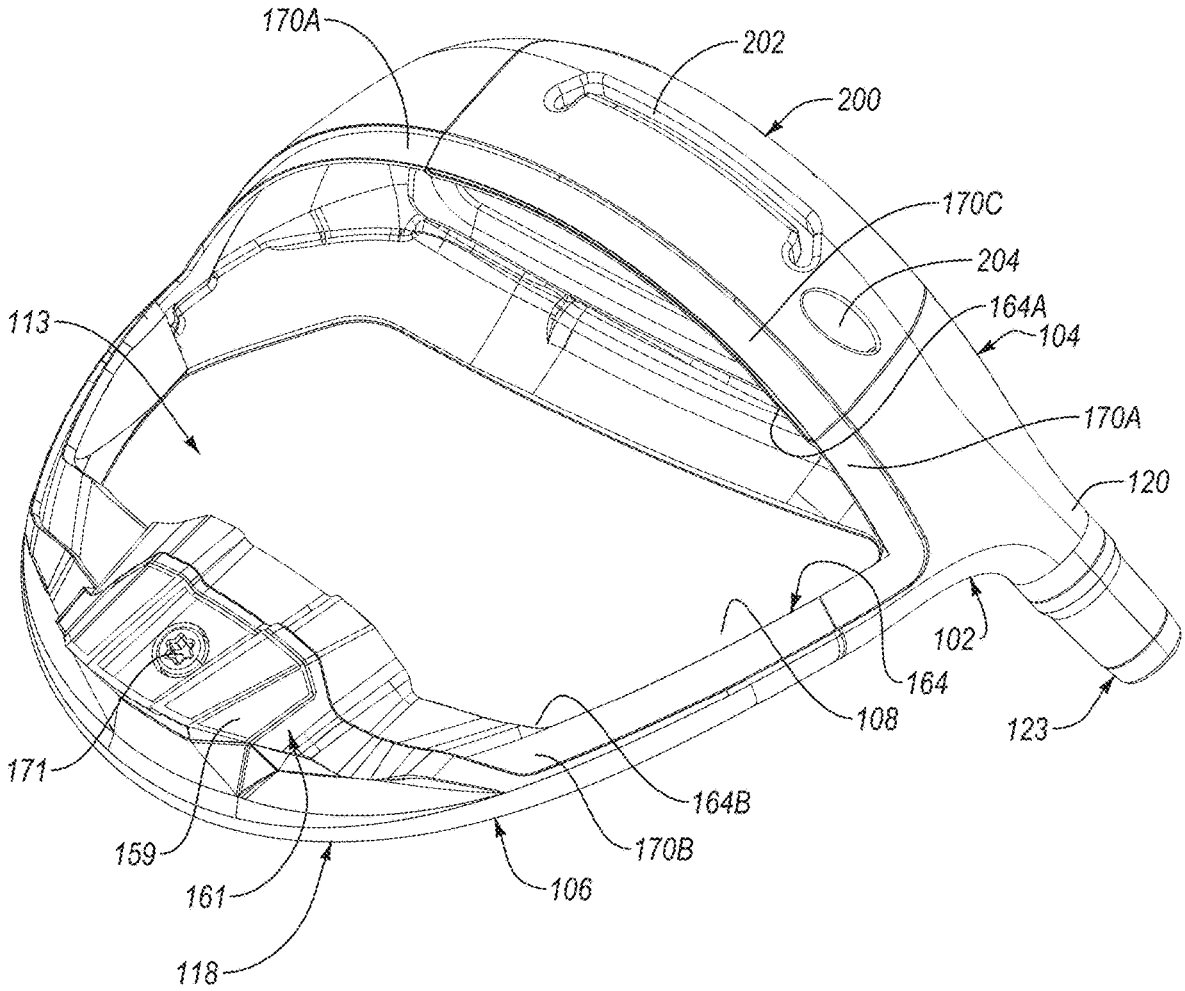
FIG. 12B is a schematic, perspective view of the golf club head of FIG. 1, shown with a sole insert removed, according to one or more examples of the present disclosure.

Referring to FIGS. 10A, 12A, and 12B, the body 102 comprises a crown opening 162 and a sole opening 164. The crown opening 162 is located at the crown portion 119 of the golf club head 100 and when open provides access into the interior cavity 113 of the golf club head 100 from a top of the golf club head 100. In contrast, the sole opening 164 is located at the sole portion 117 of the golf club head 100 and when open provides access into the interior cavity 113 of the golf club head 100 from a bottom of the golf club head 100. Corresponding sections of the crown opening 162 are defined by the continuous collar 104 and the ring 106 (see, e.g., FIG. 12A), and corresponding sections of the sole opening 164 are defined by the continuous collar 104, the ring 106, and the forward insert 200 (see, e.g., FIG. 12B). More specifically, referring to FIG. 12A, a forward section 162A of the crown opening 162 is defined by the continuous collar 104 and a rearward section 162B of the crown opening 162 is defined by the ring 106, and referring to FIG. 12B, a forward section 164A of the sole opening 164 is defined by both the continuous collar 104 and the forward insert 200 and a rearward section 164B of the sole opening 164 are defined by the ring 106. Accordingly, when the continuous collar 104, the ring 106, and the forward insert 200 are joined together, the forward section 162A and the rearward section 162B collectively define the crown opening 162, and the forward section 164A and the rearward section 164B collectively define the sole opening 164.

The ring 106 includes a rearward crown-opening recessed ledge 168B and a rearward sole-opening recessed ledge 170B. The forward crown-opening recessed ledge 168A and the rearward crown-opening recessed ledge 168B collectively form the crown-opening recessed ledge 168 of the body 102. The first forward sole-opening recessed ledge 170A, the second forward sole-opening recessed ledge 170C, and the rearward sole-opening recessed ledge 170B collectively form the sole-opening recessed ledge 170 of the golf club head 100. In some examples, the crown-opening recessed ledge 168 and the sole-opening recessed ledge 170 are non-planar or curved. The ledges are offset inwardly, toward the interior cavity 113, from the exterior surfaces of the body 102 surrounding the ledges by distances corresponding with the thicknesses of the crown insert 108 and the sole insert 110. In some examples, the offset of the ledges from the exterior surfaces of the body 102 is approximately equal to the corresponding thicknesses of the crown insert 108 and the sole insert 110, such that the crown and sole inserts are flush with the corresponding surrounding exterior surfaces of the body 102 when attached to the ledges. However, in some examples, the crown insert 108 and the sole insert 110 need not be flush with (e.g., can be raised or recessed relative to) the surrounding exterior surface of the body 102 when seatably engaged with the corresponding ledges. In some examples, a thickness of the sole insert 110 is greater than a thickness of the crown insert 108. Moreover, the sole insert 110 is made up of a first quantity of stacked plies, each made of a fiber-reinforced polymeric material, and the crown insert 108 is made up of a second quantity of stacked plies, each made of a fiber-reinforced polymeric material. In some examples, the first quantity of stacked plies is greater than the second quantity of stacked plies.

The inner periphery of the forward crown-opening recessed ledge 168A defines the forward section 162A of the crown opening 162 and the inner periphery of the rearward crown-opening recessed ledge 168B defines the rearward section 162B of the crown opening 162. Likewise, the inner periphery of the first forward sole-opening recessed ledge 170A and the second first forward sole-opening 170C defines the periphery of the forward section 164A of the sole opening 164 and the inner periphery of the rearward sole-opening recessed ledge 170B defines the periphery of the rearward section 164B of the sole opening 164. Accordingly, the inner periphery of the crown-opening recessed ledge 168 defines the periphery of the crown opening 162 and the inner periphery of the sole-opening recessed ledge 170 defines the periphery of the sole opening 164.

Figure 31:
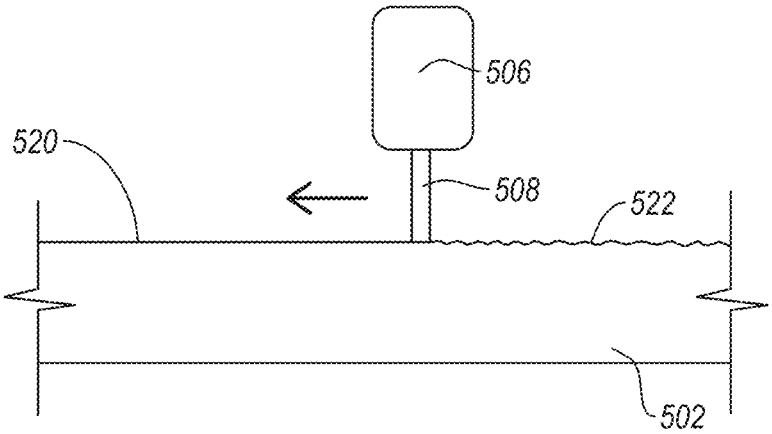
FIG. 31 is a schematic, side elevation view of a first part of a golf club head being laser ablated by a first laser, according to one or more examples of the present disclosure.

Referring to FIG. 31, a thickness of the body 102 at the crown portion 119 decreases in a rearward-to-forward direction from a forward extent 132 of the crown opening recessed ledge 168, and decreases in a forward-to-rearward direction from the forward extent 132 of the crown opening recessed ledge 168. This results in a localized increase in thickness at the forward extent 132, which helps to strengthen and stiffen the joint between the body 102 and the crown insert 108.

The crown insert 108 (or crown panel) is attached to the body 102 at a top of the golf club head 100, and the sole insert 110 (or sole panel) is attached to the body 102 at a bottom of the golf club head 100. Accordingly, the body 102 effectually provides a frame to which the crown insert 108 and the sole insert 110 are attached.

The crown insert 108 and the sole insert 110 are formed separately from each other and separately from the body 102. Accordingly, the crown insert 108 and the sole insert 110 are attached to the body 102 as shown in FIG. 9. In some examples, the crown insert 108 is seated on and adhered, such as with an adhesive, to the crown-opening recessed ledge 168 and the sole insert 110 is seated on and adhered, such as with an adhesive, to the sole-opening recessed ledge 170. In this manner, the crown insert 108 encloses or covers the crown opening 162 and defines, at least in part, the crown portion 119 of the golf club head 100, and the sole insert 110 encloses or covers the sole opening 164 and defines, at least in part, the sole portion 117 of the golf club head 100. Accordingly, the golf club head 100 has at least a six-piece construction where, in addition to the continuous collar 104, the ring 106, the forward insert 200, and the strike plate 143, the crown insert 108 and the sole insert 110 defines fifth and sixth pieces of the golf club head 100. As explained below, the crown insert 108 and the sole insert 110 can be made of a material different than the continuous collar 104, the forward insert 200, and the ring 106, but the same as the material of the strike plate 143.

The crown insert 108 and the sole insert 110 can have any of various shapes. Referring to FIG. 4, in one example, the crown insert 108 is shaped such that a location (PCH), corresponding with the peak crown height of the golf club head 100, is rearward of the hosel 120 and rearward of the hosel axis 191. The peak crown height is the maximum crown height of a golf club head where the crown height at a given location along the golf club head is the distance from the ground plane 181, parallel to the z-axis of the club head origin coordinate system 185, when the golf club head is in the address position on the ground plane, to an uppermost point on the crown portion at the given location. In some examples, the crown height of the golf club head 100 increases and then decreases in a front-to-rear direction away from the strike face 145. In certain examples, the portion or exterior surface of the crown portion that defines the peak crown height is made of the at least one first material. According to some examples, a first crown height is defined at a face-to-crown transition region in the forward crown area where the club face connects to the crown portion of the club head, a second crown height is defined at a crown-to-skirt transition region where the crown portion connects to a skirt of the golf club head near a rear end of the golf club head, and a maximum crown height is defined rearward of the first crown height and forward of the second crown height, where the maximum crown height is greater than both the first and second crown heights. In some examples, the maximum crown height occurs toeward of a geometric center of the strike face. According to certain examples, the maximum crown height is formed by a non-metal composite crown insert.

The peak crown height is associated with a maximum club head height defined as the maximum above ground z-axis coordinate of the outer surface of the crown. Similarly, a maximum club head width can be defined as the distance between the maximum extents of the heel and toe portions of the body measured along an axis parallel to the x-axis of the club head origin coordinate system 185 when the club head 100 is at normal address position and a maximum club head depth, or length, defined as the distance between the forwardmost and rearwardmost points on the surface of the club head 100 measured along an axis parallel to the y-axis of the club head origin coordinate system 185 when the club head 100 is at normal address position. Generally, the height and width of club head 100 should be measured according to the USGA "Procedure for Measuring the Clubhead Size of Wood Clubs" Revision 1.0. The heel portion of the club head 100 is broadly defined as the portion of the club head 100 from a vertical plane passing through the y-axis of the club head origin coordinate system 185 toward the hosel, while the toe portion is that portion of the club head 100 on the opposite side of the vertical plane passing through the y-axis.

Referring to FIG. 3, a skirt height (shown associated with the rearwardmost point RP of the golf club head 100, but can be associated with any point along the skirt portion 121), is the distance from the ground plane 181, when the golf club head 100 is in the address position on the ground plane 181, to an uppermost point on the skirt portion 121. According to some examples, a ratio of PCH to the skirt height (SH) at the rearwardmost point RP ranges between about 0.45 to 0.59, preferably 0.49-0.55, and in one example the skirt height at the rearwardmost point RP is about 34 mm and the peak crown height is about 65 mm, which results in a ratio of skirt height, at the rearwardmost point RP, to peak crown height of about 0.52. A skirt height, at the rearwardmost point RP, typically ranges between 28 mm and 38 mm, preferably between 31 mm and 36 mm. A peak crown height typically ranges between 60 mm and 70 mm, preferably between 62 mm and 67 mm. It is desirable to limit a difference between the peak crown height and the skirt height, at the rearwardmost point RP, to no more than 40 mm, preferably between 27 mm and 35 mm. It is desirable for the skirt height, at the rearwardmost point RP, to be the same as or greater than a Z-up value for the golf club head 100, which is the vertical distance along a z-axis from the ground plane 181 to the CG of the golf club head 100. It is desirable for the peak crown height to be two times (2×) larger than a Z-up value for the golf club head 100. A greater skirt height, at the rearwardmost point RP, may help with better aerodynamics and better air flow attachment especially for faster swing speeds. Likewise, if the difference between the peak crown height and skirt height, at the rearwardmost point RP, is too great there will be a greater likelihood of the flow separating early from the golf club head 100, which can result in an increased likelihood of turbulent flow. In some examples, the Z-up value of the golf club head 100 is between 22 and 39 mm, such as between 25 mm and 30 mm.

Figure 6:
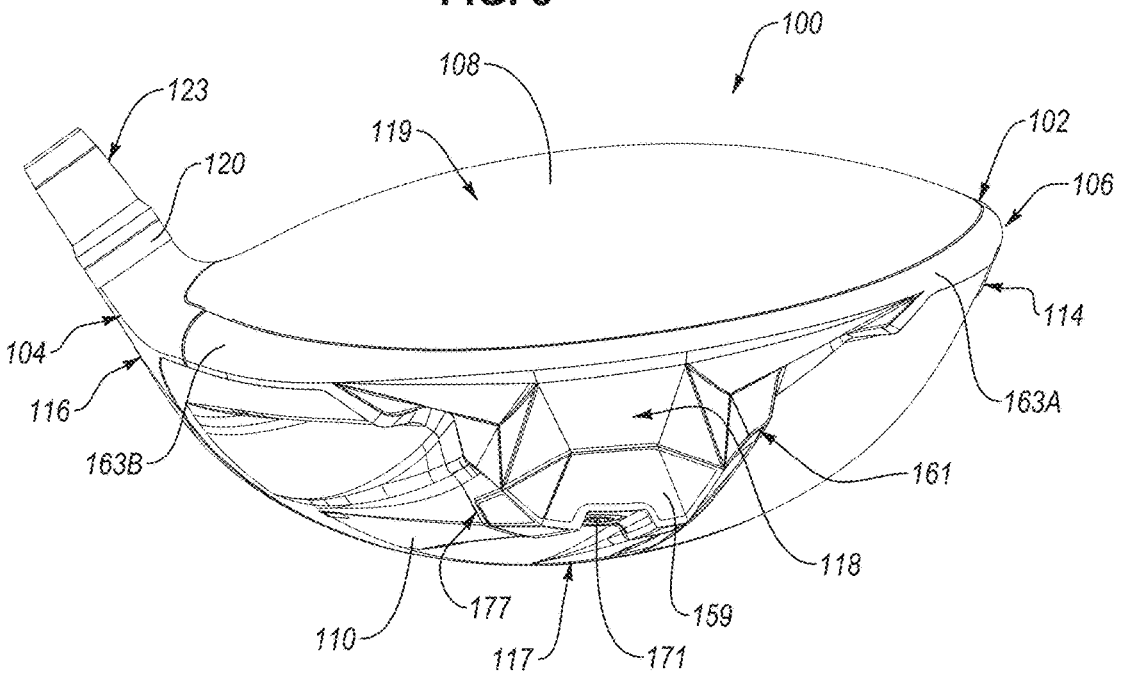
FIG. 6 is a schematic, rear view of the golf club head of FIG. 1, according to one or more examples of the present disclosure.
Figure 7:
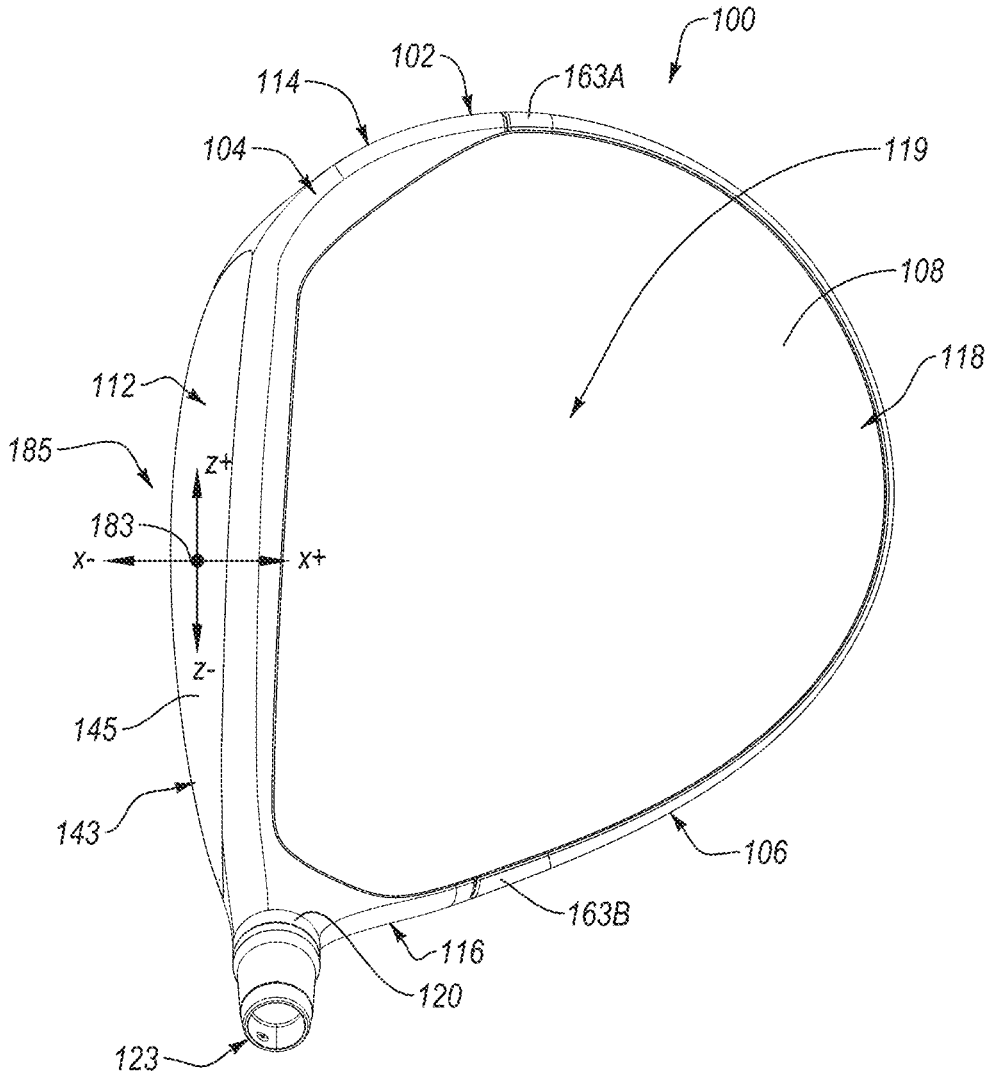
FIG. 7 is a schematic, top plan view of the golf club head of FIG. 1, according to one or more examples of the present disclosure.

Referring to FIG. 6, in some examples, when the golf club head 100 is in the proper address position on the ground plane 181, the skirt height at the rearwardmost point RP is above the center face 183. In other words, the distance between the ground plane 181 and the skirt at the rearwardmost point RP is greater than the distance between the ground plane 181 and the center face 183. Moreover, at a location toeward of the rearwardmost point RP, the skirt height is greater than at the rearwardmost point RP, and, at a location heelward of the rearwardmost point RP, the skirt height is less than at the rearwardmost point RP.

The construction and material diversity of the golf club head 100 enables the golf club head 100 to have a desirable center-of-gravity (CG) location and peak crown height location. In one example, a y-axis coordinate, on the y-axis of the club head origin coordinate system 185, of the location (PCH) of the peak crown height is between about 26 mm and about 42 mm. In the same or a different example, a distance parallel to the z-axis of the club head origin coordinate system 185, from the ground plane 181, when the golf club head 100 is in the address position, of the location (PCH) of the peak crown height ranges between 60 mm and 70 mm, preferably between 62 mm and 67 mm as described above. According to some examples, a y-axis coordinate, on the y-axis of the head origin coordinate system 185, of the center-of-gravity (CG) of the golf club head 100, abbreviated CGy, ranges between 25 mm and 60 mm, preferably at least 30 mm, and at least 34 mm, 38 mm, 40 mm, 42 mm, 44 mm in additional embodiments. In a further series of embodiments CGy is no more than 52 mm, and no more than 50 mm, 48 mm, and 46 mm in additional embodiments. An x-axis coordinate, on the x-axis of the head origin coordinate system 185, of the center-of-gravity (CG) of the golf club head 100, abbreviated CGx, ranges between −5 mm and 3 mm, and greater than −4 mm in another embodiment, and greater than −3 mm, and −2 mm, and −1 mm in further embodiments. In another series of embodiments CGx is no more than 2 mm, and no more than 1 mm, and 0 mm in additional embodiments. Likewise, a z-axis coordinate, on the z-axis of the head origin coordinate system 185, of the center-of-gravity (CG) of the golf club head 100, abbreviated CGz, is between zero and −10 mm, less than −3 mm, or less than −4 mm.

The crown insert 108 has a crown-insert outer surface that defines an outward-facing surface or exterior surface of the crown portion 119. Similarly, the sole insert 110 has a sole-insert outer surface that defines an outward-facing surface or exterior surface of the sole portion 117. As defined herein, the crown-insert outer surface and the sole-inert outer surface includes the combined outer surfaces of multiple crown inserts and multiple sole inserts, respectively, if multiple crown inserts or multiple sole inserts are used. In one example, a total surface area of the sole-insert outer surface is smaller than a total surface area of the crown-insert outer surface. According to one example, the total surface area of the crown-insert outer surface is at least 9,482 $mm^2$. In one example, the total surface area of the sole-insert outer surface is at least 8,750 $mm^2$ and the sole insert has a maximum width, parallel to a heel-to-toe direction, of at least between 80 mm and 120 mm. The total surface area of the crown-insert outer surface can range between 5,300 mm^2 to 11,000 mm^2, preferably between 9,200 mm^2 and 10,300 mm^2, preferably between 5,300 mm^2 and 7,000 mm^2. The total surface area of the sole-insert outer surface can range between 4,300 mm^2 to 10,200 mm^2, preferably between 7,700 mm^2 and 9,900 mm^2, preferably between 4,300 mm^2 and 6,600 mm^2.

Preferably the total surface area of the sole-insert outer surface is greater than the total surface area of the sole-insert outer surface in the instance when at least a portion of the sole is formed of a composite material. A ratio of total surface area of the crown-insert outer surface formed of composite material to the total surface area of the sole-insert outer surface formed of composite material may be at least 2:1 in some examples, in other instance the ratio may be between 0.95 and 1.5, more preferably between 1.03 and 1.4, even more preferably between 1.05 and 1.3. In this instance a composite material will generally have a density between about 1 g/cc and about 2 g/cc, and preferably between about 1.3 g/cc and about 1.7 g/cc.

In some examples, the total exposed composite surface area in square centimeters multiplied by the CGy in centimeters and the resultant divided by the volume in cubic centimeters may range from 1.22 to 2.1, preferably between 1.24 and 1.65, even more preferably between 1.49 and 2.1, and even more preferably 1.7 and 2.1.

Moreover, the total mass of the crown insert 108 is less than a total mass of the sole insert 110 in some examples. According to some examples, where the crown insert 108 and the sole insert 110 are made of a fiber-reinforced polymeric material and the body 102 is made of a metallic material, a ratio of a total exposed surface area of the body 102 to a total exposed surface area (e.g., the surface area of the outward-facing surfaces) of the crown insert 108 and the sole insert 110 is between 0.95 and 1.25 (e.g., 1.08). The crown insert 108, whether a single piece or split into multiple pieces, has a mass of 9 grams and the sole insert 110, whether a single piece or split into multiple pieces, has a mass of 13 grams, in some examples. Moreover, in certain examples, the crown insert 108 is about 0.65 mm thick and the sole insert 110 is about 1.0 mm thick. However, in certain examples, the minimum thickness of the crown portion 119 is less than 0.6 mm. According to some examples, an areal weight of the crown portion 119 of the golf club head 100 is less than 0.35 $g/cm^2$ over more than 50% of an entire surface area of the crown portion 119 and/or at least part of the crown portion 119 is formed of a non-metal material with a density between about 1 $g/cm^3$ to about 2 $g/cm^3$. These and other properties of the crown insert 108 and the sole insert 110 can be found in U.S. Patent Application Publication No. 2020/0121994, published Apr. 23, 2020, which is incorporated herein by reference in its entirety. In certain examples, an areal weight of the sole portion 117 is less than about 0.35 $g/cm^2$ over more than about 50% of an entire surface area of the sole portion 117. In certain examples, an areal weight of the crown insert 108 is less than an areal weight of the sole insert 110. At least 50% of the crown portion 119 has a variable thickness that changes at least 25% along at least 50% of the crown portion 119, in certain examples.

Figure 23:
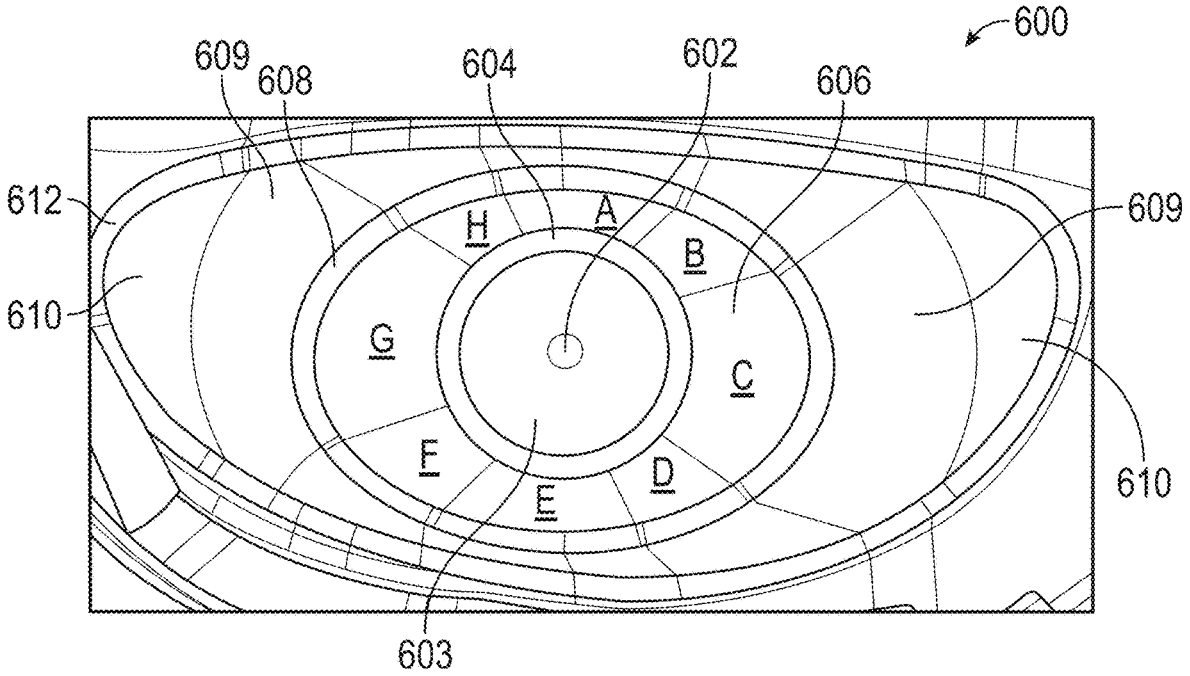
FIG. 23 is a schematic, rear view of a face portion of a golf club head, according to one or more examples of the present disclosure.
Figure 24:
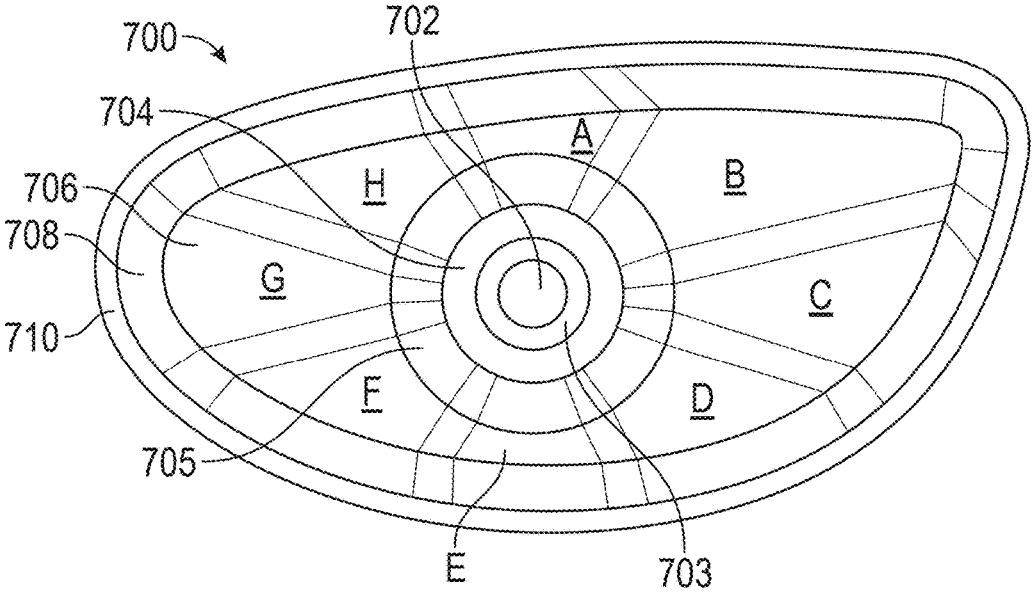
FIG. 24 is a schematic, rear view of a face portion of a golf club head, according to one or more examples of the present disclosure.
Figure 25:
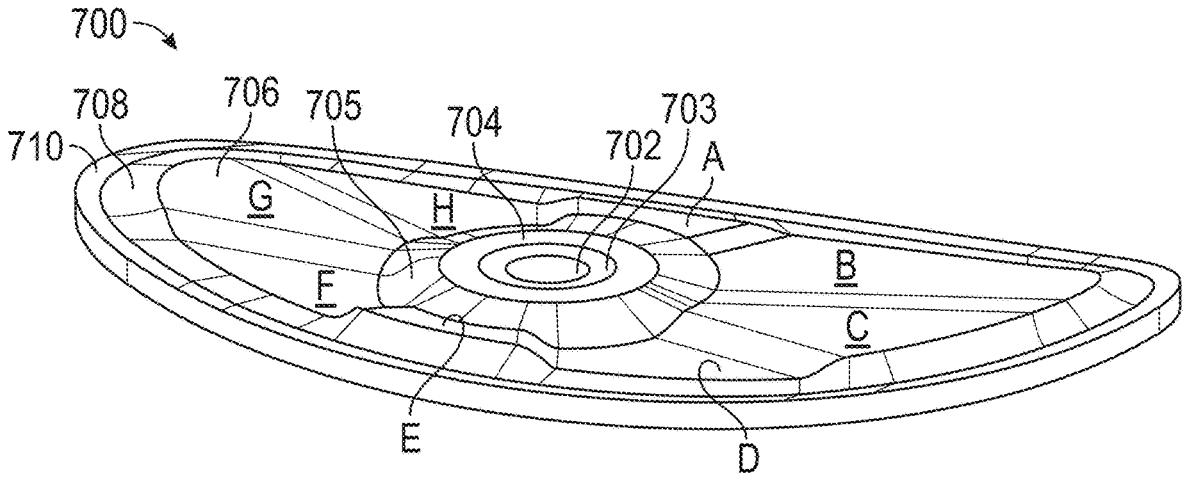
FIG. 25 is a schematic, perspective view of the face portion of FIG. 56, according to one or more examples of the present disclosure.
Figure 26:
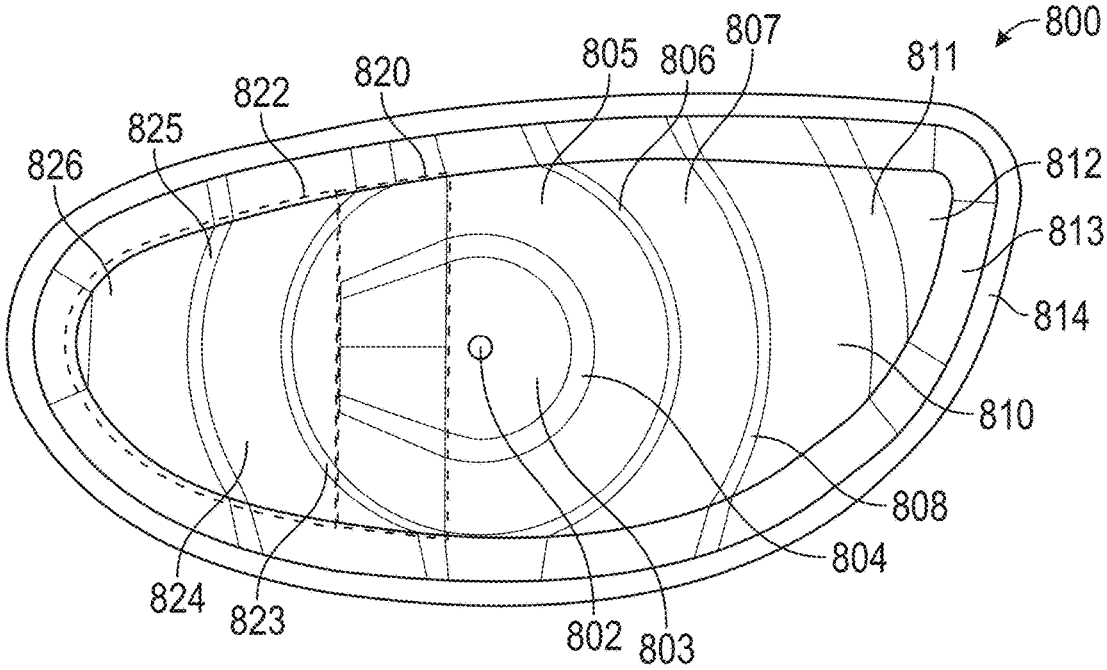
FIG. 26 is a schematic, rear view of a face portion of a golf club head, according to one or more examples of the present disclosure.

FIG. 23 illustrates a rear surface of a strike plate 600, which is one example of the strike plate 143 of the golf club head 100. In FIG. 23, the rear surface is viewed from the rear with the hosel/heel to the left and the toe to the right. FIGS. 24 and 25 illustrate a rear surface of a strike plate 700, which is another example of the strike plate 143 of the golf club head 100. FIG. 26 illustrates a rear surface of a strike plate 800, which is another example of the strike plate 143 of the golf club head 100. Each one of the strike plate 600, the strike plate 700, and the strike plate 800 has a variable thickness profile. The variable thickness profile of the strike plate 700 is formed by a cone-shaped projection, which can have a geometric center that is toeward of a geometric center of the strike face defined by the strike plate 700, in some examples. The strike plate 143 can have a great variety of novel thickness profiles. For example, a thickness of the strike plate 143 can change at least 25% along the strike plate.

The examples of the strike plate 143 disclosed herein, when made of a metallic material, can be formed as a result of a casting process and optional post-casting modifications to the strike plate. By casting the strike plate 143 into a desired geometry, rather than forming the strike plate 143 from a flat rolled sheet of metal in a traditional process, the strike plate 143 can be created with greater variety of geometries and can have different material properties, such as different grain direction and chemical impurity content, which can provide advantages for a golf performance and manufacturing.

In a traditional process, strike plates made of a metallic material, can be formed from a flat sheet of metal having a uniform thickness. Such a sheet of metal is typically rolled along one axis to reduce the thickness to a certain uniform thickness across the sheet. This rolling process can impart a grain direction in the sheet that creates a different material properties in the rolling axis direction compared to the direction perpendicular to the rolling direction. This variation in material properties can be undesirable and can be avoided by using the disclosed casting methods instead to create face portion. Furthermore, because a conventional face plate starts off as a flat sheet of uniform thickness, the thickness of the whole sheet has to be at least as great as the maximum thickness of the desired end product face plate, meaning much of the starting sheet material has to be removed and wasted, increasing material cost. By contrast, in the disclosed casting methods, the face portion is initially formed much closer to the final shape and mass, and much less material has to be removed and wasted. This saves time and cost. Still further, in a conventional process, the initial flat sheet of metal has to be bent in a special process to impart a desired bulge and roll curvature to the face plate. Such a bending process is not needed when using the disclosed casting methods.

The unique thickness profiles illustrated in FIGS. 23-26 are made possible using casting methods, such as those disclosed in U.S. Pat. No. 10,874,915 issued Dec. 29, 2020, which is incorporated by reference in its entirety, and were previously not possible to achieve using conventional processes, such as starting from a sheet of metal having a uniform thickness, mounting the sheet in a lathe or similar machine and turning the sheet to produce a variable thickness profile across the rear of the face plate. In such a turning process, the imparted thickness profile must be symmetrical about the central turning axis, which limits the thickness profile to a composition of concentric circular ring shapes each having a uniform thickness at any given radius from the center point. In contrast, no such limitations are imposed using the disclosed casting methods, and more complex face geometries can be created.

By using casting methods, large numbers of the disclosed club heads can be manufactured faster and more efficiently. For example, 50 or more heads can be cast at the same time on a single casting tree, whereas it would take much longer and require more resources to create the novel face thickness profiles on strike plates using a conventional milling methods using a lathe, one at a time.

In FIG. 23, the rear face surface or interior surface of the strike plate 600 includes a non-symmetrical variable thickness profile, illustrating just one example of the wide variety of variable thickness profiles made possible using the disclosed casting methods. The center 602 of the strike plate 600 can have a center thickness, and the face thickness can gradually increase moving radially outwardly from the center across an inner blend zone 603 to a maximum thickness ring 604, which can be circular. The face thickness can gradually decrease moving radially outwardly from the maximum thickness ring 604 across a variable blend zone 606 to a second ring 608, which can be non-circular, such as elliptical. The face thickness can gradually decrease moving radially outwardly from the second ring 608 across an outer blend zone 609 to heel and toe zones 610 of constant thicknesses (e.g., minimum thickness of the face portion) and/or to a radial perimeter zone 612 defining the extent of the strike plate 600 where the face transitions to the rest of the golf club head 100.

The second ring 608 can itself have a variable thickness profile, such that the thickness of the second ring 608 varies as a function of the circumferential position around the center 602. Similarly, the variable blend zone 606 can have a thickness profile that varies as a function of the circumferential position around the center 602 and provides a transition in thickness from the maximum thickness ring 604 to the variable and less thicknesses of the second ring 608. For example, the variable blend zone 606 to a second ring 608 can be divided into eight sectors that are labeled A-H in FIG. 22, including top zone A, top-toe zone B, toe zone C, bottom-toe zone D, bottom zone E, bottom-heel zone F, heel zone G, and top-heel zone H. These eight zones can have differing angular widths as shown, or can each have the same angular width (e.g., one eighth of 360 degrees). Each of the eight zones can have its own thickness variance, each ranging from a common maximum thickness adjacent the ring 604 to a different minimum thickness at the second ring 608. For example, the second ring can be thicker in zones A and E, and thinner in zones C and G, with intermediate thicknesses in zones B, D, F, and H. In this example, the zones B, D, F, and H can vary in thickness both along a radial direction (thinning moving radially outwardly) and along a circumferential direction (thinning moving from zones A and E toward zones C and G).

One example of the strike plate 600 can have the following thicknesses: 3.1 mm at center 602, 3.3 mm at ring 604, the second ring 608 can vary from 2.8 mm in zone A to 2.2 mm in zone C to 2.4 mm in zone E to 2.0 mm in zone G, and 1.8 mm in the heel and toe zones 610. According to one example, the ring 604 can be about 8 mm away from the center 602 and the ring 608 can be about 19 mm away from the center 602. The thickness of the strike plate 600 at the center 602 can be between 2.8 mm and 3.0 mm. The thickness of the strike plate 600 along the ring 604 can be between 2.9 mm and 3.1 mm. The thickness of the strike plate 600 along the ring 608 proximate zone A can be between 2.35 mm and 2.55 mm, proximate zone C can be between 2.3 mm and 2.5 mm, proximate zone E can be between 2.1 mm and 2.3 mm, and proximate zone G can be between 2.6 mm and 2.8 mm. The thickness of the strike plate 600 at approximately 35 mm away from the center 602 can be between 1.7 mm and 1.9 mm.

According to yet another example, the thickness of the strike plate 600 at the center 602 is between 2.95 mm and 3.35 mm, at about 9 mm away from the center 602 is between 3.3 mm and 3.65 mm, at about 16 mm away from the center 602 is between 2.95 mm and 3.36 mm, and at about 28 mm away from the center 602 is between 2.03 mm and 2.27 mm. The thickness of the strike plate 600 greater than 28 mm away from the center 602 can be between 1.8 mm and 1.95 mm on a toe side of the strike plate 600 and between 1.83 mm and 1.98 mm on a heel side of the strike plate 600.

Referring to FIGS. 24 and 25, the strike plate 700 includes a non-symmetrical variable thickness profile. The center 702 of the strike plate 700 can have a center thickness, and the face thickness can gradually increase moving radially outwardly from the center across an inner blend zone 703 to a maximum thickness ring 704, which can be circular. The face thickness can gradually decrease moving radially outwardly from the maximum thickness ring 704 across a variable blend zone 705 to an outer zone 706 comprised of a plurality of wedge shaped sectors A-H having varying thicknesses. As best shown in FIG. 24, sectors A, C, E, and G can be relatively thicker, while sectors B, D, F, and H can be relatively thinner. An outer blend zone 708 surrounding the outer zone 706 transitions in thickness from the variable sectors down to a perimeter ring 710 having a relatively small yet constant thickness. The outer zone 706 can also include blend zones between each of the sectors A-H that gradually transition in thickness from one sector to an adjacent sector.

One example of the strike plate 700 can have the following thicknesses: 3.9 mm at center 702, 4.05 mm at ring 704, 3.6 mm in zone A, 3.2 mm in zone B, 3.25 in zone C, 2.05 mm in zone D, 3.35 mm in zone E, 2.05 mm in zone F, 3.00 mm in zone G, 2.65 mm in zone H, and 1.9 mm at perimeter ring 710.

According to FIG. 26, the strike plate 800 includes a non-symmetrical variable thickness profile that has a targeted thickness offset toward the heel side (left side). The center 802 of the strike plate 800 has a center thickness, and to the toe/top/bottom the thickness gradually increases across an inner blend zone 803 to inner ring 804 having a greater thickness than at the center 802. The thickness then decreases moving radially outwardly across a second blend zone 805 to a second ring 806 having a thickness less than that of the inner ring 804. The thickness then decreases moving radially outwardly across a third blend zone 807 to a third ring 808 having a thickness less than that of the second ring 806. The thickness then decreases moving radially outwardly across a fourth blend zone 810 to a fourth ring 811 having a thickness less than that of the third ring 808. A toe end zone 812 blends across an outer blend zone 813 to an outer perimeter 814 having a relatively small thickness.

To the heel side, the thicknesses are offset by set amount (e.g., 0.15 mm) to be slightly thicker relative to their counterpart areas on the toe side. A thickening zone 820 (dashed lines) provides a transition where all thicknesses gradually step up toward the thicker offset zone 822 (dashed lines) at the heel side. In the offset zone 822, the ring 823 is thicker than the ring 806 on the heel side by a set amount (e.g., 0.15 mm), and the ring 825 is thicker that the ring 808 by the same set amount. Blend zones 824 and 826 gradually decrease in thickness moving radially outwardly, and are each thicker than their counterpart blend zones 807 and 810 on the toe side. In the thickening zone 820, the inner ring 804 gradually increases in thickness moving toward the heel.

One example of the strike plate 800 can have the following thicknesses: 3.8 mm at the center 802, 4.0 mm at the inner ring 804 and thickening to 4.15 mm across the thickening zone 820, 3.5 mm at the second ring 806 and 3.65 mm at the ring 823, 2.4 mm at the third ring 808 and 2.55 mm at the ring 825, 2.0 mm at the fourth ring 811, and 1.8 mm at the perimeter ring 814. The targeted offset thickness profile shown in FIG. 26 can help provide a desirable CT profile across the face. Thickening the heel side can help avoid having a CT spike at the heel side of the face, for example, which can help avoid having a non-conforming CT profile across the face. Such an offset thickness profile can similarly be applied to the toe side of the face, or to both the toe side and the heel side of the face to avoid CT spikes at both the heel and toe sides of the face. In other examples, an offset thickness profile can be applied to the upper side of the face and/or toward the bottom side of the face.

Referring to FIGS. 1-4, 6, 8-12B, in some examples, the golf club head 100 further includes a mass element 159, or weight, attached to the cantilevered portion 161 of the ring 106, such as at a rearmost end of the golf club head 100. The mass element 159 can be selectively removable from (e.g., interchangeable with differently weighted mass elements) or permanently attached to the cantilevered portion 161. In some examples, the flight control technology component of the golf club head 100 and the mass element 159 are adjustable relative to the golf club head 100. In certain examples, the flight control technology component of the golf club head 100 and the mass element 159 are configured to be adjustable via a single or the same tool.

In one example, the mass element 159 includes external threads. The golf club head 100 can additionally include a mass receptacle coupled to or formed in the cantilevered portion 161 of the ring 106. The mass receptacle can include a threaded aperture, with internal threads, that threadably engages a fastener 171 to secure the mass element 159 to the cantilevered portion 161. The mass receptacle is welded to the cantilevered portion 161 in some examples and adhered to the cantilevered portion 161 in other examples. In certain examples, the mass receptacle is co-formed with the cantilevered portion 161. The mass element 159 has a mass between about 15 grams and about 35 grams (e.g., 24 grams, 27.5 grams, 30 grams, or 30 grams) in some examples. The mass receptacle also defines an opening or recess that is configured to nestably receive the mass element 159. The mass element 159 can be made of a material, such as tungsten, that is different (e.g., denser) than the material of the ring 106. Although shown as being fastened to the ring 106, the mass element 159 can be bonded, such as via an adhesive, to the ring 106 to secure the mass element 159 within the mass receptacle.

According to certain examples, the mass of the forward insert 200 is greater than the mass of the mass element 159, such that a ratio of the forward insert 200 to the mass element 159 is greater than one. In certain examples, a concentrated mass of the golf club head 100, equal to the sum of the mass of the forward insert 200 and the mass of the mass element 159, is between 50 grams and 70 grams, such as about 55 grams, about 60 grams, or about 65 grams. Similarly, a spread mass of the golf club head 100, equal to the sum of the mass of the continuous collar 200 and the mass of the ring 106, is between 65 grams and 80 grams, such as about 68 grams, about 73 grams, or about 78 grams. In view of the foregoing, a ratio of the concentrated mass of the golf club head 100 to the spread mass of the golf club head 100 is between 0.65 and 1.0, such as about 0.70, about 0.82, or about 0.95. As used herein, "about" means within a range of +/−5%.

The outer peripheral shape of the mass element 159 in the illustrated examples is non-circular, such as ovular, triangular, trapezoidal, square, and the like. For example, as illustrated, the mass element 159 has an outer peripheral shape that is trapezoidal or rectangular.

The construction and material diversity of the golf club head 100 enables flexibility of the position of the mass element 159 relative to the position of the forward insert 200 and the CG of the golf club head 100. Referring to FIG. 10A, a third vector V3 initiating from and extending between a center-of-gravity MECG of the mass element 159 and the CG of the golf club head 100 has a length between 70 mm and 95 mm, in some examples. Additionally, a fourth vector V4 initiating from and extending between a center-of-gravity MECG of the mass element 159 and the FICG of the forward insert 200 has a length between 90 mm and 125 mm, in some examples. In certain examples, the fourth vector V4 has a length no less than 75 mm, no less than 80 mm, no less than 85 mm, no less than 90 mm, no less than 95 mm, no less than 100 mm, no less than 105 mm, no less than 110 mm, and no less than 115 mm. In some examples, the golf club head 100 is configured such that a ratio of the fourth vector V4 to a distance between the y-axis coordinate, on the y-axis of the club head origin coordinate system 185, of the forwardmost edge of the golf club head 100 (when in the proper address position) and the y-axis coordinate, on the y-axis of the club head origin coordinate system 185, of the rearwardmost edge of the golf club head 100 (when in the proper address position) is at least 65%, is at least 70%, is at least 75%, is at least 80%, or is at least 90%. In certain examples, the distance between the y-axis coordinate, on the y-axis of the club head origin coordinate system 185, of the forwardmost edge of the golf club head 100 (when in the proper address position) and the y-axis coordinate, on the y-axis of the club head origin coordinate system 185, of the rearwardmost edge of the golf club head 100 (when in the proper address position) is between 114 mm and 120 mm.

According to some examples, the MECG of the mass element 159 has a coordinate on the y-axis of the head origin coordinate system 185 abbreviated MECGy, of at least 1.5 times CGy, and at least 1.7, 1.9, 2.1, 2.3, and 2.6 times in additional examples. In one example, the MECGy is at least 90 mm, and at least 95 mm, 100 mm, 105 mm, and 110 mm in additional examples. Similar to FICG, the MECG of the mass element 159 has a coordinate on the x-axis of the head origin coordinate system 185, abbreviated MECGx, and a ME Z-up value for the mass element 159 that is the vertical distance along a z-axis from the ground plane 181 to the MECG. In one example ME Z-up is no more than 50% of Z-up, and no more than 35%, 30%, 25%, 20%, and 15% in further examples. In a further example, ME Z-up is less than FI Z-up, while in an alternative example ME Z-up is equal to, or greater than, FI Z-up. In one example, the differential between ME Z-up and FI Z-up is no more than 50% of Z-up, and no more than 45%, 40%, 35%, 30%, 25%, 20%, and 15% in additional example. In an example, ME Z-up is no more than 20 mm, and no more than 15 mm, 12.5 mm, 10 mm, and 7.5 mm in further examples. The mass element 159 and the forward insert 200 can be located low to the ground plane 181, when the golf club head 100 is in the proper address position on the ground plane 181, such that a first distance H1 between the FICG of the forward insert 200 and the ground plane 181 is between 2 mm and 20 mm, and a second distance H2 between the MECG of the mass element 159 and the ground plane 181 is between 2 mm and 20 mm.

Similar to FICG and MECG, a center-of-gravity CCCG of the continuous collar 104 has a coordinate on the y-axis of the head origin coordinate system 185, abbreviated CCCGy, a coordinate on the x-axis of the head origin coordinate system 185, abbreviated CCCGx, and a CC Z-up value for the continuous collar 104 that is the vertical distance along a z-axis from the ground plane 181 to the CCCG. In an example the absolute value of CCCGx is at least twice the absolute value of CGx, and is at least three times, four times, and five times in further examples. In a further example CCCGx is at least 2 mm greater than CGx, and at least 3 mm, 4 mm, 5 mm, 6 mm, 7 mm, and 8 mm in additional examples. In a further series of examples CCCGx is no more than 30 mm greater than CGx, and no more than 25 mm greater, 22 mm, 19 mm, 16 mm, and 13 mm in further examples. In one example CC Z-up is greater than Z-up, and in another example CC Z-up is at least 5% greater than Z-up, and at least 10% and 15% greater in further example. In a further series of examples CC Z-up is no more than 1.5 times Z-up, and no more than 1.4 times, 1.3 times, and 1.2 times in additional examples. In an example CCCGy is greater than FICGy, and CCCGy is less than CGy. In a further example CCCGy is at least 10% greater than FICGy, and at least 20% greater, 30% greater, 40% greater, and 50% greater in additional examples. Conversely, in another series of examples CCCGy is no more than 80% of CGy, and no more than 70%, 60%, 50%, and 40% in further examples.

Similar to FICG, MECG, and CCCG, a center-of-gravity RCG of the ring 106 has a coordinate on the y-axis of the head origin coordinate system 185, abbreviated RCGy, a coordinate on the x-axis of the head origin coordinate system 185, abbreviated RCGx, and a R Z-up value for the ring 106 that is the vertical distance along a z-axis from the ground plane 181 to the RCG. In one example RCGy is at least 50% greater than CGy, and in further examples it is at least 60% greater, 70% greater, 80% greater, and 90% greater. In another example RCGy is at least 70% of the maximum club head depth Dch, and at least 75%, 80%, and 85% in further examples. The R Z-up is at least 1.5 times ME Z-up and/or FI Z-up in an example, and at least 1.75 times, 2.0 times, 2.25 times, and 2.5 times in further examples. Nonetheless, R Z-up is no more than 1.5 times Z-up and/or CC Z-up in an example, and no more than 1.3 times, 1.1 times, 0.9 times, and 0.8 times in further examples. However, in another series of examples R Z-up is at least 50% of Z-up and/or CC Z-up, and at least 60%, 70%, and 80% in additional examples. In an example RCGx is within 15 mm of MECGx, and within 12.5 mm, 10.0 mm, 7.5 mm, 5.0 mm, and 2.5 mm in further examples. Still further, the absolute value of FICGx is at least twice the absolute value of RCGx and/or MECGx, and is at least three times, four times, and five times in further examples. In a further example the absolute value of RCGx, and/or the absolute value of MECGx, is within 20 mm of the absolute value of CGx, and within 17.5 mm, 15 mm, 12.5 mm, 10 mm, 7.5 mm, and 5 mm in further examples. A height (HR) of the lowest surface of the ring 106 above the ground plane 181, in a vertical direction when the golf club head 100 is in the address position, is less than 40% of Z-up, and in further examples less than 35%, 30%, 25%, and 20%. In still another example the height (HR) is less than 2 times ME Z-up, and less than 1.75 times, 1.5 times, 1.25 times, 1.0 times, 0.8 times, and 0.6 times in further examples.

The ring 106 has a ring mass that is no more than twice the mass of the mass element 159, also referred to as the mass element mass, while in a further example the ring mass is no more than 1.75 times the mass element mass, and no more than 1.5 times, 1.25 times, and 1.0 times in further examples. Further, in another example the ring mass that is no more than 1.5 times the mass of the strike plate 143, also referred to as the strike plate mass, while in a further example the ring mass is no more than 1.25 times the strike plate mass, and no more than 1.15 times, 1.05 times, and 0.95 times in further examples. In an even further example the ring mass is no more than 1.5 times the mass of the forward insert 200, also referred to as the forward insert mass, while in a further example the ring mass is no more than 1.25 times the forward insert mass, and no more than 1.0 times, 0.90 times, 0.80 times, and 0.70 times in further examples. Placement of the ring 106 is essential in providing the desired aerodynamic properties of the club head 100, balanced with the positioning of the mass element 159, while insuring durability of the club head 100. In one example at least 50% of the ring mass is located at an elevation above Z-up, and at least 55%, 60%, and 65% in further examples. At least 30% of the ring mass is located at an elevation above the elevation of center face 183 in another example, and at least 35%, 40%, and 45% in still further examples. Additionally, in another example at least 45% of the ring mass is located in the rearwardmost 25% of the maximum club head depth Dch, while in further examples at least 50%, 55%, 60%, and/or 65% of the ring mass is located in the rearwardmost 25% of the maximum club head depth Dch. In still another example at least 35% of the ring mass is located in the rearwardmost 20% of the maximum club head depth Dch, while in further examples at least 40%, 45%, 50%, and/or 55% of the ring mass is located in the rearwardmost 20% of the maximum club head depth Dch. While in yet another example at least 25% of the ring mass is located in the rearwardmost 15% of the maximum club head depth Dch, while in further examples at least 30%, 35%, 40%, and/or 45% of the ring mass is located in the rearwardmost 15% of the maximum club head depth Dch. The lowest surface of the ring 106 above the ground plane 181 is located within the rearwardmost 25% of the maximum club head depth Dch in one example, and within the rearwardmost 20%, 15%, and/or 10% in still further examples.

In certain examples, the sole portion 117 of the golf club head 100 includes an inertia generating feature 177 that is elongated in a lengthwise direction. The lengthwise direction is perpendicular or oblique to the strike face 145. According to some examples, the inertia generating feature 177 includes the same features and provides the same advantages as the inertia generator disclosed in U.S. patent application Ser. No. 16/660,561, filed Oct. 22, 2019, which is incorporated herein by reference in its entirety. In the illustrated examples, the sole insert 110 forms at least a portion of the inertia generating feature 177. More specifically, in some examples, the sole insert 110 forms all or a majority of the inertia generating feature 177. The cantilevered portion 161 of the ring 106 also forms part, such as a rearmost part, of the inertia generating feature 177 in certain examples. The inertia generating feature 177 helps to increase the inertia of the golf club head 100 and lower the center-of-gravity (CG) of the golf club head 100.

The inertia generating feature 177 includes a raised or elevate platform that extends from a location rearwardly of the hosel 120 to a location proximate the rearward portion 118 of the golf club head 100. The inertia generating feature 177 includes a substantially flat or planar surface that is raised above (or protrudes from, depending on the orientation of the golf club head 100) the surrounding external surface of the sole portion 117. In certain examples, at least a portion of the inertia generating feature 177 is raised above the surrounding external surface of the sole portion 117 by at least 1.5 mm, at least 1.8 mm, at least 2.1 mm, or at least 3.0 mm. The inertia generating feature 177 also has a width that is less than an entire width (e.g., less than half the entire width) of the sole portion 117. In view of the foregoing, the inertia generating feature 177 has a complex curved geometry with multiple inflection points. Accordingly, the sole insert 110, which defines the inertia generating feature 177, has a complex curved surface that has multiple inflection points.

The CT properties of the golf club head 100 can be defined as CT values within a central region of the strike face 145. The central region, is forty millimeter by twenty millimeter rectangular area centered on a center of the strike face and elongated in a heel-to-toe direction. The center of the strike face 145 can be a geometric center of the strike face 145 in some examples. Within the central region, the strike face 145 has a characteristic time (CT) of no more than 257 microseconds. In some examples, the CT of at least 60% of the strike face, within the central region, is at least 235 microseconds. According to some examples, the CT of at least 35% of the strike face, within the central region, is at least 240 microseconds.

The CT of the strike face 145, at the geometric center of the strike face, has an initial CT value. The initial CT value is the CT value of the strike face 145 before any impacts with a standard golf ball. As defined herein, an impact with the standard golf ball is an impact of the standard golf ball when the golf ball is traveling at a velocity of 52 meters per second. According to some examples, the initial CT value is at least 244 microseconds. In certain examples, the driver-type golf club heads disclosed herein, including the golf club head 100, are configured such that after 500 impacts of a standard golf ball at the geometric center of the strike face 145, the CT of the strike face at any point within the central region is less than 256 microseconds and the CT at the geometric center of the strike face is no more than five microseconds different than (e.g., greater than) the initial CT value.

In certain examples, the golf club head 100 disclosed herein is configured such that after 1,000, 1,500, 2,000, 2,500, or 3,000 impacts of the standard golf ball at the geometric center of the strike face, the CT of the strike face at any point within the central region is less than 256 microseconds. According to some examples, after 2,000 impacts of the standard golf ball at the geometric center of the strike face, the CT of the strike face 145 at any point within the central region is no more than seven microseconds or nine microseconds different that the initial CT value. Moreover, in certain examples, after 2,000 impacts of the standard golf ball at the geometric center of the strike face, the CT of the strike face 145 at the geometric center of the strike face is no less than 249 microseconds and no more than ten microseconds different than the initial CT value. According to some examples, after 3,000 impacts of the standard golf ball at the geometric center of the strike face, the CT of the strike face 145 at any point within the central region is no more than nine microseconds or thirteen microseconds different that the initial CT value. In certain examples, such as those where the strike face 145 is made of a metallic material, an inward face progression of the strike face 145 is less than 0.01 inches after 500 impacts of the standard golf ball at the geometric center of the strike face.

The golf club head 100 has a volume, equal to the volumetric displacement of the golf club head, that is between 390 cubic centimeters ($cm^3$ or cc) and about 600 $cm^3$. In more particular examples, the volume of the golf club head 100 is between about 350 $cm^3$ and about 500 $cm^3$ or between about 420 $cm^3$ and about 500 $cm^3$. The total mass of the golf club head 100 is between about 145 g and about 245 g, in some examples, and between 185 g and 210 g in other examples.

As previously mentioned, the golf club head 100 has a multi-piece construction. For example, the continuous collar 104, the ring 106, the forward insert 200, the strike plate 143, the crown insert 108, and the sole insert 110 each comprises one piece of the multi-piece construction. Because each piece of the multi-piece construction is separately formed and attached together, each piece can be made of a material different than at least one other of the pieces or made by a process that is different than the process used to make at least one other of the pieces. Such a multi-material construction allows for flexibility of the material composition, and thus the mass composition and distribution, of the golf club head 100.

According to some examples, the golf club head 100 is made from at least one first material, having a density between 0.9 g/cc and 3.5 g/cc, at least one second material, having a density between 3.6 g/cc and 5.5 g/cc, and at least one third material, having a density between 5.6 g/cc and 20.0 g/cc. In a first example, the continuous collar 104 is made of the second material or a first type of the third material, the forward insert 200 is made of a second type of the third material, the ring 106 is made of the second material, and the crown insert 108, the sole insert 110, and the strike plate 143 are made of the first material. In this first example, according to one instance, the continuous collar 104 is made of a titanium alloy or a steel alloy, the forward insert 200 is made of steel or a tungsten alloy, the ring 106 is made of a titanium alloy, plastic, or an aluminum alloy, and the crown insert 108 and the sole insert 110 are made of a fiber-reinforced polymeric material. In some alternative examples, the continuous collar 104 is made of a fiber reinforced polymeric material, a polymer, or aluminum.

According to some examples, the at least one first material has a first mass no more than 55% of the total mass of the golf club head 100 and no less than 25% of the total mass of the golf club head 100 (e.g., between 50 g and 110 g). In certain examples, the first mass of the at least one first material is no more than 45% of the total mass of the golf club head 100 and no less than 30% of the total mass of the golf club head 100. The first mass of the at least one first material can be greater than the second mass of the at least one second material. Alternatively, or additionally, the first mass of the at least one first material can be within 10 g of the second mass of the at least one second material.

In some examples, the at least one second material has a second mass no more than 65% of the total mass of the golf club head 100 and no less than 20% of the total mass of the golf club head 100 (e.g., between 40 g and 130 g). According to certain examples, the second mass of the at least one second material is no more than 50% of the total mass of the golf club head 100. The second mass of the at least one second material is less than two times the first mass of the at least one first material in certain examples. The second mass of the at least one second material is between 0.9 times and 1.8 times the first mass of the at least one first material in some examples. In one example, the second mass of the at least one second material is less than 0.9 times, or less than 1.8 times, the first mass of the at least one first material.

The at least one third material has a third mass equal to the total mass of the golf club head 100 less the first mass of the at least one first material and the second mass of the at least one second material. In one example, the third mass of the at least one third material is no less than 5% of the total mass of the golf club head 100 and no more than 50% of the total mass of the golf club head 100 (e.g., between 10 g and 100 g). According to another example, the third mass of the at least one third material is no less than 10% of the total mass of the golf club head 100 and no more than 20% of the total mass of the golf club head 100.

According to one example, the continuous collar 104 of the body 102 of the golf club head 100 is made from the at least one first material and the at least one first material is a first metal material that has a density between 4.0 g/cc and 8.0 g/cc. In this example, the forward insert 200 is made from a material that has a density greater than the material of the continuous collar 104, such as a material having a density greater than 8.0 g/cc, and the ring 106 of the body 102 of the golf club head 100 is made of a material that has a density between 0.5 g/cc and 4.0 g/cc. According to certain implementations, the first metal material of the continuous collar 104 is a titanium alloy and/or a steel alloy, the material of the forward insert 200 is a steel alloy and/or a tungsten alloy, and the material of the ring 106 is an aluminum alloy and/or a magnesium alloy. In some implementations, the first metal material of the continuous collar 104 is a titanium alloy and/or a steel alloy and the material of the ring 106 is a non-metal material, such as a plastic or polymeric material. Accordingly, in some examples, the ring 106 is made of any of various materials, such as titanium alloys, aluminum alloys, and fiber-reinforced polymeric materials.

The ring 106, in some examples, is made of one of 6000-series, 7000-series, or 8000-series aluminum, which can be anodized to have a particular color the same as or different than the continuous collar 104. According to some examples, the ring 106 can be anodized to have any one of an array of colors, including blue, red, orange, green, purple, etc. Contrasting colors between the ring 106 and the continuous collar 104 may help with alignment or suit a user's preferences. In one example, the ring 106 is made of 7075 aluminum. According to some examples, the ring 106 is made of a fiber-reinforced polycarbonate material. The ring 106 can be made from a plastic with a non-conductive vacuum metallizing coating, which may also have any of various colors. Accordingly, in certain examples, the ring 106 is made of a titanium alloy, a steel alloy, a boron-infused steel alloy, a copper alloy, a beryllium alloy, composite material, hard plastic, resilient elastomeric material, carbon-fiber reinforced thermoplastic with short or long fibers. The ring 106 can be made via an injection molded, cast molded, physical vapor deposition, or CNC milled technique.

As described herein, the ring 106 can comprise various different materials and features, and be made of different materials and have different properties than the continuous collar 104 and the forward insert 200, which is formed separately and later coupled to the ring 106. In addition to or alternative to other materials described herein, the ring 106 can comprise metallic materials, polymeric materials, and/or composite materials, and can include various external coatings.

In some examples, the ring 106 comprises anodized aluminum, such as 6000, 7000, and 8000 series aluminum. In one specific example, the ring comprises 7075 grade aluminum. The anodized aluminum can be colored, such as red, green, blue, gray, white, orange, purple, pink, fuchsia, black, clear, yellow, gold, silver, or metallic colors. In some examples, the ring can have a color that contrasts from a majority color located on other parts of the club head (e.g., the crown insert, the sole insert, the cup, the rear weight, etc.).

In some examples, the ring 106 can comprise any combination of metals, metal alloys (e.g., Ti alloys, steel, boron infused steel, aluminum, copper, beryllium), composite materials (e.g., carbon fiber reinforced polymer, with short or long fibers), hard plastics, resilient elastomers, other polymeric materials, and/or other suitable materials. Any material selection for the ring can also be combined with any of various formation methods, such as any combination of the following: casting, injection molding, sintering, machining, milling, forging, extruding, stamping, and rolling.

A plastic ring (fiber reinforced polycarbonate ring) may offer both mass savings e.g. about 5 grams compared to an aluminum ring, cost savings as well, give greater design flexibility due to processes used to form the ring e.g. injection molded thermoplastic, and perform similarly to an aluminum ring in abuse testing e.g. slamming the club head into a concrete cart path (extreme abuse) or shaking it in a bag where other metal clubs can repeatedly impact it (normal abuse).

In some examples, the ring 106 can comprise a polymeric material (e.g., plastic) with a non-conductive vacuum metallizing (NCVM) coating. For example, in some examples, the ring may include a primer layer having an average thickness of about 5-11 micrometers (μm) or about 8.5 μm, and under coating layer on top of the primer layer having an average thickness of about 5-11 μm or about 8.5 μm, a NCVM layer on top of under coating layer having an average thickness of about 1.1-3.5 μm or about 2.5 μm, a color coating layer on top of the NCVM layer having an average thickness of about 25-35 μm or about 29 μm, and a top coating (UV protection coat) outer layer on top of the color coating layer having an average thickness of about 20-35 μm or about 26 μm. In general, for a NCVM coated part or ring the NCVM layer will be the thinnest and the color coating layer and the top coating layers will be the thickest and generally about 8-15 times thicker than NCVM layer. Generally, all the layers will combine to have a total average thickness of about 60-90 μm or about 75 μm. The described layers and NCVM coating could be applied to other parts other than the ring, such as the crown, sole, forward cup, and removable weights, and it can be applied prior to assembly.

In some examples, the ring 106 can comprise a physical vapor deposition (PVD) coating or film layer. In some examples, the ring 106 can include a paint layer, or other outer coloring layer. Conventionally, painting a golf club head is all done by hand and requires masking various components to prevent unwanted spray on unwanted surfaces. Hand painting, however, can lead to great inconsistency from club to club. Separately forming the ring 106 not only allows for greater access to the rearward portion of the face for milling operations to remove unwanted alpha case and allows for machining in various face patterns, but it also eliminates the need for masking off various components. The ring 106 can be painted in isolation prior to assembly. Or in the case of anodized aluminum, no painting may be necessary, eliminating a step in the process such that the ring 106 can simply be bonded or attached to the continuous collar 104, which may also be fully finished. Similarly if the ring 106 is coated using PVD or NCVM, this coating can be applied to the ring 106 prior to assembly, again eliminating several steps. This also allows for attachment of various color rings that may be selectable by an end user to provide an alignment or aesthetic benefit to the user. Whether the ring 106 is a NCVM coated ring or a PVD coated ring, as mentioned above, it can be colored an array of colors, such as red, green, blue, gray, white, orange, purple, pink, fuchsia, black, clear, yellow, gold, silver, or metallic colors.

In some examples, the at least one first material is a fiber-reinforced polymeric material that includes continuous fibers embedded in a polymeric matrix (e.g., epoxy or resin), which is a thermoset polymer is certain examples. The continuous fibers are considered continuous because each one of the fibers is continuous across a length, width, or diagonal of the part formed by the fiber-reinforced polymeric material. The continuous fibers can be long fibers having a length of at least 3 millimeters, 10 millimeters, or even 50 millimeters. In other examples, shorter fibers can be used having a length of between 0.5 and 2.0 millimeters. Incorporation of the fiber reinforcement increases the tensile strength, however it may also reduce elongation to break therefore a careful balance can be struck to maintain sufficient elongation. Therefore, one example includes 35-55% long fiber reinforcement, while in an even further example has 40-50% long fiber reinforcement. The continuous fibers, as well as the fiber-reinforced polymeric material in general, can be the same or similar to that described in Paragraph 295 of U.S. Patent Application Publication No. 2016/0184662, published Jun. 30, 2016, now U.S. Pat. No. 9,468,816, issued Oct. 18, 2016, which is incorporated herein by reference in its entirety. In several examples, the crown insert 108 and the sole insert 110 are made of the fiber-reinforced polymeric material. Accordingly, in some examples, each one of the continuous fibers of the fiber-reinforced polymeric material does not extend from the crown portion 119 to the sole portion 117 of the golf club head 100. Alternatively, or additionally, in certain examples, each one of the continuous fibers of the fiber-reinforced polymeric material does not extend from the crown portion 119 to the forward portion 112 of the golf club head 100. The crown insert 108 is made of a material that has a density between 0.5 g/cc and 4.0 g/cc in one example. The sole insert 110 is made of a material that has a density between 0.5 g/cc and 4.0 g/cc in one example.

In certain examples, the first material is a fiber-reinforced polymeric material as described in U.S. patent application Ser. No. 17/006,561, filed Aug. 28, 2020. Composite materials that are useful for making club-head components comprise a fiber portion and a resin portion. In general the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers for a striking face is substantial, e.g., forty or more. However for a sole or crown, the number of layers can be substantially decreased to, e.g., three or more, four or more, five or more, six or more, examples of which will be provided below. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition. If interested a specific strength may be calculated by dividing the tensile strength by the density of the material. This is also known as the strength-to-weight ratio or strength/weight ratio.

In tests involving certain club-head configurations, composite portions formed of prepreg plies having a relatively low fiber areal weight (FAW) have been found to provide superior attributes in several areas, such as impact resistance, durability, and overall club performance. FAW is the weight of the fiber portion of a given quantity of prepreg, in units of $g/m^2$. FAW values below 100 $g/m^2$, and more desirably below 70 $g/m^2$, can be particularly effective. A particularly suitable fibrous material for use in making prepreg plies is carbon fiber, as noted. More than one fibrous material can be used. In other examples, however, prepreg plies having FAW values below 70 $g/m^2$ and above 100 $g/m^2$ may be used. Generally, cost is the primary prohibitive factor in prepreg plies having FAW values below 70 $g/m^2$.

In particular examples, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement. The prepreg plies used to form the panels desirably comprise carbon fibers impregnated with a suitable resin, such as epoxy.

Figure 27:
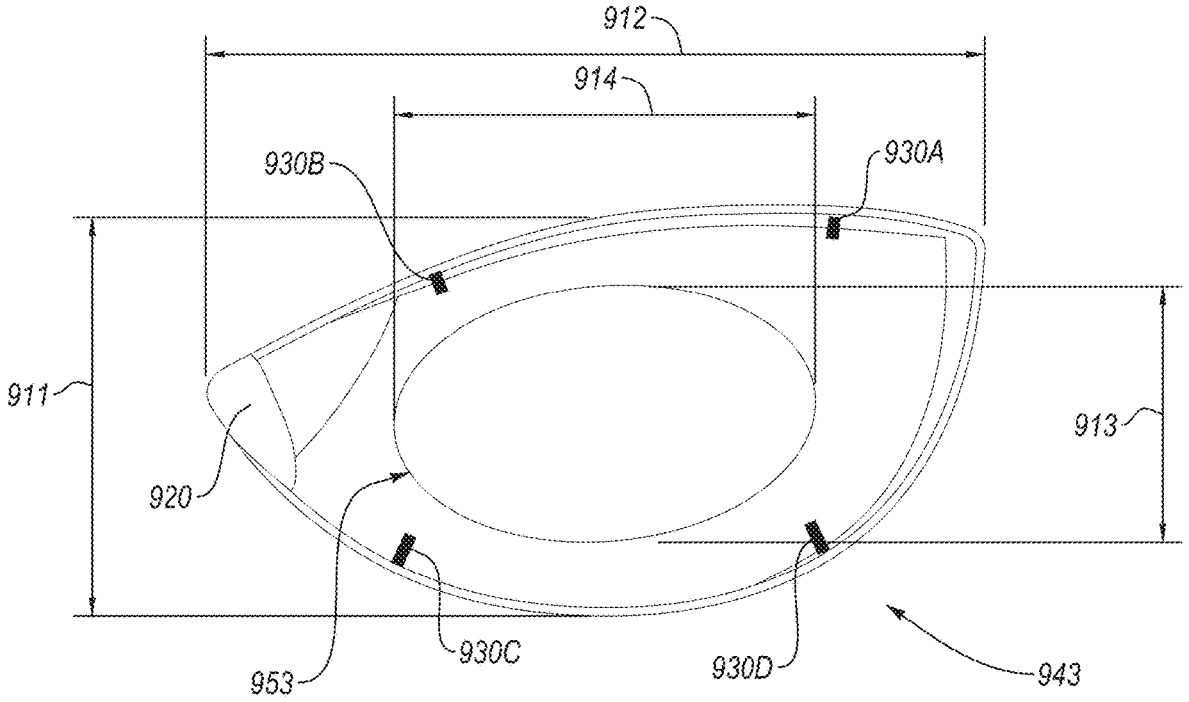
FIG. 27 is a schematic, front elevation view of a strike plate of a golf club head, according to one or more examples of the present disclosure.

FIG. 27 is a front elevation view of a strike plate 943, which is one example of the strike plate 143. The strike plate 943 is made of composite materials, and can be termed a composite strike plate in some examples. The non-metal or composite material of the strike plate 943 comprises a fiber-reinforced polymer comprising fibers embedded in a resin. A percent composition of the resin in the fiber-reinforced polymer is between 38% and 44%. Further details concerning the construction and manufacturing processes for the composite strike plate 943 are described in U.S. Pat. No. 7,871,340 and U.S. Published Patent Application Nos. 2011/0275451, 2012/0083361, and 2012/0199282, which are incorporated herein by reference. The composite strike plate 943 is attached to an insert support structure located at the opening at the front portion of a golf club head, such as one disclosed herein.

In some examples, the strike plate 943 can be machined from a composite plaque. In an example, the composite plaque can be substantially rectangular with a length between about 90 mm and about 130 mm or between about 100 mm and about 120 mm, preferably about 110 mm±1.0 mm, and a width between about 50 mm and about 90 mm or between about 6 mm and about 80 mm, preferably about 70 mm±1.0 mm plaque size and dimensions. The strike plate 943 is then machined from the plaque to create a desired face profile. For example, the face profile length 912 can be between about 80 mm and about 120 mm or between about 90 mm and about 110 mm, preferably about 102 mm. The face profile width 911 can be between about 40 mm and about 65 mm or between about 45 mm and about 60 mm, preferably about 53 mm. The height 913 of a preferred impact zone 953 on the strike face, defined by the strike plate 943 and centered on a geometric center of the strike face, can be between about 25 mm and about 50 mm, between about 30 mm and about 40 mm, or between about 17 mm and about 45 mm, such as preferably about 34 mm. The length 914 of the preferred impact zone 953 can be between about 40 mm and about 70 mm, between about 28 mm and about 65 mm, or between about 45 mm and about 65 mm, preferably about 55.5 mm or 56 mm. In certain examples, the preferred impact zone 953 of the strike face defined by the strike plate 943 has an area between 500 $mm^2$ and 1,800 $mm^2$. Alternatively, the strike plate 943 can be molded to provide the desired face dimensions and profile.

Figure 28:
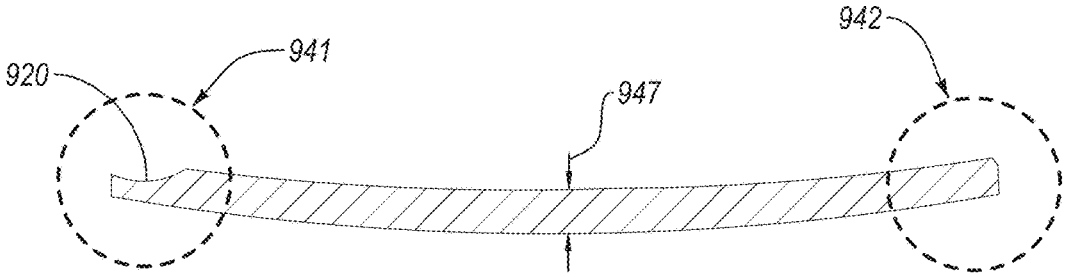
FIG. 28 is a schematic, bottom view of a strike plate of a golf club head, according to one or more examples of the present disclosure.

Additional features can be machined or molded into face the strike plate 943 to create the desired face profile. For example, as shown in FIG. 28, a notch 920 can be machined or molded into the backside of a heel portion of the strike plate 943. The notch 920 in the back of the strike plate 943 allows for the golf club head to utilize flight control technology (FCT) in the hosel, in some examples. The notch 920 can be configured to accept at least a portion of the hosel within the strike plate 943. Alternatively or additionally, the notch 920 can be configured to accept at least a portion of the club head body within the strike plate 943. The notch may allow for the reduction of center-face y-axis location (CFY) by accommodating at least a portion of the hosel and/or at least a portion of the club body within the strike plate 943, allowing the preferred impact zone 953 of the strike plate 943 to be closer to a plane passing through a center point location of the hosel. The strike plate 943 can be configured to provide a CFY no more than about 18 mm and no less than about 9 mm, preferably between about 11.0 mm and about 16.0 mm, and more preferably no more than about 15.5 mm and no less than about 11.5 mm. The strike plate 943 can be configured to provide face progression no more than about 21 mm and no less than about 12 mm, preferably no more than about 19.5 mm and no less than about 13 mm and more preferably no more than about 18 mm and no less than about 14.5 mm. In some examples, a difference between CFY and face progression is at least 3 mm and no more than 12 mm.

In another example, backside bumps 930A, 930B, 930C, 930D may be machined or molded into the backside of the strike plate 943. The backside bumps 930A, 930B, 930C, 930D can be configured to provide for a bond gap. A bond gap is an empty space between the club head body and the strike plate 943 that is filled with adhesive during manufacturing. The backside bumps 930A, 930B, 930C, 930D protrude to separate the face from the club head body when bonding the strike plate 943 to the club head body during manufacturing. In some examples, too large or too small of a bond gap may lead to durability issues of the club head, the strike plate 943, or both. Further, too large of a bond gap can allow too much adhesive to be used during manufacturing, adding unwanted additional mass to the club head. The backside bumps 930A, 930B, 930C, 930D can protrude between about 0.1 mm and 0.5 mm, preferably about 0.25 mm. In some examples, the backside bumps are configured to provide for a minimum bond gap, such as a minimum bond gap of about 0.25 mm and a maximum bond gap of about 0.45 mm.

Further, one or more of the edges of the strike plate 943 can be machined or molded with a chamfer. In an example, the strike plate 943 includes a chamfer substantially around the inside perimeter edge of the strike plate 943, such as a chamfer between about 0.5 mm and about 1.1 mm, preferably 0.8 mm.

Figure 8:
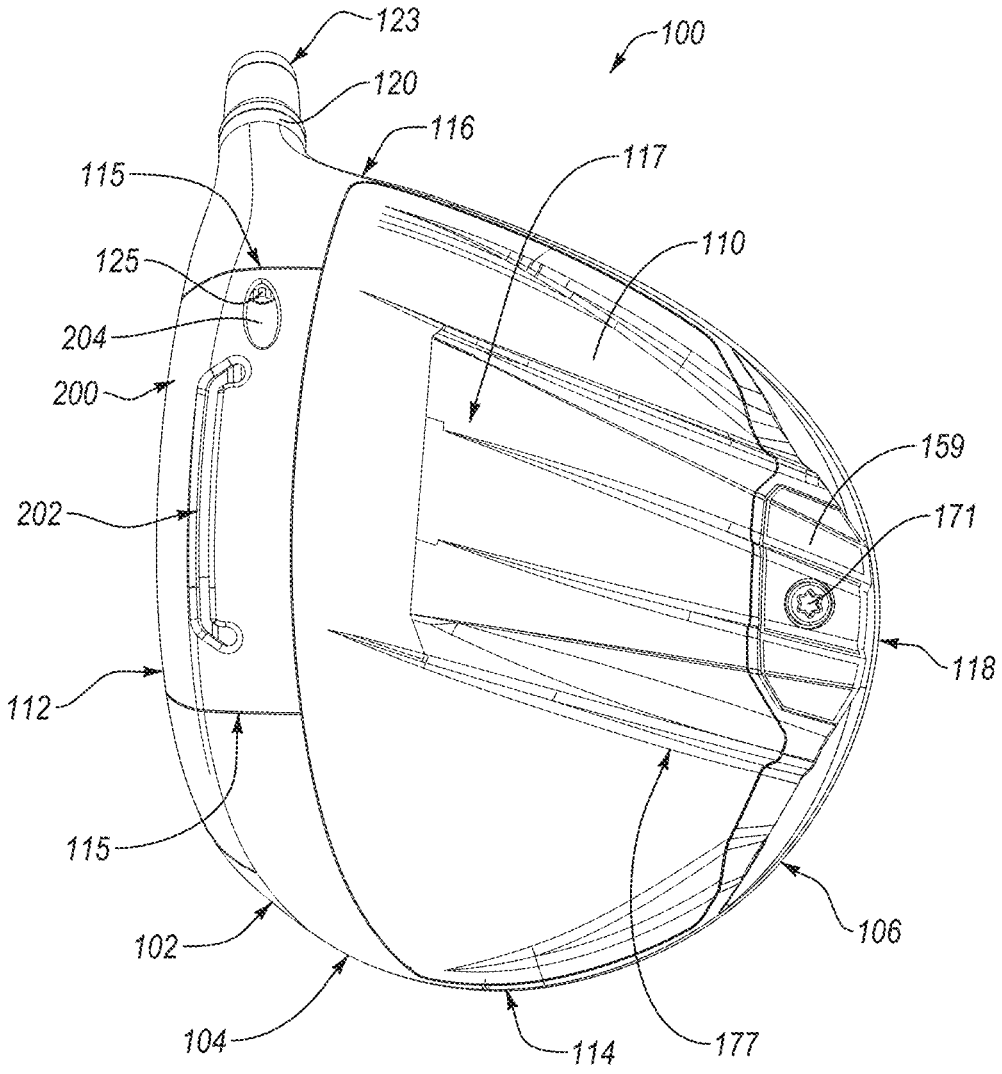
FIG. 8 is a schematic, bottom plan view of the golf club head of FIG. 1, according to one or more examples of the present disclosure.

FIG. 8 is a is a bottom perspective view of the strike plate 943. The strike plate 943 has a heel portion 941 and a toe portion 942. The notch 920 is machined or molded into the heel portion 941. In this example, the strike plate 943 has a variable thickness, such as with a peak thickness 947 within the preferred impact zone 953. The peak thickness 947 can be between about 2 mm and about 7.5 mm, between about 4.3 mm and 5.15 mm, between about 4.0 mm and about 5.15 or 5.5 mm, or between about 3.8 mm and about 4.8 mm, preferably 4.1 mm±0.1 mm, 4.25 mm±0.1 mm, or 4.5 mm±0.1 mm. The peak thickness 947 can be located at the geometric center of the strike face defines by the strike plate 943. A minimum thickness of the strike plate 943 is between 3.0 mm and 4.0 mm in some examples.

Additionally, in certain examples, the preferred impact zone 953 is off-center or offset relative to the geometric center of the strike face, and can be thicker toeward of the geometric center of the strike face. In some examples, the thickness of the strike plate 943 within the preferred impact zone 953 is variable (e.g., between about 3.5 mm and about 5.0 mm) and the thickness of the strike plate 943 outside of the preferred impact zone 953 is constant (e.g., between 3.5 mm and 4.2 mm) and less than within preferred impact zone 953. In some examples, the strike plate 943 have a thickness between 3.5 mm and 6.0 mm.

The strike plate 943 has a toe edge region and a heel edge region outside of the preferred impact zone 953 such that the preferred impact zone is between the toe edge region and the heel edge region. The toe edge region is closer to the toe portion than the heel edge region. The heel edge region is closer to the heel portion than the toe edge region. The toe edge region thickness is less than the maximum thickness. A thickness of the strike plate 943 transitions from the maximum thickness, within the preferred impact zone 953, to a toe edge region thickness, within the toe edge region, between 3.85 mm and 4.5 mm.

In some examples, the strike plate 943 is manufactured from multiple layers of composite materials. Exemplary composite materials and methods for making the same are described in U.S. patent application Ser. No. 13/452,370 (published as U.S. Pat. App. Pub. No. 2012/0199282), which is incorporated by reference. In some examples, an inner and outer surface of the composite face can include a scrim layer, such as to reinforce the strike plate 943 with glass fibers making up a scrim weave. Multiple quasi-isotropic panels (Q's) can also be included, with each Q panel using multiple plies of unidirectional composite panels offset from each other. In an exemplary four-ply Q panel, the unidirectional composite panels are oriented at 90°, −45°, 0°, and 45°, which provide for structural stability in each direction. Clusters of unidirectional strips (C's) can also be included, with each C using multiple unidirectional composite strips. In an exemplary four-strip C, four 27 mm strips are oriented at 0°, 125°, 90°, and 55°. C's can be provided to increase thickness of the strike plate 943 in a localized area, such as in the center face at the preferred impact zone. Some Q's and C's can have additional or fewer plies (e.g., three-ply rather than four-ply), such as to fine tune the thickness, mass, localized thickness, and provide for other properties of the strike plate 943, such as to increase or decrease COR of the strike plate 943.

In some examples, the strike plate 143 is manufactured from multiple layers of composite materials. Exemplary composite materials and methods for making the same are described in U.S. patent application Ser. No. 13/452,370 (published as U.S. Pat. App. Pub. No. 2012/0199282), which is incorporated by reference. In some examples, an inner and outer surface of the composite face can include a scrim layer, such as to reinforce the strike face with glass fibers making up a scrim weave. Multiple quasi-isotropic panels (Q's) can also be included, with each Q panel using multiple plies of unidirectional composite panels offset from each other. In an exemplary four-ply Q panel, the unidirectional composite panels are oriented at 90°, −45°, 0°, and 45°, which provide for structural stability in each direction. Clusters of unidirectional strips (C's) can also be included, with each C using multiple unidirectional composite strips. In an exemplary four-strip C, four 27 mm strips are oriented at 0°, 125°, 90°, and 55°. C's can be provided to increase thickness of the strike face, or other composite features, in a localized area, such as in the center face at the preferred impact zone. Some Q's and C's can have additional or fewer plies (e.g., three-ply rather than four-ply), such as to fine tune the thickness, mass, localized thickness, and provide for other properties of the strike face, such as to increase or decrease COR of the strike face.

Additional composite materials and methods for making the same are described in U.S. Pat. Nos. 8,163,119 and 10,046,212, which is incorporated by reference. For example, the usual number of layers for a strike plate is substantial, e.g., fifty or more. However, improvements have been made in the art such that the layers may be decreased to between 30 and 50 layers.

Table 1 below provide examples of possible layups of one or more of the composite parts of the golf club head disclosed herein. These layups show possible unidirectional plies unless noted as woven plies. The construction shown is for a quasi-isotropic layup. A single layer ply has a thickness of ranging from about 0.065 mm to about 0.080 mm for a standard FAW of 70 gsm with about 36% to about 40% resin content. The thickness of each individual ply may be altered by adjusting either the FAW or the resin content, and therefore the thickness of the entire layup may be altered by adjusting these parameters.

TABLE 1

| ply 1 | ply 2 | ply 3 | ply 4 | ply 5 | ply 6 | ply 7 | ply 8 | AW g/m$^2$ |
|---|---|---|---|---|---|---|---|---|
| 0 | −60 | +60 | | | | | | 290-360 |
| 0 | −45 | +45 | 90 | | | | | 390-480 |
| 0 | +60 | 90 | −60 | 0 | | | | 490-600 |
| 0 | +45 | 90 | −45 | 0 | | | | 490-600 |
| 90 | +45 | 0 | −45 | 90 | | | | 490-600 |
| +45 | 90 | 0 | 90 | −45 | | | | 490-600 |
| +45 | 0 | 90 | 0 | −45 | | | | 490-600 |
| −60 | −30 | 0 | +30 | 60 | 90 | | | 590-720 |
| 0 | 90 | +45 | −45 | 90 | 0 | | | 590-720 |
| 90 | 0 | +45 | −45 | 0 | 90 | | | 590-720 |
| 0 | 90 | 45 | −45 | −45 | 45 | 0/90 woven | | 680-840 |
| 90 | 0 | 45 | −45 | −45 | 45 | 90/0 woven | | 680-840 |
| +45 | −45 | 90 | 0 | 0 | 90 | −45/45 woven | | 680-840 |
| 0 | 90 | 45 | −45 | −45 | 45 | 90 UD | | 680-840 |
| 0 | 90 | 45 | −45 | 0 | −45 | 45 | 0/90 woven | 780-960 780-960 |
| 90 | 0 | 45 | −45 | 0 | −45 | 45 | 90/0 woven | |

The Area Weight (AW) is calculated by multiplying the density times the thickness. For the plies shown above made from composite material the density is about 1.5 g/cm$^3$ and for titanium the density is about 4.5 g/cm$^3$.

The strike plate 143 may have a peak thickness that varies between about 3.8 mm and 5.15 mm, in some examples. The strike plate 143 can be formed from multiple composite plies or layers. The number of layers of the strike plate 143 is substantial, e.g., forty or more, preferably between 30 to 75 plies, more preferably, 50 to 70 plies, even more preferably 55 to 65 plies.

In an example, the strike plate 143 can have a peak thickness of 4.1 mm and an edge thickness of 3.65 mm, including 12 Q's and 2 C's, resulting in a mass of 24.7 g. In another example, the strike plate 143 can have a peak thickness of 4.25 mm and an edge thickness of 3.8 mm, including 12 Q's and 2 C's, resulting in a mass of 25.6 g. The additional thickness and mass is provided by including additional plies in one or more of the Q's or C's, such as by using two 4-ply Q's instead of two 3-ply Q's. In yet another example, the strike plate 143 can have a peak thickness of 4.5 mm and an edge thickness of 3.9 mm, including 12 Q's and 3 C's, resulting in a mass of 26.2 g. Additional and different combinations of Q's and C's can be provided for the strike plate 143 with a mass between about 20 g and about 30 g, or between about 15 g and about 35 g. In some examples, the strike plate 143 has a total mass between 22 grams and 28 grams.

Figure 29A:
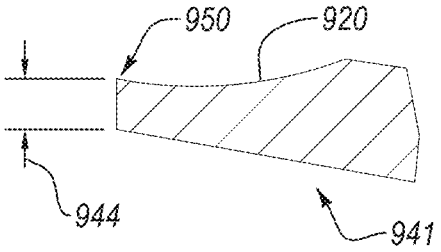
FIG. 29A is a schematic, bottom cross-sectional view of a heel portion of a strike plate of a golf club head, according to one or more examples of the present disclosure.

FIG. 29A is a section view of a heel portion 41 of the strike plate 943. The heel portion 941 can include a notch 920. In examples with a chamfer on an inside edge of the strike plate 943, no chamfer 950 is provided on the notch 920. The notch 920 can have a notch edge thickness 944 less than the edge thickness 945 of the face insert 110 (see, e.g., FIG. 29B). For example, the notch edge thickness 944 can be between 1.5 mm and 2.1 mm, preferably 1.8 mm.

Figure 29B:
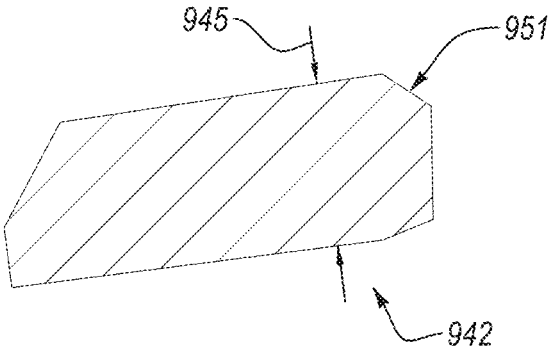
FIG. 29B a schematic, bottom cross-sectional view of a toe portion of a strike plate of a golf club head, according to one or more examples of the present disclosure.

FIG. 29B is a section view of a toe portion 942 of the strike plate 943. The toe portion 942 includes a chamfer 951 on the inside edge of the strike plate 943. In some examples, the edge thickness 945 can be between about 3.35 mm and about 4.2 mm, preferably 3.65 mm±0.1 mm, 3.8 mm±0.1 mm, or 3.9 mm±0.1 mm.

FIG. 30A is a section view of a polymer layer 900 of the strike plate 943. The polymer layer 900 can be provided on the outer surface of the strike plate 943 to provide for better performance of the strike plate 943, such as in wet conditions. Exemplary polymer layers are described in U.S. patent application Ser. No. 13/330,486 (patented as U.S. Pat. No. 8,979,669), which is incorporated by reference. The polymer layer 900 may include polyurethane and/or other polymer materials. The polymer layer may have a polymer maximum thickness 960 between about 0.2 mm and 0.7 mm or about 0.3 mm and about 0.5 mm, preferably 0.40 mm±0.05 mm. The polymer layer may have a polymer minimum thickness 970 between about 0.05 mm and 0.15 mm, preferably 0.09 mm±0.02 mm. The polymer layer can be configured with alternating maximum thicknesses 960 and minimum thicknesses 970 to create score lines on the strike plate 943. Further, in some examples, teeth and/or another texture may be provided on the thicker areas of the polymer layer 900 between the score lines.

In some examples, the crown insert 108 and the sole insert 110, are made of a carbon-fiber reinforced polymeric material. In one example, the crown insert is made of layers of unidirectional tape, woven cloth, and composite plies.

Referring to FIG. 4, the golf club head 100 has a face-back dimension (FBD) defined as the distance between a hypothetical plane 169, passing through the center face 183 of the strike face 145 and parallel to the strike face 145, and a rearmost point on the golf club head 100 in a face-back direction 165 perpendicular to the hypothetical plane 169. As defined herein, the center face 183 is located at 0% of the face-back dimension (FBD) and the rearmost point is located at 100% of the face-back dimension (FBD). Under this definition, the golf club head 100 can be divided into a face section that extends, in the face-back direction 165, from 0% of the face-back dimension (FBD) to 25% of the face-back dimension (FBD), a middle section that extends, in the face-back direction 165, from 25% to 75% of the face-back dimension (FBD), and a back section that extends, in the face-back direction 165, from 75% to 100% of the face-back dimension (FBD). According to some examples, at least 95% by weight of the middle section is made of a material having a density between 0.9 g/cc and 4.0 g/cc. In certain examples, at least 95% by weight of the middle section is made of material having a density between 0.9 g/cc and 2.0 g/cc. In some examples, at least 95% by weight of the middle section and at least 95% by weight of the back section are made of a material having a density between 0.9 g/cc and 2.0 g/cc, excluding any attached weights and any housings for the attached weights. No more than 20% by weight of the middle section and no more than 20% by weight of the back section are made of a material having a density between 4.0 g/cc and 20.0 g/cc, according to various examples.

In some examples, the golf club head 100 includes one or more of the following materials: carbon steel, stainless steel (e.g. 17-4 PH stainless steel), alloy steel, Fe—Mn—Al alloy, nickel-based ferroalloy, cast iron, super alloy steel, aluminum alloy (including but not limited to 3000 series alloys, 5000 series alloys, 6000 series alloys, such as 6061-T6, and 7000 series alloys, such as 7075), magnesium alloy, copper alloy, titanium alloy (including but not limited to 6-4 titanium, 3-2.5, 6-4, SP700, 15-3-3-3, 10-2-3, Ti 9-1-1, ZA 1300, or other alpha/near alpha, alpha-beta, and beta/near beta titanium alloys) or mixtures thereof.

In one example, when forming parts of the golf club head 100, such as when forming the continuous collar 104, the ring 106, and/or the strike plate 143, the titanium alloy is a 9-1-1 titanium alloy. Titanium alloys comprising aluminum (e.g., 8.5-9.5% Al), vanadium (e.g., 0.9-1.3% V), and molybdenum (e.g., 0.8-1.1% Mo), optionally with other minor alloying elements and impurities, herein collectively referred to a "9-1-1 Ti", can have less significant alpha case, which renders HF acid etching unnecessary or at least less necessary compared to faces made from conventional 6-4 Ti and other titanium alloys. Further, 9-1-1 Ti can have minimum mechanical properties of 820 MPa yield strength, 958 MPa tensile strength, and 10.2% elongation. These minimum properties can be significantly superior to typical cast titanium alloys, such as 6-4 Ti, which can have minimum mechanical properties of 812 MPa yield strength, 936 MPa tensile strength, and 6% elongation. In certain examples, the titanium alloy is 8-1-1 Ti.

In another example, when forming parts of the golf club heads disclosed herein, such as when forming the continuous collar 104, the ring 106, and/or the strike plate 143, the titanium alloy is an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" or "ZA1300" titanium alloy). The alpha-beta titanium alloy or ZA1300 titanium alloy has a first ultimate tensile strength of at least 1,000 MPa in some examples and at least 1,100 MPa in other examples. An ultimate tensile strength of the material forming the body 102, other than the strike face 145, can be less than the first ultimate tensile strength by at least 10%. In another representative example, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti. In yet another representative example, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti. In a further representative example, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti. In another representative example, the alloy may comprise 8% Al by weight, 2.5% Mo by weight, 2% Cr by weight, 1% V by weight, and/or 0.5% Fe by weight, with the balance comprising Ti (such titanium alloys can have the formula Ti-8Al-2.5Mo-2Cr-1V-0.5Fe). As used herein, reference to "Ti-8Al-2.5Mo-2Cr-1V-0.5Fe" refers to a titanium alloy including the referenced elements in any of the proportions given above. Certain examples may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some examples, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular examples, the Ti-8Al-2.5Mo-2Cr-1V-0.5Fe alloy can have a tensile strength of about 1320 MPa, a yield strength of about 1284 MPa, and an elongation of about 10%. The Ti-8Al-2.5Mo-2Cr-1V-0.5Fe alloy, particularly when used to cast golf club head bodies, promotes less deflection for the same thickness due to a higher ultimate tensile strength compared to other materials. In some implementations, providing less deflection with the same thickness benefits golfers with higher swing speeds because over time the face of the golf club head will maintain its original shape over time.

In yet certain examples, the golf club head 100 is made of a non-metal material with a density less than about 2 g/cm$^3$, such as between about 1 g/cm$^3$ to about 2 g/cm$^3$. The non-metal material may include a polymer, such as fiber-reinforced polymeric material. The polymer can be either thermoset or thermoplastic, and can be amorphous, crystalline and/or a semi-crystalline structure. The polymer may also be formed of an engineering plastic such as a crystalline or semi-crystalline engineering plastic or an amorphous engineering plastic. Potential engineering plastic candidates include polyphenylene sulfide ether (PPS), polyetherimide (PEI), polycarbonate (PC), polypropylene (PP), acrylonitrile-butadiene styrene plastics (ABS), polyoxymethylene plastic (POM), nylon 6, nylon 6-6, nylon 12, polymethyl methacrylate (PMMA), polyphenylene oxide (PPO), polybutylene terephthalate (PBT), polysulfone (PSU), polyether sulfone (PES), polyether ether ketone (PEEK) or mixtures thereof. Organic fibers, such as fiberglass, carbon fiber, or metallic fiber, can be added into the engineering plastic, so as to enhance structural strength. The reinforcing fibers can be continuous long fibers or short fibers. One of the advantages of PSU is that it is relatively stiff with relatively low damping which produces a better sounding or more metallic sounding golf club compared to other polymers which may be overdamped. Additionally, PSU requires less post processing in that it does not require a finish or paint to achieve a final finished golf club head.

One exemplary material from which any one or more of the sole insert 110, the crown insert 108, the continuous collar 104, the ring 106, and/or the strike plate 143, can be made is a thermoplastic continuous carbon fiber composite laminate material having long, aligned carbon fibers in a PPS (polyphenylene sulfide) matrix or base. A commercial example of a fiber-reinforced polymer, from which the sole insert 110, the crown insert 108, and/or the strike plate 143 can be made, is TEPEX® DYNALITE 207 manufactured by Lanxess®. TEPEX® DYNALITE 207 is a high strength, lightweight material, arranged in sheets, having multiple layers of continuous carbon fiber reinforcement in a PPS thermoplastic matrix or polymer to embed the fibers. The material may have a 54% fiber volume, but can have other fiber volumes (such as a volume of 42% to 57%). According to one example, the material weighs 200 g/m$^2$. Another commercial example of a fiber-reinforced polymer, from which the sole insert 110, crown insert 108, and/or the strike plate 143 is made, is TEPEX® DYNALITE 208. This material also has a carbon fiber volume range of 42 to 57%, including a 45% volume in one example, and a weight of 200 g/m2. DYNALITE 208 differs from DYNALITE 207 in that it has a TPU (thermoplastic polyurethane) matrix or base rather than a polyphenylene sulfide (PPS) matrix.

By way of example, the fibers of each sheet of TEPEX® DYNALITE 207 sheet (or other fiber-reinforced polymer material, such as DYNALITE 208) are oriented in the same direction with the sheets being oriented in different directions relative to each other, and the sheets are placed in a two-piece (male/female) matched die, heated past the melt temperature, and formed to shape when the die is closed. This process may be referred to as thermoforming and is especially well-suited for forming the sole insert 110, the crown insert 108, and/or the strike plate 143. After the sole insert 110, the crown insert 108, and/or the strike face are formed (separately, in some implementations) by the thermoforming process, each is cooled and removed from the matched die. In some implementations, the sole insert 110, the crown insert 108, and/or the strike plate 143 has a uniform thickness, which facilitates use of the thermoforming process and ease of manufacture. However, in other implementations, the sole insert 110, the crown insert 108, and/or the strike plate 143 may have a variable thickness to strengthen select local areas of the insert by, for example, adding additional plies in select areas to enhance durability, acoustic properties, or other properties of the respective inserts.

In some examples, any one or more of the sole insert 110, the crown insert 108, the continuous collar 104, the ring 106, the forward insert 200 and/or the strike plate 143 can be made by a process other than thermoforming, such as injection molding or thermosetting. In a thermoset process, any one or more of the sole insert 110, the crown insert 108, the continuous collar 104, the ring 106, the forward insert 200 and/or the strike plate 143 may be made from "prepreg" plies of woven or unidirectional composite fiber fabric (such as carbon fiber composite fabric) that is preimpregnated with resin and hardener formulations that activate when heated. The prepreg plies are placed in a mold suitable for a thermosetting process, such as a bladder mold or compression mold, and stacked/oriented with the carbon or other fibers oriented in different directions. The plies are heated to activate the chemical reaction and form the crown insert 108 and/or the sole insert 110. Each insert is cooled and removed from its respective mold.

The carbon fiber reinforcement material for any one or more of the sole insert 110, the crown insert 108, the continuous collar 104, the ring 106, the forward insert 200 and/or the strike plate 143 made by the thermoset manufacturing process, may be a carbon fiber known as "34-700" fiber, available from Grafil, Inc., of Sacramento, California, which has a tensile modulus of 234 Gpa (34 Msi) and a tensile strength of 4500 Mpa (650 Ksi). Another suitable fiber, also available from Grafil, Inc., is a carbon fiber known as "TR50S" fiber which has a tensile modulus of 240 Gpa (35 Msi) and a tensile strength of 4900 Mpa (710 Ksi). Exemplary epoxy resins for the prepreg plies used to form the thermoset crown and sole inserts include Newport 301 and 350 and are available from Newport Adhesives & Composites, Inc., of Irvine, California. In one example, the prepreg sheets have a quasi-isotropic fiber reinforcement of 34-700 fiber having an areal weight between about 20 g/m^2 to about 200 g/m^2 preferably about 70 g/m^2 and impregnated with an epoxy resin (e.g., Newport 301), resulting in a resin content (R/C) of about 40%. For convenience of reference, the primary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%.

In some examples, polymers used in the manufacturing of the golf club head 100 may include without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference), ethylene vinyl acetates, polyureas, and polysiloxanes and any and all combinations thereof.

Of these preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers. Especially preferred polymers for use in the golf club heads of the present invention are the family of so called high performance engineering thermoplastics which are known for their toughness and stability at high temperatures. These polymers include the polysulfones, the polyetherimides, and the polyamide-imides. Of these, the most preferred are the polysulfones.

Aromatic polysulfones are a family of polymers produced from the condensation polymerization of 4,4'-dichlorodiphenylsulfone with itself or one or more dihydric phenols. The aromatic polysulfones include the thermoplastics sometimes called polyether sulfones, and the general structure of their repeating unit has a diaryl sulfone structure which may be represented as -arylene-SO2-arylene-. These units may be linked to one another by carbon-to-carbon bonds, carbon-oxygen-carbon bonds, carbon-sulfur-carbon bonds, or via a short alkylene linkage, so as to form a thermally stable thermoplastic polymer. Polymers in this family are completely amorphous, exhibit high glass-transition temperatures, and offer high strength and stiffness properties even at high temperatures, making them useful for demanding engineering applications. The polymers also possess good ductility and toughness and are transparent in their natural state by virtue of their fully amorphous nature. Additional key attributes include resistance to hydrolysis by hot water/steam and excellent resistance to acids and bases. The polysulfones are fully thermoplastic, allowing fabrication by most standard methods such as injection molding, extrusion, and thermoforming. They also enjoy a broad range of high temperature engineering uses.

Three commercially important polysulfones are a) polysulfone (PSU); b) Polyethersulfone (PES also referred to as PESU); and c) Polyphenylene sulfone (PPSU).

Particularly important and preferred aromatic polysulfones are those comprised of repeating units of the structure —C6H4SO2-C6H4-O— where C6H4 represents a m-or p-phenylene structure. The polymer chain can also comprise repeating units such

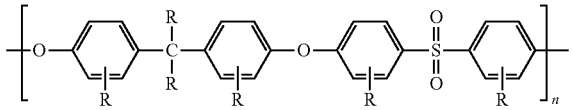

as —C6H4-, C6H4-O—, —C6H4-(lower-alkylene)-C6H4-O—, —C6H4-O—C6H4-O—, —C6H4-S—C6H4-O—, and other thermally stable substantially-aromatic difunctional groups known in the art of engineering thermoplastics. Also included are the so called modified polysulfones where the individual aromatic rings are further substituted in one or substituents including or

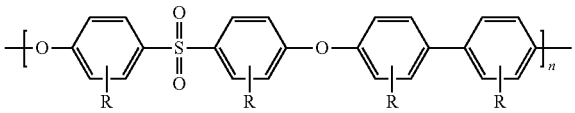

-continued or

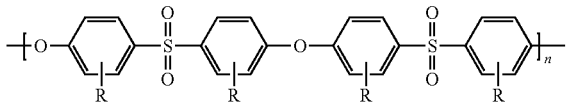

wherein R is independently at each occurrence, a hydrogen atom, a halogen atom or a hydrocarbon group or a combination thereof. The halogen atom includes fluorine, chlorine, bromine and iodine atoms. The hydrocarbon group includes, for example, a C1-C20 alkyl group, a C2-C20 alkenyl group, a C3-C20 cycloalkyl group, a C3-C20 cycloalkenyl group, and a C6-C20 aromatic hydrocarbon group. These hydrocarbon groups may be partly substituted by a halogen atom or atoms, or may be partly substituted by a polar group or groups other than the halogen atom or atoms. As specific examples of the C1-C20 alkyl group, there can be mentioned methyl, ethyl, propyl, isopropyl, amyl, hexyl, octyl, decyl and dodecyl groups. As specific examples of the C2-C20 alkenyl group, there can be mentioned propenyl, isopropyl, butenyl, isobutenyl, pentenyl and hexenyl groups. As specific examples of the C3-C20 cycloalkyl group, there can be mentioned cyclopentyl and cyclohexyl groups. As specific examples of the C3-C20 cycloalkenyl group, there can be mentioned cyclopentenyl and cyclohexenyl groups. As specific examples of the aromatic hydrocarbon group, there can be mentioned phenyl and naphthyl groups or a combination thereof.

Individual preferred polymers include (a) the polysulfone made by condensation polymerization of bisphenol A and 4,4'-dichlorodiphenyl sulfone in the presence of base, and having the main repeating structure

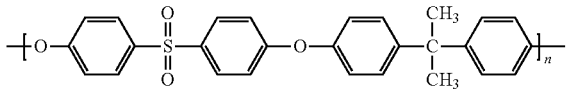

and the abbreviation PSF and sold under the tradenames Udel®, Ultrason® S, Eviva®, RTP PSU, (b) the polysulfone made by condensation polymerization of 4,4'-dihydroxydiphenyl and 4,4'-dichlorodiphenyl sulfone in the presence of base, and having the main repeating structure

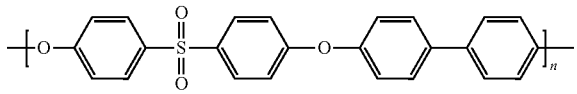

and the abbreviation PPSF and sold under the tradenames RADEL® resin; and (c)a condensation polymer made from 4,4'-dichlorodiphenyl sulfone in the presence of base and having the principle repeating structure

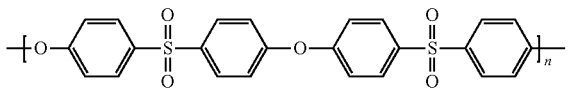

and the abbreviation PPSF and sometimes called a "polyether sulfone" and sold under the tradenames Ultrason® E, LNP™, Veradel®PESU, Sumikaexce, and VICTREX® resin," and any and all combinations thereof.

In some examples, one exemplary material from which any one or more of the sole insert 110, the crown insert 108, the cast cup 103, the ring 106, and/or the strike face, such as the strike plate 243, can be made from is a composite material, such as a carbon fiber reinforced polymeric material, made of a composite including multiple plies or layers of a fibrous material (e.g., graphite, or carbon fiber including turbostratic or graphitic carbon fiber or a hybrid structure with both graphitic and turbostratic parts present). Examples of some of these composite materials for use in the parts of the golf club head 100 and their fabrication procedures are described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004, 387, 11/960,609, 11/960,610, and 12/156,947, which are incorporated herein by reference. The composite material may be manufactured according to the methods described at least in U.S. patent application Ser. No. 11/825,138, the entire contents of which are herein incorporated by reference.

Alternatively, short or long fiber-reinforced formulations of the previously referenced polymers can be used. Exemplary formulations include a Nylon 6/6 polyamide formulation, which is 30% Carbon Fiber Filled and available commercially from RTP Company under the trade name RTP 285. This material has a Tensile Strength of 35000 psi (241 MPa) as measured by ASTM D 638; a Tensile Elongation of 2.0-3.0% as measured by ASTM D 638; a Tensile Modulus of 3.30×106 psi (22754 MPa) as measured by ASTM D 638; a Flexural Strength of 50000 psi (345 MPa) as measured by ASTM D 790; and a Flexural Modulus of 2.60×106 psi (17927 MPa) as measured by ASTM D 790.

Other materials also include is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Yet other materials include is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

Especially preferred materials include a polysulfone (PSU) formulation which is 20% Carbon Fiber Filled and available commercially from RTP Company under the trade name RTP 983. This material has a Tensile Strength of 124 MPa as measured by ISO 527; a Tensile Elongation of 2% as measured by ISO 527; a Tensile Modulus of 11032 MPa as measured by ISO 527; a Flexural Strength of 186 MPa as measured by ISO 178; and a Flexural Modulus of 9653 MPa as measured by ISO 178.

Also, preferred materials may include a polysulfone (PSU) formulation which is 30% Carbon Fiber Filled and available commercially from RTP Company under the trade name RTP 985. This material has a Tensile Strength of 138 MPa as measured by ISO 527; a Tensile Elongation of 1.2% as measured by ISO 527; a Tensile Modulus of 20685 MPa as measured by ISO 527; a Flexural Strength of 193 MPa as measured by ISO 178; and a Flexural Modulus of 12411 MPa as measured by ISO 178.

Further preferred materials include a polysulfone (PSU) formulation which is 40% Carbon Fiber Filled and available commercially from RTP Company under the trade name RTP 987. This material has a Tensile Strength of 155 MPa as measured by ISO 527; a Tensile Elongation of 1% as measured by ISO 527; a Tensile Modulus of 24132 MPa as measured by ISO 527; a Flexural Strength of 241 MPa as measured by ISO 178; and a Flexural Modulus of 19306 MPa as measured by ISO 178.

Any one or more of the sole insert 110, the crown insert 108, the continuous collar 104, the ring 106, the forward insert 200 and/or the strike plate 143 can have a complex three-dimensional shape and curvature corresponding generally to a desired shape and curvature of the golf club head 100. It will be appreciated that other types of club heads, such as fairway wood-type club heads, hybrid club heads, and iron-type club heads, may be manufactured using one or more of the principles, methods, and materials described herein.

Referring to FIGS. 31, 32, 33, and 36, and according to some examples, a method 550 of making the golf club head 100 includes (block 552) laser ablating a first-part surface 520 of a first part 502 of a golf club head such that a first-part ablated surface 522 is formed in the first part 502. The method 550 also includes (block 554) laser ablating a second-part surface 524 of a second part 504 of the golf club head 100 such that a second-part ablated surface 526 is formed in the second part 504. The method 550 additionally includes (block 556) bonding together the first-part ablated surface 522 and the second-part ablated surface 526. Generally, the method 550 helps to produce bonding surfaces (i.e., faying surfaces) of a golf club head with features that promote strong and reliable bonds between the bonding surfaces. More specifically, the features formed by ablating the bonding surfaces of the golf club head with a laser promote an increase in the pattern uniformity and surface energy of the bonding surfaces, which helps to strengthen the bond between the bonding surfaces and increase the overall reliability and performance of the golf club head. Also, ablating the bonding surfaces with a laser enables the repeatability of surface characteristics across multiple parts and batches of parts. As defined herein, each one of the first-part ablated surface 522 and/or the second-part ablated surface 526 can be a single continuous surface or multiple spaced apart (e.g., intermittent) surfaces.

Conventional processes for bonding together surfaces of a golf club head, including surface preparation via non-laser ablation methods, may not provide a sufficient pattern uniformity and surface energy for producing strong and reliable bonds. For example, chemical ablation and media-blast ablation processes are unable to achieve pattern uniformities and surface energies of bonding surfaces that are achievable by the laser ablation of the present disclosure. The patterns of peaks and valleys on bonding surfaces ablated via a chemical ablation process or a media-blast ablation process are irregular and inconsistent, which leads to lower and non-uniform bonding strength across a bond between the bonding surfaces.

As shown in FIG. 31, a first-part laser 506 is configured to generate a first-part laser beam 508 and direct the first-part laser beam 508 at the first-part surface 520 of the first part 502. The first-part laser beam 508 impacts the first-part surface 520, which sublimates a portion of the first-part surface 520 up to a desired depth. More specifically, the energy of the first-part laser beam 508 is sufficient to transition the portion of the first-part surface 520 from a solid state directly to a gas state. In some examples, the desired depth is between 5 micrometers and 100 micrometers, between 20 micrometers and 50 micrometers, or approximately 30 micrometers. The gas sublimated from the first-part surface 520 can be suctioned away, such as by a vacuum pump (not shown).

The depth of the portion of the first-part surface 520 that is sublimated (e.g., removed) is dependent on the material of the first-part surface 520 and the characteristics of the first-part laser beam 508. The characteristics of the first-part laser beam 508 include the intensity (e.g., optical power per unit area) of, the pulse frequency of, and the duration of the impact on the first-part surface 520 by the first-part laser beam 508. After the portion of the first-part surface 520 is removed, the first-part ablated surface 522 is exposed. Accordingly, generally speaking, the first-part laser beam 508 removes a top surface of the first part 502 so that a fresh surface of the first part 502 is exposed. The first-part ablated surface 522 (e.g., fresh surface or exposed surface) is relatively free of contaminants (e.g., oxides, moisture, etc.) present on the first-part surface 520.

Figure 32:
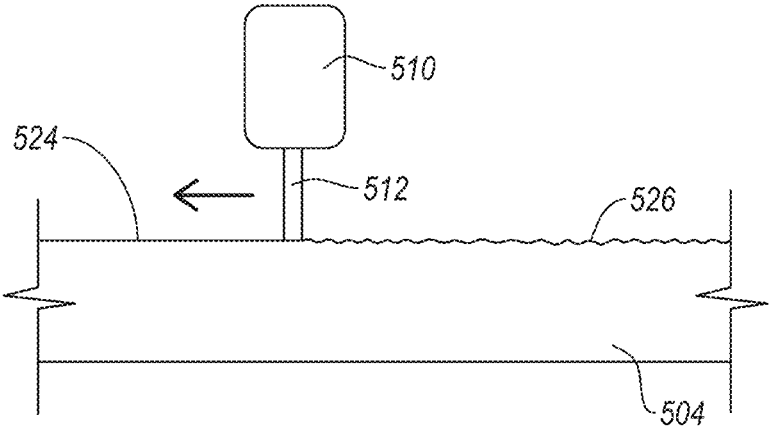
FIG. 32 is a schematic, side elevation view of a second part of a golf club head being laser ablated by a second laser, according to one or more examples of the present disclosure.
Figure 33:
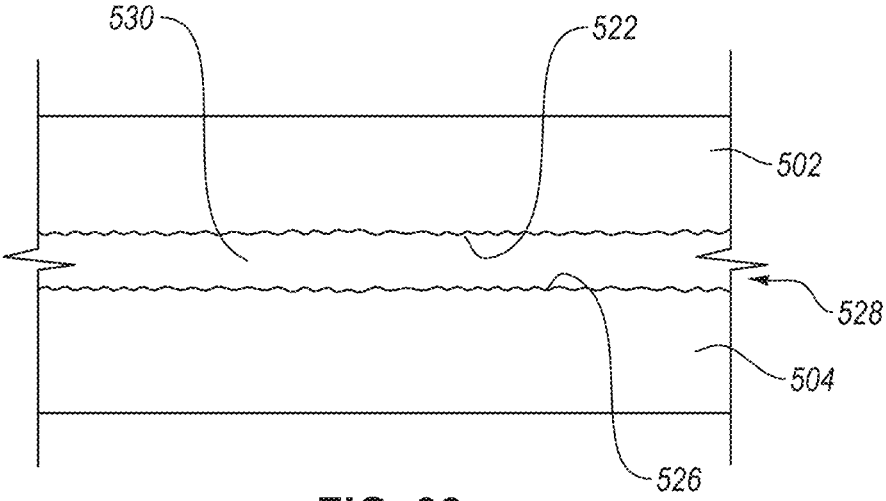
FIG. 33 is a schematic, side elevation view of a first part, of a golf club head, bonded to a second part, of the golf club head, according to one or more examples of the present disclosure.

Similarly, as shown in FIG. 32, a second-part laser 510 is configured to generate a second-part laser beam 510 and direct the second-part laser beam 512 at the second-part surface 524 of the second part 504. The second-part laser beam 512 impacts the second-part surface 524, which sublimates a portion of the second-part surface 524 up to a desired depth. More specifically, the energy of the second-part laser beam 512 is sufficient to transition the portion of the second-part surface 524 from a solid state directly to a gas state. The gas sublimated from the second-part surface 524 can be suctioned away, such as by a vacuum pump (not shown). The depth of the portion of the second-part surface 524 that is sublimated is dependent on the material of the second-part surface 524 and the characteristics of the second-part laser beam 512. Like the first-part laser beam 508, the characteristics of the second-part laser beam 512 include the intensity (e.g., optical power per unit area) of, the pulse frequency of, and the duration of the impact on the second-part surface 524 by the second-part laser beam 512. Generally, the first-part laser beam 508 and the second part-laser beam 512 are highly focused beams of laser radiation. After the portion of the second-part surface 524 is removed, the second-part ablated surface 526 is exposed. Accordingly, generally speaking, the second-part laser beam 512 removes a top surface of the second part 504 so that a fresh surface of the second part 504 is exposed. The second-part ablated surface 526 is relatively free of contaminants present on the second-part surface 524.

In certain examples of the method 550, the first-part laser beam 508 is moved along the first-part surface 520 at a first-part rate to form the first-part ablated surface 522 in the first part 502. Similarly, in some examples, the second-part laser beam 510 is moved along the second-part surface 524 at a second-part rate to form the second-part ablated surface 526 in the second part 504. In this manner, a laser beam with a relatively small footprint can be used to form an ablated surface with a relatively larger surface area. Moreover, in various examples, a laser beam can be split into separate sub-beams, using optics, to move along and form separate portions of an ablated surface. Also, according to some examples, multiple laser beams generated from multiple lasers can be used to form an ablated surface in a single part. The rate at which a laser beam moves along a corresponding part is dependent on the type of material of the part. For example, a given laser beam may need to be moved along a given part at a faster rate, compared to another part, when the material of the given part sublimates faster than the material of the other part. In contrast, a given laser beam may need to be moved along a given part at a slower rate, compared to another part, when the material of the given part sublimates slower than the material of the other part.

The rate of sublimation, and thus the rate of movement of a laser beam along a part, is dependent on the type of laser generating the laser beam and the characteristics of the generated laser beam. Different types of lasers generate different types of laser beams. For example, a carbon-dioxide laser generates a laser beam that is different than the one generated by a fiber laser. Likewise, an Nd-YAG (neodymium-doped yttrium aluminum garnet) laser generates a laser beam that is different than the ones generated by a carbon-dioxide laser and fiber laser, respectively. Additionally, in some examples, a laser can be selectively controlled to adjust characteristics of the generated laser. For example, a laser can be selectively controlled to adjust one or both of an intensity or pulse frequency of the generated laser. Generally, the higher the intensity of the laser beam or the higher the pulse frequency of the laser beam, the higher the rate of sublimation.

Figure 35:
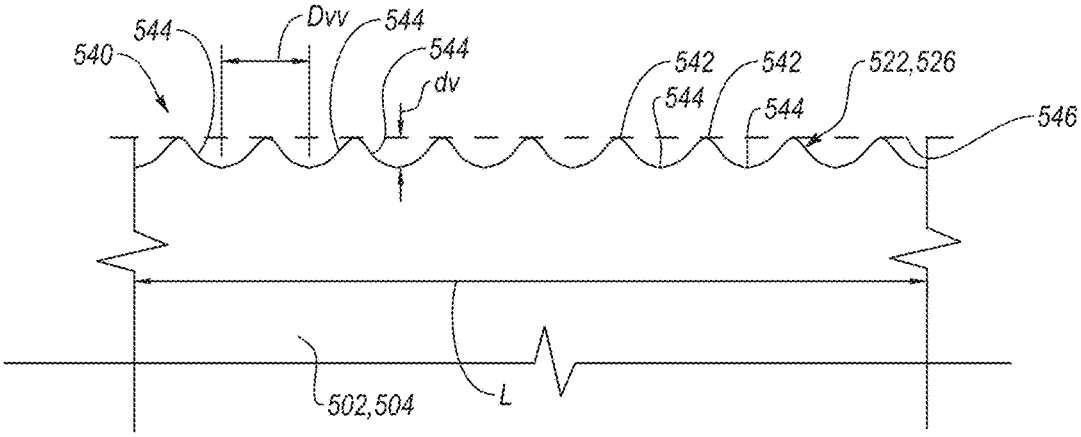
FIG. 35 is a schematic, side elevation view of an ablation pattern, of peaks and valleys, of an ablated surface of a part of a golf club head, according to one or more examples of the present disclosure.
Figure 36:
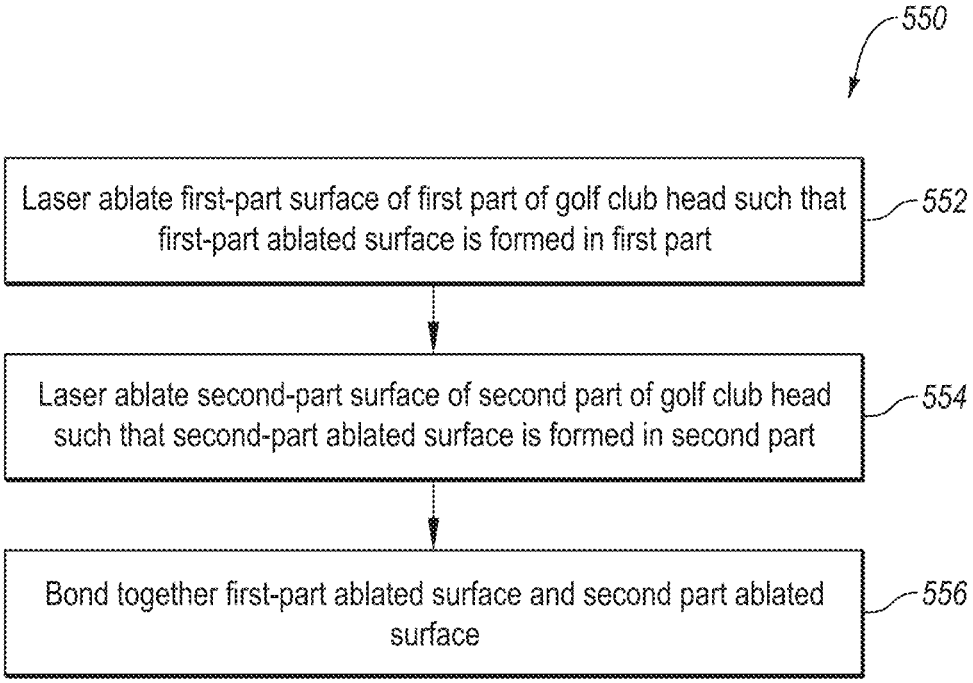
FIG. 36 is a schematic flow diagram of a method of making a golf club head, according to one or more examples of the present disclosure.

After the first part 502 is laser ablated, to form the first-part ablated surface 522, and the second part 504 is laser ablated, to form the second-part ablated surface 526, the first-part ablated surface 522 and the second-part ablated surface 526 are bonded together. Referring to FIG. 35, the first-part ablated surface 522 and the second-part ablated surface 526, when facing each other, are bonded together along a bondline 528 to form a bonded joint. The bondline 528 is defined as the structure, including, but not limited to, the material, between the first-part ablated surface 522 and the second-part ablated surface 526. Accordingly, in certain examples, the first-part ablated surface 522 and the second-part ablated surface 526 are directly bonded together along the bondline 528. In other words, in such examples, other than the material of the bondline 528, no other intervening layer is interposed between the first-part ablated surface 522 and the second-part ablated surface 526. In some examples, the bondline 528 includes an adhesive 530 when the first-part ablated surface 522 and the second-part ablated surface 526 are adhesively bonded. The adhesive 530 can be any of various adhesives known in the art, such as glues, epoxies, resins, and the like. Additionally, the adhesive 530 has a maximum thickness and a minimum thickness, or alternatively an average thickness, along the bondline 528.

In some examples, the type of the first-part laser 506, the rate of movement of the first laser beam 508 (i.e., first-part rate), and/or the characteristics of the first-part laser beam 508 is dependent on the type of material of the first part 502. Similarly, in some examples, the type of the second-part laser 510, the rate of movement of the second-part laser beam 512 (i.e., second-part rate), and/or the characteristics of the second-part laser beam 512 is dependent on the type of material of the second part 504.

According to certain examples, the first part 502 is made of a first material and the second part is made of a second material, where the first material is different than the second material. In one example, the first part 502 is made of a first type of metallic material and the second part 504 is made of a second type of metallic material. In another example, the first part 502 is made of a first type of non-metallic material and the second part 504 is made of a second type of non-metallic material. In yet a further example, the first part 502 is made of a non-metallic material and the second part 504 is made of a metallic material. In the above examples, at least one of the type of the first-part laser 506, the rate of movement of the first-part laser beam 508, or the characteristics of the first-part laser beam 508 is different than the type of the second-part laser 510, the rate of movement of the second-part laser beam 512, or the characteristics of the second-part laser beam 512, respectively. According to some examples, the type of the first-part laser 506 is different than that of the second-part laser 510 (e.g., such that the first-part laser 506 is different than and separate from the second-part laser 510). In some examples, the first-part rate is different than the second-part rate. In one example, the intensity of the first-part laser beam 508 is different than the second-part laser beam 512. Additionally, or alternatively, according to certain examples, the pulse frequency of the first-part laser beam 508 is different than the pulse frequency of the second-part laser beam 512.

According to some examples, the first material is a fiber-reinforced polymeric material and the second material is a metallic material. In one example, the fiber-reinforced polymeric material is at least one of a glass-fiber-reinforced polymeric material or a carbon-fiber-reinforced polymeric material, such as one of those described above, and the metallic material is a titanium alloy, such as a cast titanium material. In these examples, at least one of: the first-part laser 506 is a carbon dioxide laser and the second-part laser 510 is a fiber laser; the first-part rate is slower than the second-part rate; the intensity of the first-part laser beam 508 is less than the intensity of the second-part laser beam 512; or the pulse frequency of the first-part laser beam 508 is less than the pulse frequency of the second-part laser beam 512. When the first-part rate is slower than the second-part rate, in some examples, the first-part rate is between 600 mm/s and 800 mm/s (e.g., 700 mm/s), and the second-part rate is between 600 mm/s and 800 mm/s (e.g., 700 mm/s). When the intensity of the first-part laser beam 508 is less than the intensity of the second-part laser beam 512, in certain examples, the intensity of the first-part laser beam 508 is between 40 watts and 60 watts, and the intensity of the second-part laser beam 512 is between 40 watts and 60 watts. When the pulse frequency of the first-part laser beam 508 is less than the pulse frequency of the second-part laser beam 512, in some examples, the pulse frequency of the first-part laser beam 508 is between 40 kHz and 60 kHz, and the pulse frequency of the second-part laser beam 512 is between 40 kHz and 60 kHz.

When either the first material of the first part 502 or the second material of the second part 504 is a fiber-reinforced polymeric material, which includes a plurality of reinforcement fibers embedded in a resin or epoxy matrix, the corresponding first-part surface 520 or the second-part surface 524 is defined entirely by the resin or epoxy matrix of the fiber-reinforced polymeric material. Accordingly, the first-part laser beam 508 or the second-part laser beam 512 impacts and ablates only the resin or epoxy matrix, without ablating the reinforcement fibers embedded therein. Moreover, in some examples, the first part 502 or the second part 504 is made of plies of a carbon-fiber-reinforced polymeric material sandwiched between opposing outer plies of a glass-fiber-reinforced polymeric material. In such examples, the corresponding laser beam impacts and ablates only the resin or epoxy matrix of the glass-fiber-reinforced polymeric material.

As presented previously, due the ability to precisely control the energy, pulse frequency, and directionality of a laser, laser ablation of a surface can result in a fresh (e.g., relatively uncontaminated) surface having a high uniformity of peaks and valleys, and a high surface energy. Generally, each pulse of the laser beam sublimates and removes a localized portion of the surface being ablated. The removed portion of the surface defines a valley (e.g., dimple or depression) that has a shape that corresponds with a cross-sectional shape of the laser beam and a depth that corresponds with the intensity and frequency of the laser beam. Because the laser beam is moved relative to the surface being ablated, each pulse of the laser beam contacts a different portion of the surface, which results in disparate and spaced apart valleys corresponding with the removed portions. Because the portions of the surface between the removed portions are not removed, the unremoved portions of the surface define peaks between diagonal ones of the valleys. In this manner, as the laser beam is moved relative to the surface, a pattern of peaks and valleys in the surface is formed.

Referring to FIG. 31, sublimation of the first-part surface 520 results in a first-part ablated surface 522 having a first-part ablation pattern of peaks and valleys. Similarly, referring to FIG. 34, sublimation of the second-part surface 524 results in a second-part ablated surface 526 having a second-part ablation pattern of peaks and valleys. Example of an ablation pattern of peaks of valleys, which can be representative of the first-part ablation pattern and the second-part ablation pattern, are shown in FIGS. 34, 35, 39, and 40.

Figure 34:
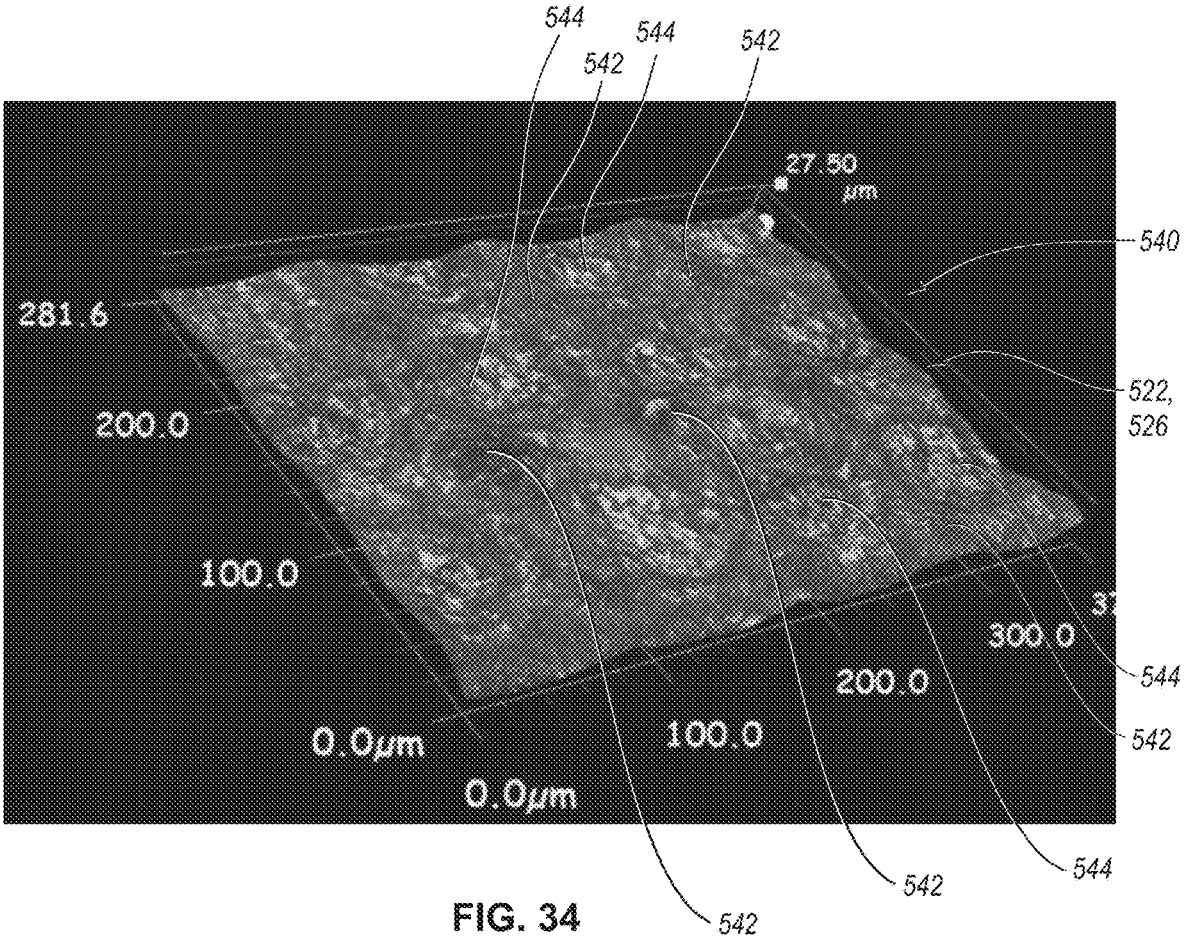
FIG. 34 is a schematic, perspective view of an ablation pattern, of peaks and valleys, of an ablated surface of a part of a golf club head, according to one or more examples of the present disclosure.
Figure 39:
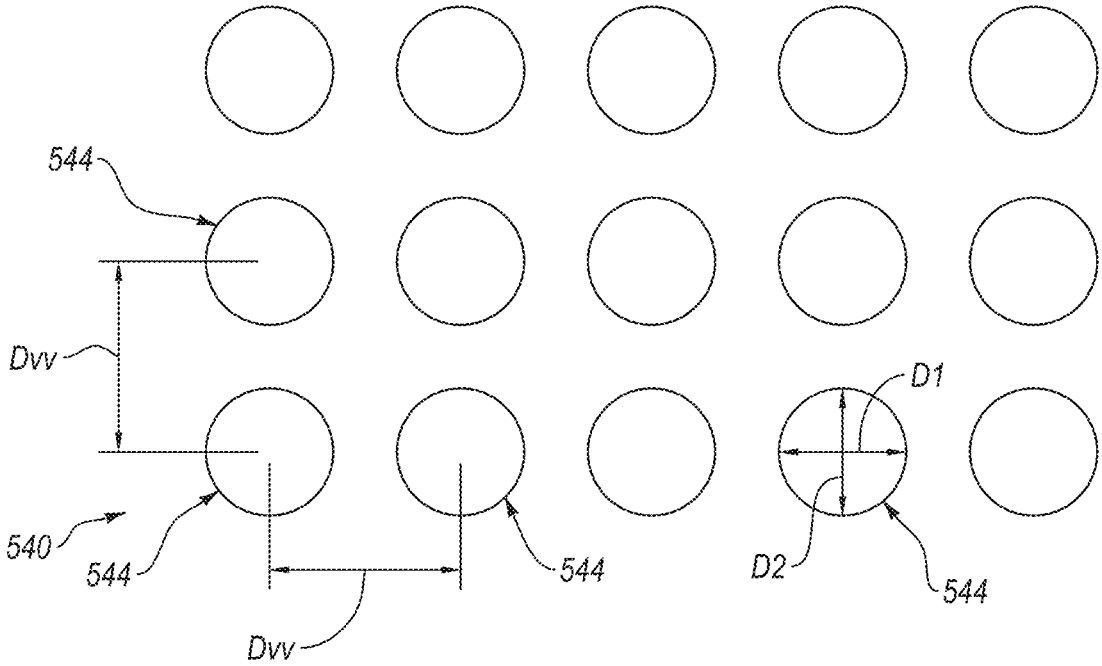
FIG. 39 is a schematic, top plan view of an ablation pattern on a part of a golf club head, according to one or more examples of the present disclosure.
Figure 40:
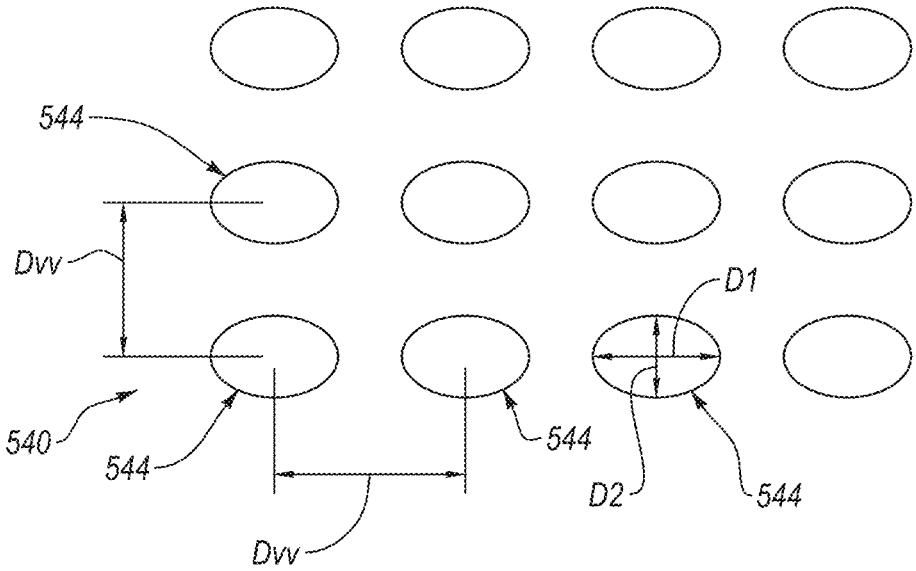
FIG. 40 is a schematic, top plan view of an ablation pattern on a part of a golf club head, according to one or more examples of the present disclosure.

An ablation pattern 540 includes a plurality of peaks 542 spaced apart by a plurality of valleys 544. Generally, the laser beam is moved and pulsed such that the valleys are located relative to each other to form a desired pattern. The pattern of valleys can be symmetrical or non-symmetrical. Moreover, the spacing between valleys can be uniform or non-uniform. In one example, such as shown in FIGS. 34, 39, and 40, the ablation pattern 540 is symmetrical and the spacing between the valleys of the ablation pattern 540 is uniform. As shown in FIG. 32, in one example of a symmetrical pattern, the valleys of the ablation pattern 540 are uniformly spaced and closely spaced together, which means each valley is contiguous with at least one adjacent valley and at least one adjacent peak of the pattern of peaks and valleys. In the illustrated example of FIG. 34, some valleys, of the ablation pattern 540 of peaks and valleys, are contiguous with four adjacent valleys and four adjacent peaks. Likewise, in the illustrated example of FIG. 34, some peaks, of the ablation pattern 540 of peaks and valleys, are contiguous with four adjacent peaks and four adjacent valleys.

In some examples, each one of the valleys 544 is separated from an adjacent one of the valleys 544, across one of the peaks 542 and along a length L (or width) of the part, by a valley-to-valley distance Dvv. The valley-to-valley distance Dvv is defined as the distance from a center point of one of the valleys 544 and the center point of an adjacent one of the valleys 544. Moreover, each one of the valleys 544 has a valley depth dv measured from a hypothetical boundary 546 that is generally co-planar with the surface prior to being laser ablated. Referring to FIGS. 45 and 46, each one of the valleys 544 has a major dimension D1 (e.g., maximum dimension) and a minor dimension D2 (e.g., minimum dimension). The major dimension D1 is equal to or less than the minor dimension D2. For example, with reference to FIG. 38, when each one of the valleys 544 is substantially circular, the major dimension D1 is equal to the minor dimension D2. However, in other examples, as shown in FIG. 40, each one of the valleys 544 has a non-circular shape (e.g., an oval shape) such that the major dimension D1 is greater than the minor dimension D2. In some examples, such as when the surface, ablated by the laser beam, is flat, the resulting ablation pattern includes valleys 544 that are circular. However, according to certain examples, such as when the surface, ablated by the laser beam, is curved or contoured, the curvature of the surfaces causes the valleys 544 of the resulting ablation pattern to have an oval shape.

In some examples, the major dimension D1 of at least one of the valleys 544 is between 40 micrometers and 80 micrometers, and the minor dimension D2 is equal to the major dimension D1 or may vary by as much as 10% or 20% or by 10-20 micrometers. Additionally, or alternatively, the valley-to-valley distance Dvv between two valleys 544 can range from 80%-200% (preferably at least 120%) of the major dimension D1 of any one of the two valleys 544. As defined herein, in relation to the valleys 544, a first valley is adjacent a second valley when the second valley is the nearest neighbor to the first valley. Moreover, in some examples, such as those with uniform spacing between valleys, a given valley can be considered to be adjacent to multiple valleys. The center point of a valley 544 is defined as the location of greatest depth of the valley 544, which will typically be half of the major dimension inwards from an outer perimeter of the valley 544. The outer perimeter (e.g., perimeter) of a valley 544 is defined as the transition region where a change in the valley depth dv of the valley 544, versus an unablated surface, is no more than 5 micrometers, preferably between 0 to 2 micrometers versus an unablated surface.

According to one example, the uniformity of an ablation pattern of peaks and valleys, as used herein, can be defined in terms of the variation of the size of the valleys of the ablation pattern. As previously mentioned, the substantially non-controllable ablation pattern left behind by some ablation process, such as media-blast ablation processes, include valleys of widely disparate sizes, shapes, and spacing. The ability to precisely control the energy, pulse frequency, and directionality of the laser results in an ablation pattern where all the valleys of the pattern have a uniform size. The uniformity of the sizes of the valleys of the ablation pattern formed by the laser beam can be expressed by the percent difference in the size of one valley of the ablation pattern relative to any other one (e.g., all other ones) of the valleys of the ablation pattern. The percent difference, as pertaining to the size of the valleys, is equal to the ratio (expressed as a percentage) of the size of one valley in the pattern and the size of any other one of the valleys in the pattern. The lower the percent difference in the size of the valleys of the ablation pattern, the higher the uniformity of the ablation pattern. In some examples, the percent difference of the size of one valley of a given pattern and the size of any other one of the valleys of the given pattern is no more than 20%. In other words, the size of one valley is within 20% of the size of any other one, or all other ones, of the valleys. In other examples, the percent difference of the size of one valley of a given pattern and the size of any other one of the valleys of the given pattern is no more than 10%.

The size of a valley can be expressed as a cross-sectional area, the major dimension D1, the minor dimension D2, the depth dv, or other characteristic of the size of the valley. In certain examples, the major dimension D1 or the minor dimension D2 of one valley is within 20% of the corresponding major dimension D1 or the minor dimension D2 of any other one, or all other ones, of the valleys. According to one example, the major dimension D1 of one valley is within 20% of the major dimension D1 of any other one, or all other ones, of the valleys, and the minor dimension D2 of the one valley is within 20% of the minor dimension D2 of any other one, or all other ones, of the valleys. In certain examples, the major dimension D1 or the minor dimension D2 of one valley is within 10% of the corresponding major dimension D1 or the minor dimension D2 of any other one, or all other ones, of the valleys. According to one example, the major dimension D1 of one valley is within 10% of the major dimension D1 of any other one, or all other ones, of the valleys, and the minor dimension D2 of the one valley is within 10% of the minor dimension D2 of any other one, or all other ones, of the valleys. Although the above examples reference the major dimension D1 and the minor dimension D2 of the valleys, other characteristics of the size of the valleys, such as cross-sectional area and depth, can be interchanged with the major dimension D1 and the minor dimension D2.

Additionally, or alternatively, in some examples, the uniformity of an ablation pattern of peaks and valleys, as used herein, can be defined in terms of the variation of the distance between adjacent valleys of the ablation pattern. The ability to precisely control the energy, pulse frequency, and directionality of the laser results in an ablation pattern where all the valleys of the pattern are uniformly spaced apart from each other. The uniformity of the distance between the valleys of the ablation pattern formed by the laser beam can be expressed by the percent difference in the distance between two adjacent valleys of the ablation pattern relative to the distance between any other two adjacent valleys (e.g., all adjacent valleys) of the ablation pattern. The percent difference, as pertaining to the distances between valleys, is equal to the ratio (expressed as a percentage) of the distance between two adjacent valleys in the pattern and the distance between any other two adjacent valleys in the pattern. The lower the percent difference in the distances between the valleys of the ablation pattern, the higher the uniformity of the ablation pattern. In some examples, the percent difference of the distances between two adjacent valleys of a given pattern and the difference between any other two adjacent valleys of the given pattern is no more than 20%. In other words, the distance between two adjacent valleys is within 20% of the distance between any other two adjacent valleys. In other examples, the percent difference of the distances between two adjacent valleys of a given pattern and the difference between any other two adjacent valleys of the given pattern is no more than 10%.

Corresponding with the uniformity of the peaks and valleys of the ablation pattern on the ablated surfaces of the parts disclosed herein, laser ablating a surface of a part of the golf club head also promotes a higher surface energy compared to surfaces treated using other types of ablation processes. As presented above, a higher surface energy of surfaces to be bonded enables a stronger and more reliable bond between the surfaces. The surface energy of a surface is inversely proportional to the water contact angle of the surface. In other words, the lower the water contact angle of the surface, the higher the surface energy of that surface. The water contact angle is defined as the angle (through the water) a drop of water, on a surface, makes with the surface. The lower the water contact angle, the higher the wettability of the surface, which promotes the adhesiveness of the adhesive and the ability of the adhesive to bond to the surface. Accordingly, the lower the water contact angle, the better the bond, and the higher the strength of the bond. In some examples, the water contact angle can be measured by using a goniometer or other measuring device. According to Table 2 below, the water contact angle for various laser ablated surfaces of several examples of a golf club head, prior to forming a bonded joint, are shown.

TABLE 2

| | Crown-Hosel | Crown-Toe | Sole-Hosel | Sole-Toe |
|---|---|---|---|---|
| Example 1 | 14° | 6° | 10° | 5° |
| Example 2 | 16° | 12° | 10° | 6° |
| Example 3 | 14° | 13° | 10° | 10° |
| Example 4 | 11° | 13° | 10° | 2° |
| Example 5 | 16° | 13° | 10° | 12° |
| Example 6 | 14° | 21° | 10° | 6° |
| Example 7 | 14° | 14° | 10° | 6° |
| Example 8 | 15° | 15° | 16° | 15° |
| Example 9 | 18° | 18° | 9° | 10° |
| Example 10 | 18° | 17° | 8° | 2° |

In Table 2, the crown-hosel surface is a portion of a front-ledge ablated surface of the body 102 that is closer to the crown portion 119 than the sole portion 117, and closer to the hosel 120 than the toe portion 114; the crown-toe surface is a portion of the front-ledge ablated surface of the body 102 that is closer to the crown portion 119 than the sole portion 117, and closer to the toe portion 114 than the hosel 120; the sole-hosel surface is a portion of the front-ledge ablated surface of the body 102 that is closer to the sole portion 117 than the crown portion 119, and closer to the hosel 120 than the toe portion 114; and the sole-toe surface is a portion of the front-ledge ablated surface of the body 102 that is closer to the sole portion 117 than the crown portion 119, and closer to the toe portion 114 than the hosel 120. Accordingly, with reference to Table 2, in some examples, the second-part ablated surface 526, or any laser ablated surface of the golf club head 100, has a water contact angle between 2° and 25°, or between 5° and 18°. According to yet certain examples, the water contact angle of an ablated surface of the golf club head 100 is less than 50°, less than 45°, less than 40°, less than 35°, less than 30°, less than 25°, or less than 20°. In some examples, the water contact angle of an ablated surface of the golf club head 100 is greater than zero degrees and less than 30° or greater than zero degrees and less than 25°. In certain examples, the water contact angle of an ablated surface of the golf club head 100 is between 1° and 18°.

In some examples, the first part 502 is the strike plate 143 of the golf club head 100 and the second part 504 is the body 102 of the golf club head 100. In certain examples, the strike plate 143 can be made of a fiber-reinforced polymeric material and the body 102 can be made of a different material, such as a cast titanium material, non-cast titanium material, an aluminum material, a steel material, a tungsten material, a plastic material, and/or the like. The strike plate 143 is made of a plurality of stacked plies of fiber-reinforced polymeric material in certain examples. In one example, the strike plate 143 is made of between 35-70 stacked plies of fiber-reinforced polymeric material (each having continuous fibers at a given angle) and has a thickness between 3.5 mm and 6.0 mm, inclusive. The angle of the fibers of the plies can vary from ply-to-ply. Alternatively, the strike plate 143 can be made of a metallic material, such as a titanium alloy, and the body 102 can be made of the same metallic material or a different metallic material, such as a different titanium alloy. Also, the body 102, as presented above, can be made of multiple, separately formed and subsequently attached, pieces where each piece is made of a different material.

When the first part 502 is the strike plate 143 of the golf club head 100, the first-part surface 520 includes an interior surface 166 or rear surface of the strike plate 143, which is opposite the strike face 145 of the strike plate 143 (see, e.g., FIG. 12A). Accordingly, the first laser 506 generates the first-part laser beam 508 and directs the first-part laser beam 508 to impact the interior surface 166 within and along a designated first-part bond area, at least partially on the interior surface 166, to form a strike-plate-interior ablated surface. Accordingly, only a portion (e.g., outer peripheral portion) of the entire interior surface 166 of the strike plate 143 is laser ablated, with the remaining portion of the interior surface 166 being non-ablated. The first-part ablated surface 522 includes, at least partially, the strike-plate-interior ablated surface. In some examples, the first-part surface 520 also includes a peripheral edge surface of the strike plate 143 and the first laser 506 generates the first-part laser beam 508 and directs the first-part laser beam 508 to impact (e.g., an entirety of) the peripheral edge surface such that a strike-plate-edge ablated surface is formed. Accordingly, the first-part ablated surface 522 can further include the strike-plate-edge ablated surface and the designated first-part bond area 548 can further include the peripheral edge surface. The strike-plate-interior ablated surface and the strike-plate-edge ablated surface have the same ablation pattern in certain examples. In some examples, an orientation of the strike plate 143 relative to the first-part laser 506 is adjusted when laser ablating the peripheral edge surface, compared to when laser ablating the interior surface 166, because of the angle of the peripheral edge surface 167 relative to the interior surface 166.

When the second part 504 is the body 102, the second-part surface 524 includes the plate-opening recessed ledge 147 of the body 102. Accordingly, as shown in FIG. 39, the second laser 510 generates the second-part laser beam 512 and directs the second-part laser beam 512 to impact the plate-opening recessed ledge 147, within and along a designated second-part bond area, to form a front-ledge ablated surface. The second-part ablated surface 526 includes, at least partially, the front-ledge ablated surface. In some examples, the second-part surface 524 also includes the sidewall 146, extending about the plate-opening recessed ledge 147, and the second laser 510 generates the second-part laser beam 512 and directs the second-part laser beam 512 to impact (e.g., an entirety of) the sidewall 146 such that a front-sidewall ablated surface is formed. Accordingly, the second-part ablated surface 526 can further include the front-sidewall ablated surface and the designated second-part bond area can further include the sidewall 146. The front-ledge ablated surface and the front-sidewall ablated surface have the same ablation pattern in certain examples. In some examples, an orientation of the body 102 relative to the second-part laser 510 is adjusted when laser ablating the sidewall 146, compared to when laser ablating the plate-opening recessed ledge 147, because of the angle of the sidewall 146 relative to the plate-opening recessed ledge 147.

In view of the foregoing, according to some examples, such as with the body 102 of the golf club head 100, the second-part ablated surface 526 is defined by the ablated surfaces of two sub-components (e.g., the continuous collar 104 and the ring 106 or the forward insert 200) made of different materials. Therefore, when the second-part ablated surface 526 is laser ablated, the different materials defining the second-part ablated surface 526 can be laser ablated in a single, continuous step. A first material of the different materials can define a first surface area of the second-part ablated surface 526 and the second material of the different materials can define a second surface area of the second-part ablated surface. The first surface area and the second surface area can be different in some examples. According to certain examples, the first surface area is greater than the second surface area, and the first material, defining the first surface area, has a lower density than the second material, defining the second surface area. Both the continuous collar 104 and the ring 106 or the forward insert 200 include a front ledge and a sidewall (similar to the plate opening recessed ledge 147 and the sidewall 146), which can be laser ablated to define the second-part ablated surface 526.

In some examples, the first part 502 is one of the crown insert 108 or the sole insert 110, and the second part 504 is the body 102. In certain examples, the crown insert 108 and/or the sole insert 110 can be made of a fiber-reinforced polymeric material and the body 102 can be made of a different material, such as a cast titanium material, non-cast titanium material, an aluminum material, a steel material, a tungsten material, a plastic material, and/or the like. Alternatively, the crown insert 108 and/or the sole insert 100 can be made of a metallic material, such as a titanium alloy, and the body 102 can be made of the same metallic material or a different metallic material, such as a different titanium alloy.

When the first part 502 is the crown insert 108, the first-part surface 520 includes an interior surface of the crown insert 108. Accordingly, the first laser 506 generates the first-part laser beam 508 and directs the first-part laser beam 508 to impact the interior surface of the crown insert 108 within and along a designated first-part bond area, at least partially on the interior surface of the crown insert 108, to form a crown-insert ablated surface. The first-part ablated surface 522 includes, at least partially, the crown-insert ablated surface. Accordingly, only a portion (e.g., outer peripheral portion) of the entire interior surface of the crown insert 108 is laser ablated, with the remaining portion of the interior surface of the crown insert 108 being non-ablated. In some examples, the bond area on the interior surface of the crown insert 108 will range from 2,000 $mm^2$ to 2,500 $mm^2$, such as at least 2,248 $mm^2$. Moreover, in certain examples, a total surface area of the interior surface of the crown insert 108 is between 7,000 $mm^2$ and 12,000 $mm^2$ or between 9,000 $mm^2$ and 11,000 $mm^2$ (e.g., a minimum surface area between 7,000 $mm^2$ and 9,000 $mm^2$), such as between 9,379 $mm^2$ and 10,366 $mm^2$ (e.g., around 9,873 $mm^2$). In some examples, a percentage of the total surface area of the interior surface occupied by the bond area on the interior surface of the crown insert 108 is no more than 25%, 30%, 35%, or 40% and no less than 10%, 15%, 20%, or 25%. According to certain examples, the percentage of the total surface area of the interior surface occupied by the bond area on the interior surface of the crown insert 108 is between 20% and 25%, such as 22%, between 20% and 27%, or between 22% and 25%.

In some examples, the bond area on the interior surface of the sole insert 110 will range from 1,800 $mm^2$ to 2,200 $mm^2$, such as at least 2,076 $mm^2$. Moreover, in certain examples, a total surface area of the interior surface of the sole insert 110 is between 7,000 $mm^2$ and 12,000 $mm^2$ or between 9,000 $mm^2$ and 11,000 $mm^2$ (e.g., a minimum surface area between 7,000 $mm^2$ and 9,000 $mm^2$), such as between 8,182 $mm^2$ and 9,043 $mm^2$ (e.g., around 8,613 $mm^2$). In some examples, a percentage of the total surface area of the interior surface occupied by the bond area on the interior surface of the sole insert 110 is no more than 25%, 30%, 35%, or 40% and no less than 10%, 15%, 20%, or 25%. According to certain examples, the percentage of the total surface area of the interior surface occupied by the bond area on the interior surface of the sole insert 110 is between 20% and 27%, between 22% and 25%, or between 21% and 26%, such as 24%.

In some examples, the bond area on the interior surface of the strike plate 143 will range from 1,770 $mm^2$ to 2,170 $mm^2$, such as at least 1,976 $mm^2$. Moreover, in certain examples, a total surface area of the interior surface of the strike plate 143 is less than 7,000 $mm^2$, such as between 1,500 $mm^2$ and 7,000 $mm^2$, between 3,200 $mm^2$ and 4,700 $mm^2$, or between 3,572 $mm^2$ and 3,949 $mm^2$ (e.g., around 3,761 $mm^2$). In some examples, a percentage of the total surface area of the interior surface of the strike plate 143 occupied by the bond area on the interior surface of the strike plate 143 is no more than 55%, 60%, 65%, or 70% and no less than 30%, 35%, 40%, or 45%. According to certain examples, the percentage of the total surface area of the interior surface of the strike plate 143 occupied by the bond area on the interior surface of the strike plate 143 is between 47% and 58%, such as 52%.

In some examples, the first-part surface 520 also includes a peripheral edge surface of the crown insert 108 and the first laser 506 generates the first-part laser beam 508 and directs the first-part laser beam 508 to impact (e.g., an entirety of) the peripheral edge surface of the crown insert 108 such that a crown-insert-edge ablated surface is formed. Accordingly, the first-part ablated surface 522 can further include the crown-insert-edge ablated surface and the designated first-part bond area 548 can further include the peripheral edge surface of the crown insert 108. The crown-insert ablated surface and the crown-insert-edge ablated surface can have the same ablation pattern in certain examples. In some examples, an orientation of the crown insert 108 relative to the first-part laser 506 is adjusted when laser ablating the peripheral edge surface of the crown insert 108, compared to when laser ablating the interior surface of the crown insert 108, because of the angle of the peripheral edge surface relative to the interior surface.

When the first part 502 is the crown insert 108, the second-part surface 524 includes the top plate-opening recessed ledge 168. Accordingly, the second laser 510 generates the second-part laser beam 512 and directs the second-part laser beam 512 to impact the top plate-opening recessed ledge 168 within and along a designated second-part bond area, at least partially on the top plate-opening recessed ledge 168, to form a top-ledge ablated surface. The second-part ablated surface 526 includes, at least partially, the top-ledge ablated surface. In some examples, the second-part surface 520 also includes a top recessed-ledge sidewall, circumferentially surrounding and defining a depth of the top plate-opening recessed ledge 168, and the second laser 510 generates the second-part laser beam 512 and directs the second-part laser beam 512 to impact (e.g., an entirety of) the top recessed-ledge sidewall such that a top-sidewall ablated surface is formed. Accordingly, the second-part ablated surface 526 can further include the top-sidewall ablated surface and a designated second-part bond area can further include the top recessed-ledge sidewall. The top-ledge ablated surface and the top-sidewall ablated surface can have the same ablation pattern in certain examples. In some examples, an orientation of the body 102 relative to the second-part laser 506 is adjusted when laser ablating the top recessed-ledge sidewall, compared to when laser ablating the top plate-opening recessed ledge 168, because of the angle of the top recessed-ledge sidewall relative to the top plate-opening recessed ledge 168.

In view of the foregoing, according to some examples, the second-part ablated surface 526 is defined by the ablated surfaces of two sub-components (e.g., the continuous collar 104 and the ring 106) made of different materials. Therefore, when the second-part ablated surface 526 is laser ablated, the different materials defining the second-part ablated surface 526 can be laser ablated in a single, continuous step.

When the first part 502 is the sole insert 110, the first-part surface 520 includes an interior surface of the sole insert 110. Accordingly, the first laser 506 generates the first-part laser beam 508 and directs the first-part laser beam 508 to impact the interior surface of the sole insert 110 within and along a designated first-part bond area, at least partially on the interior surface of the crown insert 110, to form a sole-insert ablated surface. The first-part ablated surface 522 includes, at least partially, the sole-insert ablated surface. Accordingly, only a portion (e.g., outer peripheral portion) of the entire interior surface of the sole insert 110 is laser ablated, with the remaining portion of the interior surface of the sole insert 110 being non-ablated. In some examples, the first-part surface 520 also includes a peripheral edge surface of the sole insert 110 and the first laser 506 generates the first-part laser beam 508 and directs the first-part laser beam 508 to impact (e.g., an entirety of) the peripheral edge surface of the sole insert 110 such that a sole-insert-edge ablated surface is formed. Accordingly, the first-part ablated surface 522 can further include the sole-insert-edge ablated surface and the designated first-part bond area 548 can further include the peripheral edge surface of the sole insert 110. The sole-insert ablated surface and the sole-insert-edge ablated surface can have the same ablation pattern in certain examples. In some examples, an orientation of the sole insert 110 relative to the first-part laser 506 is adjusted when laser ablating the peripheral edge surface of the sole insert 110, compared to when laser ablating the interior surface, because of the angle of the peripheral edge surface relative to the interior surface.

Furthermore, when the first part 502 is the sole insert 110, the second-part surface 524 includes the sole-opening recessed ledge 170. Accordingly, the second laser 510 generates the second-part laser beam 512 and directs the second-part laser beam 512 to impact the sole-opening recessed ledge 170 within and along a designated second-part bond area, at least partially on the sole-opening recessed ledge 170, to form a bottom-ledge ablated surface. The second-part ablated surface 526 includes, at least partially, the bottom-ledge ablated surface. In some examples, the second-part surface 524 also includes a bottom recessed-ledge sidewall, circumferentially surrounding and defining a depth of the sole-opening recessed ledge 170, and the second laser 510 generates the second-part laser beam 512 and directs the second-part laser beam 512 to impact (e.g., an entirety of) the bottom recessed-ledge sidewall such that a bottom-sidewall ablated surface is formed. Accordingly, the second-part ablated surface 526 can further include the bottom-sidewall ablated surface and the designated second-part bond area can further include the bottom recessed-ledge sidewall. The bottom-ledge ablated surface and the bottom-sidewall ablated surface can have the same ablation pattern in certain examples. In some examples, an orientation of the body 102 relative to the second-part laser 510 is adjusted when laser ablating the bottom recessed-ledge sidewall, compared to when laser ablating the sole-opening recessed ledge 170, because of the angle of the bottom recessed-ledge sidewall relative to the sole-opening recessed ledge 170.

As disclosed above, in some examples, an orientation of a part being laser ablated can be adjusted relative to the laser that is ablating the part. In one example, the part is held stationary and the orientation of the laser or the directionality of the laser beam is changed relative to the part. The orientation of the laser can be changed by moving the laser, such as via a numerically-controlled robot, or adjusting the directionality of the laser beam generated by the laser, such as by using electronically controllable optical components.

According to another example, the laser is held stationary (or the directionality of the laser beam is held constant), and the orientation of the part is adjusted or the part is moved relative to the laser beam. The orientation of the part can be adjusted by fixing the part to an adjustable platform, that can be translationally moved or rotated to translationally move or rotate the part relative to the laser beam.

Although in some examples, the methods disclosed herein may be performed manually, in other examples, the methods are automated. As used herein, automated means operated at least partially by automatic equipment, such as computer-numerically-controlled (CNC) machines. The process of controlling the laser, including the directionality and/or characteristics of the laser beam, and/or controlling the orientation/position of the part relative to the laser beam is automated in some examples. For example, an electronic controller can control the laser and part-adjustment components (e.g., motors, cylinders, gears, rails, etc.) that hold and adjust the orientation/position of the part.

Because the golf club head 100 has both a crown insert 108 and a sole insert 110 attached to the body 102, in some examples, the method 550 can be performed to make a golf club head that has more than one first part 502 coupled to the second part 504. In other words, in at least one example, the golf club head 100 includes at least two first parts 502 coupled to the second part 504. Moreover, because the golf club head 100 also includes a strike plate 148 attached to the body 102, in certain examples, the method 550 can be performed to make a golf club head that has at least three first parts 502 coupled to the second part 504.

As described above, the body 102 of the golf club head 100 includes multiple pieces that are attached together to form a multi-piece construction. For example, the body 102 of the golf club head 100 includes the continuous collar 104, the ring 106, and the forward insert 200. Accordingly, in some examples, the method 550 can be performed to make a body of a golf club head that includes the first part 502 and the second part 504. The first part 502 is the ring 106 or the forward insert 200 and the second part 504 is the continuous collar 104 in certain examples. As disclosed above, the ring 106, the forward insert 200, and the continuous collar 104 can be made of different materials. For example, the ring 106 can be made of a metallic material or a plastic material having a relatively lower density than the material of the continuous collar 104, which can be made of a cast titanium material and which is less dense than the material of the forward insert 200.

When the first part 502 is the ring 106 and the second part 504 is the continuous collar 104, the first-part surface 520 includes the toe collar-engagement surface 152A and the heel collar-engagement surface 152B. Accordingly, the first laser 506 generates the first-part laser beam 508 and directs the first-part laser beam 508 to impact the toe collar-engagement surface 152A and the heel collar-engagement surface 152B within and along a designated first-part bond area, at least partially on the toe collar-engagement surface 152A and the heel collar-engagement surface 152B, to form a toe collar-engagement ablated surface and a heel collar-engagement surface, respectively. The first-part ablated surface 522 includes, at least partially, the toe collar-engagement ablated surface and the heel collar-engagement surface. The toe collar-engagement ablated surface and the heel collar-engagement surface can have the same ablation pattern in certain examples.

Correspondingly, when the first part 502 is the ring 106 and the second part 504 is the continuous collar 104, the second-part surface 524 includes the toe ring-engagement surface 150A and the heel ring-engagement surface 150B. Accordingly, the second laser 510 generates the second-part laser beam 512 and directs the second-part laser beam 512 to impact the toe ring-engagement surface 150A and the heel ring-engagement surface 150B within and along a designated second-part bond area, at least partially on the toe ring-engagement surface 150A and the heel ring-engagement surface 150B, to form a toe ring-engagement ablated surface and a heel ring-engagement surface, respectively. The second-part ablated surface 526 includes, at least partially, the toe ring-engagement ablated surface and the heel ring-engagement surface. The toe ring-engagement ablated surface and the heel ring-engagement surface can have the same ablation pattern in certain examples.

When the first part 502 is the forward insert 200 and the second part 504 is the continuous collar 104, the first-part surface 520 includes the engagement surfaces of the forward insert 200 that are configured to bond to corresponding engagement surfaces of the continuous collar 104, the strike plate 143, and the sole insert 110. Accordingly, the first laser 506 generates the first-part laser beam 508 and directs the first-part laser beam 508 to impact the engagement surfaces of the forward insert 200, within and along a designated first-part bond area, at least partially on the engagement surfaces, to form corresponding ablated surfaces on the forward insert 200. The first-part ablated surface 522 includes, at least partially, these ablated surfaces on the forward insert 200. The ablated surfaces of the forward insert can have the same ablation pattern in certain examples. Additionally, when the first part 502 is the forward insert 200 and the second part 504 is the continuous collar 104, the second-part surface 524 includes the engagement surfaces of the continuous collar 104 that are configured to be bonded to the forward insert 200. Accordingly, the second laser 510 generates the second-part laser beam 512 and directs the second-part laser beam 512 to impact the these engagement surfaces of the continuous collar 104 within and along a designated second-part bond area to form corresponding ablated surfaces. The second-part ablated surface 526 includes, at least partially, the ablated surfaces of the continuous collar 104. These ablated surfaces, which are bonded to the forward insert 200, can have the same ablation pattern in certain examples.

After the ring 106 is bonded to the continuous collar 104, the ring 106 and the continuous collar 104 can collectively define a second part 504 to which a first part 502 is bonded according to the method 550. In other words, the second part 504 can have a multi-piece construction. In fact, in one example, the continuous collar 104 is the first part 502 and the forward insert 200 is the second part 504, such that these multiple pieces (e.g., made of the same or different materials) have ablated surfaces bonded together after the manner of the method 550.

In some examples, the step of laser ablating the first-part surface 520 or the step of laser ablating the second-part surface 524 is performed to remove alpha case from a corresponding one of the first part 502 or the second part 504. In such examples, the corresponding one of the first part 502 or the second part 504 is made of a titanium alloy that is prone to developing a layer of alpha case on the first-part surface 520 or the second-part surface 524, respectively, during manufacturing (e.g., casting) of the corresponding part (see, e.g., U.S. Pat. No. 10,780,327, issued Sep. 22, 2020, which is incorporated herein by reference). The corresponding one of the first-part surface 520 or the second-part surface 524 is ablated to a depth sufficient to remove the layer of alpha case from the corresponding part. Using the laser ablation method disclosed herein enables the alpha case to be removed with more precision, efficiency, and lower waste materials that conventional methods, such as chemical etching, computer numerically-controlled (CNC) machine, or abrasion techniques.

Figure 37:
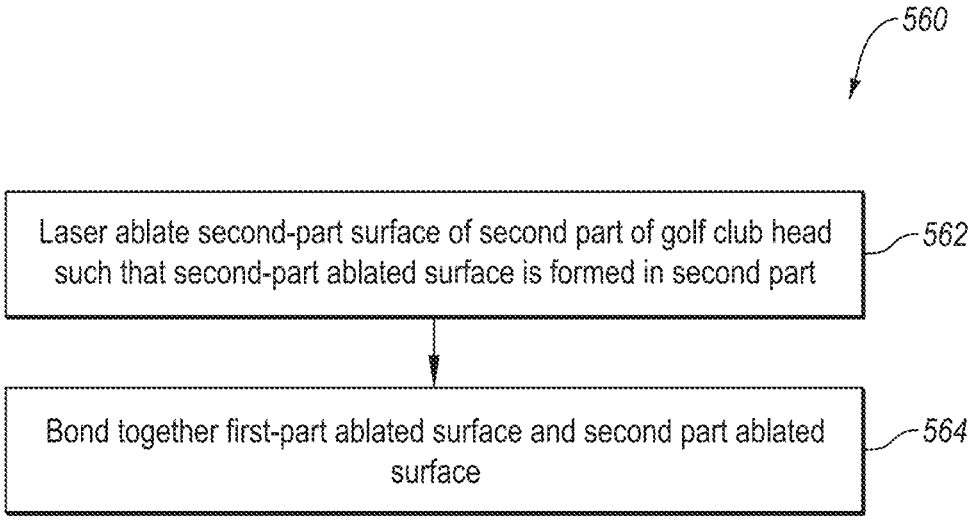
FIG. 37 is a schematic flow diagram of a method of making a golf club head, according to one or more examples of the present disclosure.
Figure 38:
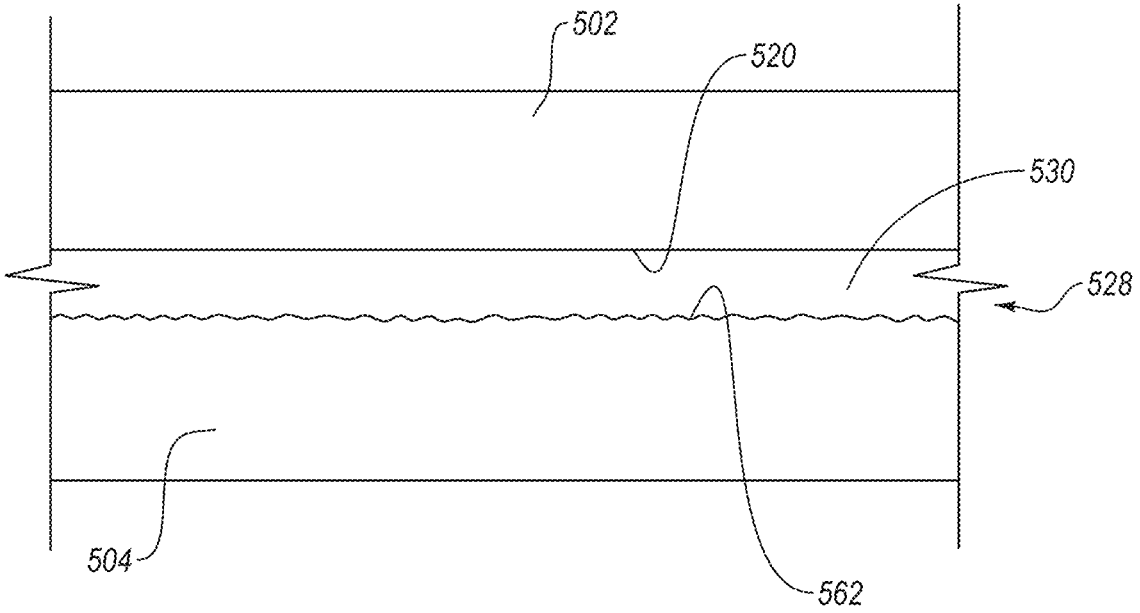
FIG. 38 is a schematic, side elevation view of a first part, of a golf club head, bonded to a second part, of the golf club head, according to one or more examples of the present disclosure.

Referring to FIGS. 37 and 38, in alternative examples, only one of the two surfaces forming the bondline 528 is laser ablated. According to one example, a method 560 of making the golf club heads of the present disclosure, such as the golf club head 100, includes (block 562) laser ablating the second-part surface 524 of the second part 504 of the golf club head 100 such that the second-part ablated surface 526 is formed in the second part 504. The method 560 additionally includes (block 564) bonding together the first-part surface 520, of the first part 502 of the golf club head 100, and the second-part ablated surface 526 of the second part 504. In other words, instead of the second-part ablated surface 526 being bonded to a first-part ablated surface of the first part 502, the second-part ablated surface 526 of the second part 504 is bonded to a non-ablated surface (i.e., the first-part surface 520) of the first part 502.

In certain examples, the second part 504 in the method 560 is made of a titanium alloy, such as a cast alloy, and the first part 502 in the method 560 is made of a fiber-reinforced polymeric material. For example, the first part 502 can be the strike plate 143, the second part 504 can be the continuous collar 104 and the forward insert 200, and the second-part ablated surface 526 can define the plate-opening recessed ledge 147. The interior surface 166 of the strike plate 143 used in the method 560 is not laser ablated. Instead, the interior surface 166 of the strike plate 143 is untreated or treated using a different type of surface treatment, such as media blasting or chemical etching. According to another example, the first part 502 can be one of the crown insert 108 or the sole insert 110, the second part 504 can be the body 102, and the second-part ablated surface 526 can define one of the top plate-opening recess ledge or the sole-opening recessed ledge.

Each bonded joint of the golf club head 100 is defined by two bonded surfaces (e.g., faying surfaces). Because a bonded joint has two equal and opposite bonded surfaces, a surface area of each bonded joint (i.e., bond area of each bonded joint) is defined as the surface area of just one of the two bonded surfaces. In other words, as defined herein, the bond area of each bonded joint does not include the surface area of both bonded surfaces of the bonded joint. Accordingly, as used herein, the bond area of a bonded joint, defined between two surfaces of the golf club head disclosed herein, is the surface area of the portion of any one (but just one) of the two surfaces of the bonded joint that is covered by or in direct contact with an adhesive between the two surfaces. In view of this definition, the bond area is equal to the surface area of one of two surfaces of the adhesive (e.g., the adhesive 530) defining the bonded joint.

In some examples, at least one of the two bonded surfaces of at least one bonded joint of the golf club head 100 is a laser ablated surface. Accordingly, the bond area of a bonded joint defined by a laser ablated surface can be the surface area of the laser ablated surface. Therefore, unless otherwise noted, a surface area of an ablated surface is equal to the bond area of the bonded joint defined by the laser ablated surface. Moreover, the bond area of a bonded joint defined by a non-ablated surface (e.g., the first-part surface 520 of FIG. 38) and an ablated surface is the surface area of the portion of the non-ablated surface that is bonded to the ablated surface or the portion of the non-ablated surface that is covered by or in direct contact with the adhesive 530. Accordingly, a non-ablated surface can have a total surface area that is larger than the surface area of the portion of the non-ablated surface bonded to the ablated surface of a bonded joint.

As defined herein, the surface area of a laser ablated surface is the area of the portion of the surface covered by the pattern of peaks and valleys formed by the laser beam. Accordingly, the surface area of a laser ablated surface can be calculated as a length times a width of the portion of the surface that includes the pattern of peaks and valleys, or calculated by the combined surface area of the peaks and valleys of the pattern of peaks and valleys. Moreover, because in some examples, the bonded surfaces of a bonded joint are contoured, to provide a more convenient way of calculating the area of the bonded surfaces, as defined herein, the surface area of a surface is a projected surface area, which is the surface area of the surface projected onto a hypothetical plane substantially facing the surface.

Generally, a total bond area of the golf club head 100 is higher than conventional golf club heads. Moreover, a high percentage, such as 50%-100%, of the total bond area of the golf club head 100 is defined by laser ablated surfaces. According to one example, the second-part ablated surface 526 of the golf club head 100 has a surface area between 800 $mm^2$ and 2,880 $mm^2$. In this, or other examples, the second-part ablated surface 526 of the golf club head 100 has a surface area of at least 1,560 $mm^2$, of at least 1,770 $mm^2$, of at least 2,062 $mm^2$, or of at least 2,600 $mm^2$. As defined previously, the first-part surface 520 or the first-part ablated surface 522 of the golf club head 100 can have corresponding surface areas because they would define the side of a bonded joint opposite the second-part ablated surface 526. Referring to Table 3 below, areas of some features and the bond area (in $mm^2$) of bonded surfaces of bonded joints of several examples of the golf club heads disclosed herein, which can be the same as or different than the examples of Table 2, is shown.

TABLE 3

| | Example 1 | Example 2 | Example 3 |
|---|---|---|---|
| Plate Opening Area | 2266 | 1674 | 1330-2720 |
| Front-Ledge Ablated Surface Area | 1010 | — | 800-1220 |
| Front-Sidewall Ablated Surface Area | 806 | — | 640-970 |
| Strike Face Ablated Surface Area | 1073 | 1073 | 850-1290 |
| Lower Cup Piece Ablated Surface Area | — | 599 | 470-720 |
| Lower Cup Piece Ledge Ablated Surface Area | — | 267 | 210-330 |
| Lower Cup Piece Sidewall Ablated Surface Area | — | 222 | 170-270 |
| Ring-Engagement Ablated Surface Area | 80 | — | 60-100 |
| Collar-engagement Ablated Surface Area | 112 | — | 80-140 |
| Cup Top-Ledge Ablated Surface Area | 1424 | — | 1130-2000 |
| Cup Bottom-Ledge Ablated Surface Area | 1000 | — | 800-1200 |
| Ring Top-Ledge Ablated Surface Area | 935 | — | 740-1130 |
| Ring Bottom-Ledge Ablated Surface Area | 1420 | — | 1130-1710 |

In some examples, the first forward sole-opening recessed ledge 170A (e.g., the cup bottom-ledge ablated surface area of Table 3) defines a bond area of about 1,054 $mm^2$, the forward crown-opening recessed ledge 168A (e.g., the cup top-ledge ablated surface area of Table 3) defines a bond area of about 1,910 $mm^2$, the toe ring-engagement surface 150A and the heel ring-engagement surface 150B (e.g., the ring-engagement ablated surface area of Table 3) or the toe collar-engagement surface 152A and the heel collar-engagement surface 152B (e.g., the collar-engagement ablated surface area of Table 3) are about 98 $mm^2$, the plate-opening recessed ledge 147 and the sidewall 146 (e.g., the front-ledge ablated surface area and the front-sidewall ablated surface area) define a bond area of about 2,240 $mm^2$, a total bond area defined by the continuous collar 104 is 5,300 $mm^2$. According to the same or alternative examples, the rearward crown-opening recessed ledge 168B (e.g., the ring top-ledge ablated surface area of Table 3) defines a bond area of about 928 $mm^2$, the rearward sole-opening recessed ledge 170B (e.g., the ring bottom-ledge ablated surface area of Table 3) defines a bond area of about 1,222 $mm^2$, and a total bond area defined by the ring 106 is 2,250 $mm^2$.

In view of the foregoing, in some examples, the golf club head 100 includes a single component or piece (e.g., the ring 106) that is bonded to three other components or pieces of the golf club head 100 where a total bonded area between these four components or pieces of the golf club head 100 is between 1,950 $mm^2$ and 2,500, $mm^2$, or more preferably between 2,100 $mm^2$ and 2,400 $mm^2$. According to some examples, the golf club head 100 includes a single component or piece (e.g., the continuous collar 104) that is bonded to three other components or pieces of the golf club head 100 where a total bonded area between these four components or pieces of the golf club head 100 is between 2,250 $mm^2$ and 3,400, $mm^2$, or more preferably between 2,900 $mm^2$ and 3,200 $mm^2$. According to yet some examples, the golf club head 100 includes a single component or piece (e.g., the continuous collar 104) that is bonded to four other components or pieces of the golf club head 100 where a total bonded area between these five components or pieces of the golf club head 100 is between 4,750 $mm^2$ and 6,200, $mm^2$, or more preferably between 4,900 $mm^2$ and 5,500 $mm^2$. In certain examples, the golf club head includes a single component or piece (e.g., the upper cup piece 304A) that is bonded to five other components or pieces of the golf club head 100 where a total bonded area between these six components or pieces of the golf club head 100 is between 5,500 $mm^2$ and 7,000, $mm^2$, or more preferably between 5,700 $mm^2$ and 6,300 $mm^2$.

The golf club head 100 has a high bond area, between multiple pieces of the golf club heads, relative to a volume of the golf club head 100. In other words, for a given size of a golf club head, the amount of bonded area is significantly higher than for conventional golf club heads. According to some examples, the volume of the golf club head 100 is between 450 cc and 600 cc, and more preferably between 450 cc and 470 cc. Moreover, in certain examples, a bond-volume ratio, or a ratio of a combined bond area of the plurality of bonded joints of the golf club head 100 to a volume of the golf club head is at least 3.75 $mm^2$/cc and at most 15.5 $mm^2$/cc (e.g., at least 9.1 $mm^2$/cc and at most 14.0 $mm^2$/cc). In some examples, the bond-volume ratio of at least some of the examples of the golf club head is at least 7.9 $mm^2$/cc and at most 13.7 $mm^2$/cc (e.g., at least 8.1 $mm^2$/cc and at most 12.2 $mm^2$/cc). In yet some examples, the bond-volume ratio of at least some of the examples of the golf club head 100 is at least 3.75 $mm^2/cc$ and at most 7.5 $mm^2/cc$ (e.g., at least 4.8 $mm^2/cc$ and at most 7.1 $mm^2/cc$).

According to some alternative examples, a bond-volume ratio, or a ratio of a combined bond area of the plurality of bonded joints of the golf club head 100 to a volume of the golf club head is at least 10 $mm^2/cc$ and at most 18.8 $mm^2/cc$ (e.g., at least 10 $mm^2/cc$ and at most 15.5 $mm^2/cc$ or at least 11.6 $mm^2/cc$ and at most 17.7 $mm^2/cc$). In some examples, the bond-volume ratio of at least some of the examples of the golf club head 100 is at least 10.5 $mm^2/cc$ and at most 15.3 $mm^2/cc$, at least 11.6 $mm^2/cc$ and at most 18.8 $mm^2/cc$, or at least 12.1 $mm^2/cc$ and at most 17.5 $mm^2/cc$.

The golf club head 100 is made of multiple pieces adhesively bonded together. Accordingly, in some examples, the golf club head 100 includes multiple pieces coupled together via an adhesive such that no portions or pieces of the golf club head 100 are welded together.

The bond area of a bonded joint is defined by a width ($W_{BA}$) and a length ($L_{BA}$) of the bonded joint (see, e.g., FIG. 12A). The width $W_{BA}$ can be variable along the length $L_{BA}$ of a bonded joint. Generally, the length $L_{BA}$ of the bond area of a bonded joint is greater than the width $W_{BA}$ of the bond area of the bonded joint. The bonded joint can be continuous such that a length $L_{BA}$ of the bond area of the bonded joint is continuous. However, in some examples, the bonded joint is non-continuous or intermittent such that the length $L_{BA}$ of the bond area of the bonded joint is a summation of the lengths of the intervals of the bonded joint. Although the width $W_{BA}$ and the length $L_{BA}$ of the bonded area of only two bonded joints (e.g., the bonded area associated with the forward crown-opening recessed ledge 168A and the rearward crown-opening recessed ledge 168B) are shown in FIG. 12A, it is recognized that, although not specifically labeled, the bonded area of each one of the bonded joints of the golf club head 100 has a corresponding width $W_{BA}$ and length $L_{BA}$, similar to those shown in FIG. 12A, that are not labeled for ease in showing and labeling other features of the golf club head 100. Additionally, regarding the length $L_{BA}$, as defined herein, the length $L_{BA}$ of the bond area of a bonded joint is the maximum length of the bond area. Accordingly, where a bond area can be considered to have two different lengths, such as a maximum length (e.g., along an outer perimeter of the bond area, such as shown in FIG. 12A) and a minimum length (e.g., along an inner perimeter of the bond area), the length $L_{BA}$ of the bond area is defined herein to be the largest or maximum length of the bond area.

According to some examples, the bond area of at least one bonded joint of the golf club head 100 has a continuous length $L_{BA}$ of between 174 mm and 405 mm, such as at least 250 mm. For example, the combined bond area defined by the forward crown-opening recessed ledge 168A and the rearward crown-opening recessed ledge 168B has a continuous length $L_{BA}$ of at least 268 mm, of at least 300 mm, at least 316 mm, at least 353 mm, or at least 370 mm. As another example, the combined bond area defined by the first forward sole-opening recessed ledge 170A and the rearward sole-opening recessed ledge 170B has a continuous length $L_{BA}$ of at least 281 mm, of at least 314 mm, at least 331 mm, at least 350 mm, or at least 367 mm. According to yet another example, the bond area defined by the plate-opening recessed ledge 147 has a continuous length $L_{BA}$ of at least 174 mm, of at least 194 mm, at least 205 mm, at least 250 mm, or at least 262 mm. According to some examples, a combined length of the plurality of bonded joints is at least 723 mm and at most 1,094 mm, such as between 852 mm and 953 mm.

In some examples, a length-area ratio, equal to a ratio of the length $L_{BA}$ to the bond area of a bonded joint, of the bond defined by the forward crown-opening recessed ledge 168A and the rearward crown-opening recessed ledge 168B is between 0.13 and 0.16, such as around 0.15. In yet some examples, the length-area ratio of the bond defined by the first forward sole-opening recessed ledge 170A and the rearward sole-opening recessed ledge 168B is between 0.13 and 0.16, such as around 0.15.

In yet some examples, the length-area ratio of the bond defined by the first forward sole-opening recessed ledge 170A and the rearward sole-opening recessed ledge 168B is between 0.13 and 0.16, such as around 0.15.

In yet some examples, the length-area ratio of the bond defined by the plate-opening recessed ledge 147 is between 0.10 and 0.13, such as around 0.11.

Although not specifically shown, the golf club head 100 of the present disclosure may include other features to promote the performance characteristics of the golf club head 100. For example, the golf club head 100, in some implementations, includes movable weight features similar to those described in more detail in U.S. Pat. Nos. 6,773,360; 7,166,040; 7,452,285; 7,628,707; 7,186,190; 7,591,738; 7,963,861; 7,621,823; 7,448,963; 7,568,985; 7,578,753; 7,717,804; 7,717,805; 7,530,904; 7,540,811; 7,407,447; 7,632,194; 7,846,041; 7,419,441; 7,713,142; 7,744,484; 7,223,180; 7,410,425; and 7,410,426, the entire contents of each of which are incorporated herein by reference in their entirety.

In certain implementations, for example, the golf club head 100 includes slidable weight features similar to those described in more detail in U.S. Pat. Nos. 7,775,905 and 8,444,505; U.S. patent application Ser. No. 13/898,313, filed on May 20, 2013; U.S. patent application Ser. No. 14/047,880, filed on Oct. 7, 2013; U.S. Patent Application No. 61/702,667, filed on Sep. 18, 2012; U.S. patent application Ser. No. 13/841,325, filed on Mar. 15, 2013; U.S. patent application Ser. No. 13/946,918, filed on Jul. 19, 2013; U.S. patent application Ser. No. 14/789,838, filed on Jul. 1, 2015; U.S. Patent Application No. 62/020,972, filed on Jul. 3, 2014; Patent Application No. 62/065,552, filed on Oct. 17, 2014; and Patent Application No. 62/141,160, filed on Mar. 31, 2015, the entire contents of each of which are hereby incorporated herein by reference in their entirety.

According to some implementations, the golf club head 100 includes aerodynamic shape features similar to those described in more detail in U.S. Patent Application Publication No. 2013/0123040A1, the entire contents of which are incorporated herein by reference in their entirety.

In certain implementations, the golf club head 100 includes removable shaft features similar to those described in more detail in U.S. Pat. No. 8,303,431, the contents of which are incorporated by reference herein in in their entirety.

According to yet some implementations, the golf club head 100 includes adjustable loft/lie features similar to those described in more detail in U.S. Pat. Nos. 8,025,587; 8,235,831; 8,337,319; U.S. Patent Application Publication No. 2011/0312437A1; U.S. Patent Application Publication No. 2012/0258818A1; U.S. Patent Application Publication No. 2012/0122601A1; U.S. Patent Application Publication No. 2012/0071264A1; and U.S. patent application Ser. No. 13/686,677, the entire contents of which are incorporated by reference herein in their entirety.

Additionally, in some implementations, the golf club head 100 includes adjustable sole features similar to those described in more detail in U.S. Pat. No. 8,337,319; U.S.

Patent Application Publication Nos. 2011/0152000A1, 2011/0312437, 2012/0122601A1; and U.S. patent application Ser. No. 13/686,677, the entire contents of each of which are incorporated by reference herein in their entirety.

In some implementations, the golf club head 100 includes composite face portion features similar to those described in more detail in U.S. patent application Ser. Nos. 11/998,435; 11/642,310; 11/825,138; 11/823,638; 12/004,386; 12/004,387; 11/960,609; 11/960,610; and U.S. Pat. No. 7,267,620, which are herein incorporated by reference in their entirety.

According to one example, a method of making a golf club head, such as the golf club head 100, includes one or more of the following steps: (1) forming a body having a sole opening, forming a composite laminate sole insert, injection molding a thermoplastic composite head component over the sole insert to create a sole insert unit, and joining the sole insert unit to the body; (2) forming a body having a crown opening, forming a composite laminate crown insert, injection molding a thermoplastic composite head component over the crown insert to create a crown insert unit, and joining the crown insert unit to the body; (3) forming a weight track, capable of supporting one or more slidable weights, in the body; (4) forming the sole insert and/or the crown insert from a thermoplastic composite material having a matrix compatible for bonding with the body; (5) forming the sole insert and/or the crown insert from a continuous fiber composite material having continuous fibers selected from the group consisting of glass fibers, aramid fibers, carbon fibers and any combination thereof, and having a thermoplastic matrix consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; (6) forming both the sole insert and the weight track from thermoplastic composite materials having a compatible matrix; (7) forming the sole insert from a thermosetting material, coating a sole insert with a heat activated adhesive, and forming the weight track from a thermoplastic material capable of being injection molded over the sole insert after the coating step; (8) forming the body from a material selected from the group consisting of titanium, one or more titanium alloys, aluminum, one or more aluminum alloys, steel, one or more steel alloys, polymers, plastics, and any combination thereof; (9) forming the body with a crown opening, forming the crown insert from a composite laminate material, and joining the crown insert to the body such that the crown insert overlies the crown opening; (10) selecting a composite head component from the group consisting of one or more ribs to reinforce the golf club head, one or more ribs to tune acoustic properties of the golf club head, one or more weight ports to receive a fixed weight in a sole portion of the golf club head, one or more weight tracks to receive a slidable weight, and combinations thereof; (11) forming the sole insert and the crown insert from a continuous carbon fiber composite material; (12) forming the sole insert and the crown insert by thermosetting using materials suitable for thermosetting, and coating the sole insert with a heat activated adhesive; and (13) forming the body from titanium, titanium alloy or a combination thereof to have the crown opening, the sole insert, and the weight track from a thermoplastic carbon fiber material having a matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; and (13) forming a frame with a crown opening, forming a crown insert from a thermoplastic composite material, and joining the crown insert to the body such that the crown insert overlies the crown opening.

The disclosure contains a delicate interplay of relationships of the various components, variables within each component, as well as relationships across the components, which impact the performance, sound, feel, durability, and manufacturability of the golf club head. The disclosed relationships are more than mere optimization, maximization, or minimization of a single characteristic or variable, and are often contrary to conventional design thinking, yet have been found to achieve a unique balance of the trade-offs associated with competing criteria such as durability, acoustics, vibration, fatigue resistance, weight, and ease of manufacture. The relationships disclosed do more than maximize or minimize a single characteristic such as characteristic time (CT), coefficient of restitution (COR) at a single point such as face center or offset/distributed COR, moments of inertia, deflection of a single component, frequency of a single components, damping, and/or changes in mode frequencies of the individual components, rather, the relationships achieve a unique balance among these characteristics, which are often conflicting, to produce a club head that has improved feel, sound, and/or performance. After all, the interaction of the numerous components of the present golf club head, particularly when they have such varied material properties, has the potential to adversely impact the sound and feel of the golf club head, as well as its durability, manufacturability, and overall performance.

The aforementioned balance requires trade-offs among the competing characteristics recognizing key points of diminishing returns. Further, it is important to recognize that all the associated disclosure and relationships apply equally to all embodiments and should not be interpreted as being limited to the particular embodiment being discussed when a relationship is mentioned. The aforementioned balances require trade-offs among the competing characteristics recognizing key points of diminishing returns, as often disclosed with respect to open and closed ranges for particular variables and relationships. Proper functioning of each component, and the overall club head, on each and every shot, over thousands of impacts during the life of a golf club, is critical. Therefore, this disclosure contains unique combinations of components and relationships that achieve these goals. While the relationships of the various features and dimensions of a single component play an essential role in achieving the goals, the relationships of features and/or characteristics across multiple components are just as critical, if not more critical, to achieving the goals. Further, the relative length, width, thickness, geometry, and material properties of various components, and their relationships to one another and the other design variables disclosed herein, influence the performance, durability, feel, sound, safety, and ease of manufacture.

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some examples, can be defined to mean within +/−5% of a given value.

Additionally, examples in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. A golf club head, comprising:

a crown portion, defining a crown of the golf club head;

a sole portion, opposite the crown portion and defining a sole of the golf club head;

a heel portion, defining a heel of the golf club head and located between the crown portion and the sole portion;

a toe portion, defining a toe of the golf club head, located between the crown portion and the sole portion, and opposite the heel portion;

a rearward portion, located between the crown portion and the sole portion;

a forward portion, opposite the rearward portion and located between the crown portion and the sole portion, wherein the forward portion comprises a plate opening, a plate-opening recessed ledge defining the plate opening, and a strike plate attached to the plate-opening recessed ledge and covering the plate opening;

a hollow interior cavity, defined and enclosed by the crown portion, the sole portion, the heel portion, the toe portion, the rearward portion, and the forward portion; and at least six pieces adhesively bonded together, wherein at least a portion of a top half of the plate-opening recessed ledge is made of a first material having a first density and at least a portion of a bottom half of the plate-opening recessed ledge is made of a second material having a second density that is greater than the first density;

wherein the top half of the plate-opening recessed ledge is closer to the crown portion than the bottom half of the plate-opening recessed ledge and the bottom half of the plate-opening recessed ledge is closer to the sole portion than the top half of the plate-opening recessed ledge; and wherein the at least six pieces comprise: (i) a continuous collar, made of the first material and defining the at least the portion of the top half of the plate-opening recessed ledge; (ii) a forward insert made of the second material, defining the at least the portion of the bottom half of the plate-opening recessed ledge, and adhesively bonded directly to the continuous collar; (iii) a strike plate, adhesively bonded directly to both the continuous collar and the forward insert; (iv) a ring, adhesively bonded directly to the continuous collar; (v) a crown insert, adhesively bonded directly to the continuous collar and the ring; and (vi) a sole insert, adhesively bonded directly to the continuous collar, the ring, and the forward insert.

2. The golf club head according to claim 1, wherein the strike plate is adhesively bonded to the plate-opening recessed ledge.

3. The golf club head according to claim 1, wherein:

the forward portion comprises a continuous collar and a forward insert attached to the continuous collar;

the continuous collar is made of the first material and defines the at least the portion of the top half of the plate-opening recessed ledge; and the forward insert is made of the second material and defines the at least the portion of the bottom half of the plate-opening recessed ledge.

4. The golf club head according to claim 3, wherein the forward insert is closer to the heel of the golf club head than the toe of the golf club head.

5. The golf club head according to claim 3, wherein the forward insert defines a forwardmost point of the golf club head and a bottommost point of the golf club head.

6. The golf club head according to claim 3, wherein the forward insert forms part of the forward portion and the sole portion, and defines a portion of the sole of the golf club head.

7. The golf club head according to claim 3, wherein the forward insert is adhesively bonded to the continuous collar.

8. The golf club head according to claim 3, wherein:

the continuous collar comprises a forward notch at a forward edge of the continuous collar and extending rearwardly from the forwardmost portion of the continuous collar; and the forward insert is nestably received within the forward notch of the continuous collar.

9. The golf club head according to claim 8, wherein:

the continuous collar comprises an insert-retention receptacle that is circumferentially closed;

the forward insert comprises an insert-retention projection; and the insert-retention projection of the forward insert is nestably received within the insert-retention receptacle of the continuous collar.

10. The golf club head according to claim 9, wherein the insert-retention receptacle of the continuous collar and the insert-retention projection of the forward insert are closer to the toe of the golf club head than the heel of the golf club head.

11. The golf club head according to claim 8, wherein:

the continuous collar comprises an insert-retention ridge, protruding in a crown-to-sole direction and having a forward-facing surface and a rearward-facing surface;

the forward insert comprises an insert-retention channel having a forward-facing surface and a rearward-facing surface; and the insert-retention ridge of the continuous collar is nestably received within the insert-retention channel of the forward insert such that the forward-facing surface of the insert-retention ridge is directly engaged with the rearward-facing surface of the insert-retention channel and the rearward-facing surface of the insert-retention ridge is directly engaged with the forward-facing surface of the insert-retention channel.

12. The golf club head according to claim 11, wherein the insert-retention ridge of the continuous collar and the insert-retention channel of the forward insert is closer to the heel of the golf club head than the toe of the golf club head.

13. The golf club head according to claim 11, wherein:

the continuous collar comprises an internal valley that defines the insert-retention ridge;

the internal valley extends parallel to the strike face; and the continuous collar further comprises a rib that extends across the internal valley in a direction perpendicular to the strike face.

14. The golf club head according to claim 3, wherein a thickness of a heelward portion of the forward insert gradually increases in a toe-to-heel direction.

15. The golf club head according to claim 3, wherein an outer surface of the continuous collar is flush with an outer surface of the forward insert.

16. The golf club head according to claim 3, wherein:

the forward insert defines a portion of the sole of the golf club head;

the forward insert comprises a slot formed in the portion of the sole defined by the forward insert;

the slot is open to the hollow interior cavity; and an entirety of the slot is confined within the forward insert.

17. The golf club head according to claim 3, further comprising a hosel, located at the heel portion of the golf club head and defining a bore, wherein the forward insert comprises a fastener port that is open to the bore of the hosel.

18. The golf club head according to claim 3, wherein the continuous collar comprises an internal rib, parallel to the strike plate and rearwardly offset from the at least the portion of the bottom half of the plate-opening recessed ledge defined by the forward insert.

19. The golf club head according to claim 3, wherein the continuous collar defines at least a portion of the bottom half of the plate-opening recessed ledge.

20. The golf club head according to claim 1, wherein the strike plate is made of a third material having a third density that is less than the first density.

21. The golf club head according to claim 20, wherein:

the first material is a titanium alloy;

the second material is one of a steel alloy or a tungsten alloy; and the third material is a fiber-reinforced polymer.

22. The golf club head according to claim 1, wherein:

the sole portion comprises a sole opening, a sole-opening recessed ledge defining the sole opening, and a sole insert attached to the sole-opening recessed ledge and covering the sole opening;

a first portion of the sole-opening recessed ledge is made of the first material; and a second portion of the sole-opening recessed ledge is made of the second material.

23. The golf club head according to claim 22, wherein:

the forward portion comprises a continuous collar and a forward insert attached to the continuous collar;

the continuous collar is made of the first material, defines the at least the portion of the top half of the plate-opening recessed ledge, and defines the first portion of the sole-opening recessed ledge; and the forward insert is made of the second material, defines the at least the portion of the bottom half of the plate-opening recessed ledge, and defines the second portion of the sole-opening recessed ledge.

24. The golf club head according to claim 23, wherein the sole insert is made of a third material having a third density that is less than the first density.

25. The golf club head according to claim 24, wherein:

the first material is a titanium alloy;

the second material is one of a steel alloy or a tungsten alloy; and the third material is a fiber-reinforced polymer.

26. The golf club head according to claim 1, wherein the ring is made of a third material having a third density less than the first density; and the strike plate, the crown insert, and the sole insert are made of a fourth material having a fourth density less than the third density.

27. The golf club head according to claim 26, wherein:

the first material is a titanium alloy;

the second material is one of a steel alloy or a tungsten alloy;

the third material is one of an aluminum alloy or plastic; and the fourth material is a fiber-reinforced polymer.

28. A golf club head, comprising:

a crown portion, defining a crown of the golf club head;

a sole portion, opposite the crown portion and defining a sole of the golf club head;

a heel portion, defining a heel of the golf club head and located between the crown portion and the sole portion;

a toe portion, defining a toe of the golf club head, located between the crown portion and the sole portion, and opposite the heel portion;

a rearward portion, located between the crown portion and the sole portion;

a forward portion, opposite the rearward portion and located between the crown portion and the sole portion, wherein the forward portion comprises a plate opening, a plate-opening recessed ledge defining the plate opening, and a strike plate attached to the plate-opening recessed ledge and covering the plate opening;

a hollow interior cavity, defined and enclosed by the crown portion, the sole portion, the heel portion, the toe portion, the rearward portion, and the forward portion; and a hosel, located at the heel portion of the golf club head and defining a bore, wherein:

at least a portion of a top half of the plate-opening recessed ledge is made of a first material having a first density and at least a portion of a bottom half of the plate-opening recessed ledge is made of a second material having a second density that is greater than the first density;

the top half of the plate-opening recessed ledge is closer to the crown portion than the bottom half of the plate-opening recessed ledge and the bottom half of the plate-opening recessed ledge is closer to the sole portion than the top half of the plate-opening recessed ledge;

the forward portion comprises a continuous collar and a forward insert attached to the continuous collar;

the continuous collar is made of the first material and defines the at least the portion of the top half of the plate-opening recessed ledge;

the forward insert is made of the second material and defines the at least the portion of the bottom half of the plate-opening recessed ledge; and the forward insert comprises a fastener port that is open to the bore of the hosel.

29. A golf club head, comprising:

a crown portion, defining a crown of the golf club head;

a sole portion, opposite the crown portion and defining a sole of the golf club head;

a heel portion, defining a heel of the golf club head and located between the crown portion and the sole portion;

a toe portion, defining a toe of the golf club head, located between the crown portion and the sole portion, and opposite the heel portion;

a rearward portion, located between the crown portion and the sole portion;

a forward portion, opposite the rearward portion and located between the crown portion and the sole portion, wherein the forward portion comprises a plate opening, a plate-opening recessed ledge defining the plate opening, and a strike plate attached to the plate-opening recessed ledge and covering the plate opening; and a hollow interior cavity, defined and enclosed by the crown portion, the sole portion, the heel portion, the toe portion, the rearward portion, and the forward portion, wherein:

at least a portion of a top half of the plate-opening recessed ledge is made of a first material having a first density and at least a portion of a bottom half of the plate-opening recessed ledge is made of a second material having a second density that is greater than the first density;

the top half of the plate-opening recessed ledge is closer to the crown portion than the bottom half of the plate-opening recessed ledge and the bottom half of the plate-opening recessed ledge is closer to the sole portion than the top half of the plate-opening recessed ledge;

the forward portion comprises a continuous collar and a forward insert attached to the continuous collar;

the continuous collar is made of the first material and defines the at least the portion of the top half of the plate-opening recessed ledge;

the forward insert is made of the second material and defines the at least the portion of the bottom half of the plate-opening recessed ledge;

the continuous collar comprises a forward notch at a forward edge of the continuous collar and extending rearwardly from the forwardmost portion of the continuous collar;

the forward insert is nestably received within the forward notch of the continuous collar;

the continuous collar comprises an insert-retention receptacle that is circumferentially closed;

the forward insert comprises an insert-retention projection; and the insert-retention projection of the forward insert is nestably received within the insert-retention receptacle of the continuous collar.

* * * * *